US006539707B2

(12) United States Patent
Ikemoto et al.

(10) Patent No.: US 6,539,707 B2
(45) Date of Patent: Apr. 1, 2003

(54) EXHAUST EMISSION CONTROL SYSTEM FOR INTERNAL COMBUSTION ENGINE

(75) Inventors: Noriaki Ikemoto, Kariya (JP); Yukihiro Yamashita, Takahama (JP); Hisashi Iida, Kariya (JP); Kouichi Shimizu, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/968,837

(22) Filed: Oct. 3, 2001

(65) Prior Publication Data

US 2002/0038544 A1 Apr. 4, 2002

(30) Foreign Application Priority Data

| | | |
|---|---|---|
| Oct. 3, 2000 | (JP) | 2000-308001 |
| Feb. 7, 2001 | (JP) | 2001-031532 |
| Mar. 9, 2001 | (JP) | 2001-065962 |
| Mar. 19, 2001 | (JP) | 2001-077396 |
| Mar. 23, 2001 | (JP) | 2001-083964 |

(51) Int. Cl.[7] ..... F01N 3/00
(52) U.S. Cl. ..... 60/285; 60/276; 60/299
(58) Field of Search ..... 60/274, 276, 285; 123/674, 679

(56) References Cited

U.S. PATENT DOCUMENTS

| | | | | |
|---|---|---|---|---|
| 5,090,199 A | | 2/1992 | Ikuta et al. | |
| 5,159,810 A | * | 11/1992 | Grutter et al. | 123/691 |
| 5,438,826 A | | 8/1995 | Blischke et al. | |
| 5,509,267 A | * | 4/1996 | Theis | 60/274 |
| 5,568,725 A | * | 10/1996 | Uchikawa | 123/688 |
| 5,644,912 A | * | 7/1997 | Kawamura | 60/276 |
| 5,740,676 A | * | 4/1998 | Agustin et al. | 60/276 |
| 5,743,084 A | * | 4/1998 | Hepburn | 60/274 |
| 5,826,426 A | * | 10/1998 | Weber et al. | 60/274 |
| 5,847,271 A | * | 12/1998 | Poublon et al. | 340/438 |
| 6,256,981 B1 | * | 7/2001 | Sullivan et al. | 123/672 |
| 6,256,983 B1 | * | 7/2001 | Yasui | 123/674 |
| 6,321,530 B1 | * | 11/2001 | Hoshi et al. | 60/274 |
| 6,370,473 B1 | * | 4/2002 | Yasui et al. | 123/692 |

FOREIGN PATENT DOCUMENTS

| | | |
|---|---|---|
| JP | A-6-294342 | 10/1994 |
| JP | A-8-193537 | 7/1996 |

* cited by examiner

*Primary Examiner*—Thomas Denion
*Assistant Examiner*—Diem Tran
(74) *Attorney, Agent, or Firm*—Nixon & Vanderhye P.C.

(57) ABSTRACT

An upstream catalyst and a downstream catalyst are disposed in series in an exhaust pipe, and first through third sensors for detecting the air-fuel ratio or an adsorption amount of hazardous components on the rich/lean side of exhaust gases are disposed on the upstream and downstream sides of the upstream catalyst and the downstream side of the downstream catalyst, respectively. An ECU for controlling an engine controls the air-fuel ratio so that when the adsorption amount of the hazardous components on the rich side of the downstream catalyst is large, that of the hazardous components on the lean side of the upstream catalyst is large. Similarly, the ECU controls the air-fuel ratio so that when the adsorption amount of the hazardous components on the lean side of the downstream catalyst is large, that of the hazardous components on the rich side of the upstream catalyst is large.

22 Claims, 28 Drawing Sheets

| | SECOND SENSOR | THIRD SENSOR | Grich | Glean |
|---|---|---|---|---|
| (1) | RICH | RICH | Rmin | Lmax |
| (2) | LEAN | RICH | Rav | Lav |
| (3) | LEAN | LEAN | Rmax | Lmin |
| (4) | RICH | LEAN | Rav | Lav |

EXHAUST EMISSION CONTROL SYSTEM FOR INTERNAL COMBUSTION ENGINE

CROSS REFERENCE TO RELATED APPLICATION

This application is based on and incorporates herein by reference Japanese Patent Application Nos. 2000-308001 filed on Oct. 3, 2000, 2001-31532 filed on Feb. 7, 2001, 2001-65962 filed on Mar. 9, 2001, 2001-77396 filed on Mar. 19, 2001, and 2001-83964 filed on Mar. 23, 2001.

BACKGROUND OF THE INVENTION

1. Field of the Invention

The present invention relates to an exhaust emission control system for an internal combustion engine, in which a plurality of catalysts or a plurality of catalyst groups are disposed in series in an exhaust passage.

2. Description of Related Art

In recent years, to increase the capability of reducing hazardous substances in exhaust gas of an engine, two catalysts for exhaust emission control are disposed in series at some midpoint of an exhaust pipe of the engine. According to the method, an air-fuel ratio sensor (or oxygen sensor) is disposed on each of the upstream side of an upstream catalyst and the downstream side of a downstream catalyst. An air-fuel ratio closed loop control is performed by detecting the air-fuel ratio of exhaust gas flowing in the upstream catalyst by the upstream sensor and making the detected air-fuel ratio coincide with a target air-fuel ratio. The air-fuel ratio of the exhaust gas passed through the downstream catalyst is detected by the downstream sensor, and the target air-fuel ratio on the upstream side is corrected so that the air-fuel ratio detected on the downstream side coincides with a predetermined value.

Generally, conversion efficiency of a catalyst varies according to a state of adsorbing hazardous components which are generated in a state where the air-fuel ratio is lean (hereinbelow, called components on the lean side) and hazardous components which are generated in a state where the air-fuel ratio is rich (hereinbelow, called components on the rich side) of the catalyst. At and around the stoichiometric air-fuel ratio, the catalyst reduces both components on the rich side (HC, CO, and the like) and components on the lean side (NOx and the like) in the exhaust gas most efficiently, and the highest catalytic conversion efficiency can be obtained. In the conventional air-fuel ratio feedback system, however, there is a tendency that when the amount of adsorbing the components on the rich side of the upstream catalyst is large, that of the downstream catalyst is also large. When the amount of adsorbing the components on the lean side of the upstream catalyst is large, that of the downstream catalyst is also large. As a result, there is a tendency that the states of both the upstream and downstream catalysts are controlled in the same way. Thus, the exhaust gases cannot be treated by efficiently using the two catalysts. Considering that two catalysts are used, an effect of improving the catalytic conversion efficiency is not so great.

In the above-described system, it is desirable to set the adsorption state of both of the upstream and downstream catalysts to a stoichiometric state as much as possible during the engine operation. However, depending on the driving conditions, in order to save the fuel or to prevent an excessive increase in the engine rotation, there is a case such that the fuel cut is executed. Since oxygen in the air taken in the cylinders is not used for combustion but is exhausted as it is to the exhaust pipe during the fuel cut, the lean-side components (oxygen) in the exhaust gases entering the catalysts largely increase, and the lean-side component adsorption amount of the catalysts largely increases. Thus, JP-A-6-200803 and JP-A-8-193537 disclose the techniques such that when the fuel cut is finished and the fuel injection is restarted, the air-fuel ratio is set temporarily to the rich side to make the lean-side components (oxygen) adsorbed by a catalyst react with the rich-side components (HC, CO, and the like) in the exhaust gases, thereby promptly decreasing the lean-side component adsorption amount of the catalyst.

In each of the two publications, only one catalyst is disposed in the exhaust pipe. It can be considered to apply the technique of JP-A-6-200803 to a system having two catalysts as follows. When the fuel cut is finished and the fuel injection is re-started, the rich-side control for setting the air-fuel ratio temporarily to the rich side by about 5–10% is performed to reduce the lean-side component adsorption amount of the catalysts. By the operation, when the output of an air-fuel ratio sensor (or oxygen sensor) on the downstream side changes to a rich output, the rich-side control is stopped and the program returns to the normal control.

However, as the lean-side component adsorption amount of the catalysts decreases during the rich-side control, the amount of rich-side components necessary to reduce the lean-side components also decreases. If the degree of richness in the air-fuel ratio during the rich-side control is fixed, the setting of the air-fuel ratio to the rich side is insufficient when the lean-side component adsorption amount of the catalysts is large at an initial stage of the rich-side control. On the contrary, as the lean-side component adsorption amount of the catalyst becomes small at the end of the rich-side control, the setting of the air-fuel ratio to the rich side becomes excessive, and a rich-side component exhaust amount to the atmosphere increases.

In order to solve the drawback, in JP-A-8-193537, an oxygen adsorption amount of the catalyst during the rich-side control is estimated and the degree of richness is changed according to the oxygen adsorption amount. However, since the maximum oxygen adsorption amount changes by the change with time of each of the catalysts, it is difficult to estimate the oxygen adsorption amount of each catalyst with high accuracy. It is accordingly difficult to properly change the degree of richness in association with the change in the actual oxygen adsorption amount of each of the catalysts during the rich-side control.

SUMMARY OF THE INVENTION

A first object of the present invention is to provide an exhaust emission control system of an internal combustion engine with increased catalytic conversion efficiency, capable of efficiently reducing hazardous components in exhaust gas by efficiently using a plurality of catalysts (or catalyst groups) disposed in series in an exhaust passage.

According to a first aspect of the present invention, in an exhaust emission control system of an internal combustion engine, a state of a catalyst or a catalyst group disposed on the upstream side (hereinbelow, called "upstream catalyst") is detected or estimated by upstream catalyst state detecting means, and a state of a catalyst or a catalyst group disposed on the downstream side (hereinbelow, called "downstream catalyst") is detected or estimated by downstream catalyst state detecting means. As shown in FIG. 6, an air-fuel ratio is controlled by air-fuel ratio control means so that one of the states of the upstream and downstream catalysts is that an adsorption amount of hazardous components on the rich side is large and the other one is that an adsorption amount of hazardous components on the lean side is large.

For example, when the adsorption amount of the components on the rich side of the upstream catalyst is large, the conversion efficiency of the components on the lean side (NOx and the like) in exhaust gases of the upstream catalyst is high but the conversion efficiency of the components on the rich side (HC, CO, and the like) of the upstream catalyst is relatively low. Consequently, the amount of the components on the rich side in the exhaust gases flowing from the upstream catalyst becomes relatively large. In this case, it is controlled so that the adsorption amount of the components on the lean side of the downstream catalyst is large. Therefore, the components on the rich side which cannot be reduced by the upstream catalyst can be efficiently reduced by the downstream catalyst in which the adsorption amount of the components on the lean side is large. On the other hand, when the adsorption amount of the components on the lean side of the upstream catalyst is large, the adsorption amount of the components on the lean side in exhaust gases flowing from the upstream catalyst is relatively large. In this case, it is controlled so that the adsorption amount of the components on the rich side of the downstream catalyst is large. Consequently, the components on the lean side which cannot be reduced by the upstream catalyst can be efficiently reduced by the downstream catalyst in which the adsorption amount of the components on the rich side is large. In such a manner, the components on the rich and lean sides in the exhaust gases can be efficiently removed by effectively using both the upstream and downstream catalysts. Thus, the catalytic conversion efficiency can be increased.

It is also possible to detect the air-fuel ratio of exhaust gases flown from the upstream catalyst by a sensor, and control the air-fuel ratio so as to be opposite to the rich/lean side of the components of the large adsorption amount in the exhaust gases of the downstream catalyst. In such a manner, the components on the rich and lean sides in exhaust gases can be efficiently reduced by effectively using both the upstream and downstream catalysts. Thus, the catalytic conversion efficiency can be increased. According to a second aspect of the present invention, an exhaust emission control system of an internal combustion engine includes: a first sensor for detecting an air-fuel ratio or a rich/lean state of exhaust gases entering an upstream catalyst; a second sensor for detecting an air-fuel ratio or a rich/lean state of the exhaust gases flowing from the upstream catalyst; and a third sensor for detecting an air-fuel ratio or a rich/lean state of the exhaust gases flowing from a downstream catalyst. A target air-fuel ratio is set by air-fuel ratio closed loop controlling means on the basis of an output of the second sensor and/or an output of the third sensor, and a control range of the target air-fuel ratio is shifted on the basis of the outputs of the second and third sensors. In such a manner, while detecting the converting states of both the upstream and downstream catalysts, the control range of the target air-fuel ratio can be shifted so as to improve the conversion efficiency of the system as a whole. Thus, the exhaust gases can be efficiently treated by efficiently using both the upstream and downstream catalysts.

Generally, the catalytic conversion efficiency changes according to the adsorbing states of the components on the lean/rich sides of the catalysts. When the adsorbing states of the catalysts are around the stoichiometric ratio, both the components on the rich side (HC, CO, and the like) and the components on the lean side (NOx and the like) can be reduced most efficiently, and the highest catalytic conversion efficiency can be obtained.

It is also possible to switch a control gain of a sub-closed loop control for setting the target air-fuel ratio on the basis of an output of the second sensor and an output of the third sensor. In such a manner, the target air-fuel ratio can be changed with high response by switching the control gain of the second closed loop control in accordance with the state of the upstream catalyst and the state of the downstream catalyst. Thus, the exhaust gases can be efficiently treated by efficiently using both the upstream and downstream catalysts.

According to a third aspect of the present invention, an exhaust emission control system of an internal combustion engine of the invention includes: a first sensor for detecting an air-fuel ratio or a rich/lean state of an exhaust gas entering a catalyst or a catalyst group disposed on the upstream side (hereinbelow, called "upstream catalyst"); a second sensor for detecting an air-fuel ratio or a rich/lean state of the exhaust gas flowing from the upstream catalyst; and a third sensor for detecting an air-fuel ratio or a rich/lean state of the exhaust gas flowing from a catalyst or a catalyst group disposed on the downstream side (hereinbelow, called "downstream catalyst"). In the system, a target output of the second sensor upstream of the downstream catalyst (target air-fuel ratio on the upstream side of the downstream catalyst) is set by downstream-side second closed loop control means on the basis of an output of the third sensor downstream of the downstream catalyst. A target output of the first sensor upstream of the upstream catalyst (target air-fuel ratio on the upstream side of the upstream catalyst) is set by upstream-side second closed loop control means on the basis of a deviation between an output of the second sensor upstream of the downstream catalyst and a target output of the second sensor. By air-fuel ratio closed loop controlling means, an air-fuel ratio is closed loop controlled on the basis of a deviation between an output of the first sensor and a target output of the first sensor. Whether an output of the third sensor downstream of the downstream catalyst is normal or not is determined by sensor diagnosing means. When it is determined by the sensor diagnosing means that the output of the third sensor is not normal, by fail-safe means, an operation of the downstream-side second closed loop control means is inhibited, the target output of the second sensor upstream of the downstream catalyst is set to a learn value or a predetermined set value and, on the basis of a deviation between the output of the second sensor and the target output of the second sensor, the target output of the first sensor upstream of the upstream catalyst is set.

With such a configuration, in the case where the output of the third sensor downstream of the downstream catalyst becomes abnormal, the abnormal output of the third sensor is ignored, and the second closed loop control for setting the target output of the first sensor (target air-fuel ratio on the upstream side of the upstream catalyst) can be performed by using the output of the second sensor upstream of the downstream catalyst which functions normally (air-fuel ratio of exhaust gases flowing from the upstream catalyst). Consequently, even when the output of the third sensor used for the second closed loop control becomes abnormal, the second closed loop control in which the state of the upstream catalyst is reflected can be carried out by using the second sensor which functions normally.

The following manner is also possible. Whether an output of the second sensor upstream of the downstream catalyst is normal or not is determined. When it is determined that the output of the second sensor is not normal, operations of both the upstream-side and downstream-side second closed loop control means are inhibited, and the target output of the first sensor may be set on the basis of an output of the third sensor downstream of the downstream catalyst. With such a configuration, in the case where the output of the second sensor upstream of the downstream catalyst becomes abnormal, the abnormal output of the second sensor is ignored, and the second closed loop control for setting the target output of the first sensor (target air-fuel ratio on the upstream side of the upstream catalyst) can be performed by using the output of the third sensor downstream of the downstream catalyst which functions normally (air-fuel ratio of exhaust gases flowing from the downstream catalyst). Thus, even when the output of the second sensor used for the second closed loop control becomes abnormal, the second closed loop control in which the states of the two catalysts are reflected to some extent can be carried out by using the third sensor which functions normally. Worseness in the exhaust gas conversion efficiency can be minimized.

According to a fourth aspect of the present invention, an exhaust emission control system of an internal combustion engine has: a first sensor for detecting an air-fuel ratio or a rich/lean state of an exhaust gas entering a catalyst or a catalyst group disposed on the upstream side (hereinbelow, called "upstream catalyst"); a second sensor for detecting an air-fuel ratio or a rich/lean state of the exhaust gas flowing from the upstream catalyst; and a third sensor for detecting an air-fuel ratio or a rich/lean state of the exhaust gas flowing from a catalyst or a catalyst group disposed on the downstream side (hereinbelow, called "downstream catalyst"). In the system, by downstream-side second closed loop control means, a target output of the second sensor upstream of the downstream catalyst (target air-fuel ratio on the upstream side of the downstream catalyst) is set on the basis of an output of the third sensor downstream of the downstream catalyst. By upstream-side second closed loop control means, a target output of the first sensor upstream of the upstream catalyst (target air-fuel ratio on the upstream side of the upstream catalyst) is set on the basis of a deviation between an output of the second sensor upstream of the downstream catalyst and a target output of the second sensor. By air-fuel ratio closed loop controlling means, an air-fuel ratio is closed loop controlled, on the basis of a deviation between an output of the first sensor and a target output of the first sensor. By learning means, the target output of the second sensor is corrected by learning on the basis of a deviation between the output of the second sensor and the output of the third sensor.

In such a manner, even when the output characteristic of the second or third sensor is deviated to the lean or rich side due to manufacture variations, deterioration with time, and the like, the deviation is learned, and the target output of the second sensor can be corrected so as to compensate the deviation. Consequently, the high-precision air-fuel ratio control in which the deviation in the control system due to manufacture variations, deterioration with time, and the like of the sensor system is compensated can be executed. The exhaust gas reducing efficiency can be improved without being influenced by the manufacture variations, deterioration with time, and the like of the sensor system.

A second object of the present invention is to provide an exhaust emission control system of an internal combustion engine with improved exhaust gas reducing efficiency, for controlling the air-fuel ratio while detecting the states of upstream and downstream catalysts by three air-fuel ratio sensors (or oxygen sensors), in which when a lean-side component adsorption amount (oxygen adsorption amount) of each of the catalysts becomes excessive as in the time of a fuel cut, the lean-side component adsorption amount of each of the catalysts can be promptly reduced.

According to a fifth embodiment, an exhaust emission control system of an internal combustion engine according to the invention has: a first sensor for detecting an air-fuel ratio or a rich/lean state of an exhaust gas entering a catalyst or a catalyst group disposed on the upstream side (hereinbelow, called "upstream catalyst"); a second sensor for detecting an air-fuel ratio or a rich/lean state of the exhaust gas flowing from the upstream catalyst; and a third sensor for detecting an air-fuel ratio or a rich/lean state of the exhaust gas flowing from a catalyst or a catalyst group disposed on the downstream side (hereinbelow, called "downstream catalyst"). In the system, by air-fuel ratio closed loop controlling means, a target air-fuel ratio is set on the basis of an output of the second sensor and/or an output of the third sensor, and an air-fuel ratio is closed loop controlled on the basis of a deviation between the target air-fuel ratio and an output of the first sensor. When it is estimated that a lean-side component adsorption amount of the upstream catalyst and/or the downstream catalyst is equal to or larger than a predetermined amount due to a fuel cut or the like, by rich-side control means, a rich-side control for setting an air-fuel ratio temporarily to the rich side is executed. During the rich-side control, the degree of richness in the air-fuel ratio is changed on the basis of an output of the second sensor and/or an output of the third sensor. With such a configuration, during the rich-side control, the degree of richness in the air-fuel ratio can be changed in accordance with the lean-side component adsorption amount (oxygen adsorption amount) of each of the upstream and downstream catalysts. Thus, the lean-side component adsorption amount of each of the catalysts is promptly reduced, and the exhaust gas reducing efficiency can be improved.

BRIEF DESCRIPTION OF THE DRAWINGS

Additional objects and advantages of the present invention will be more readily apparent from the following detailed description of preferred embodiments thereof when taken together with the accompanying drawings in which.

Figure 1:
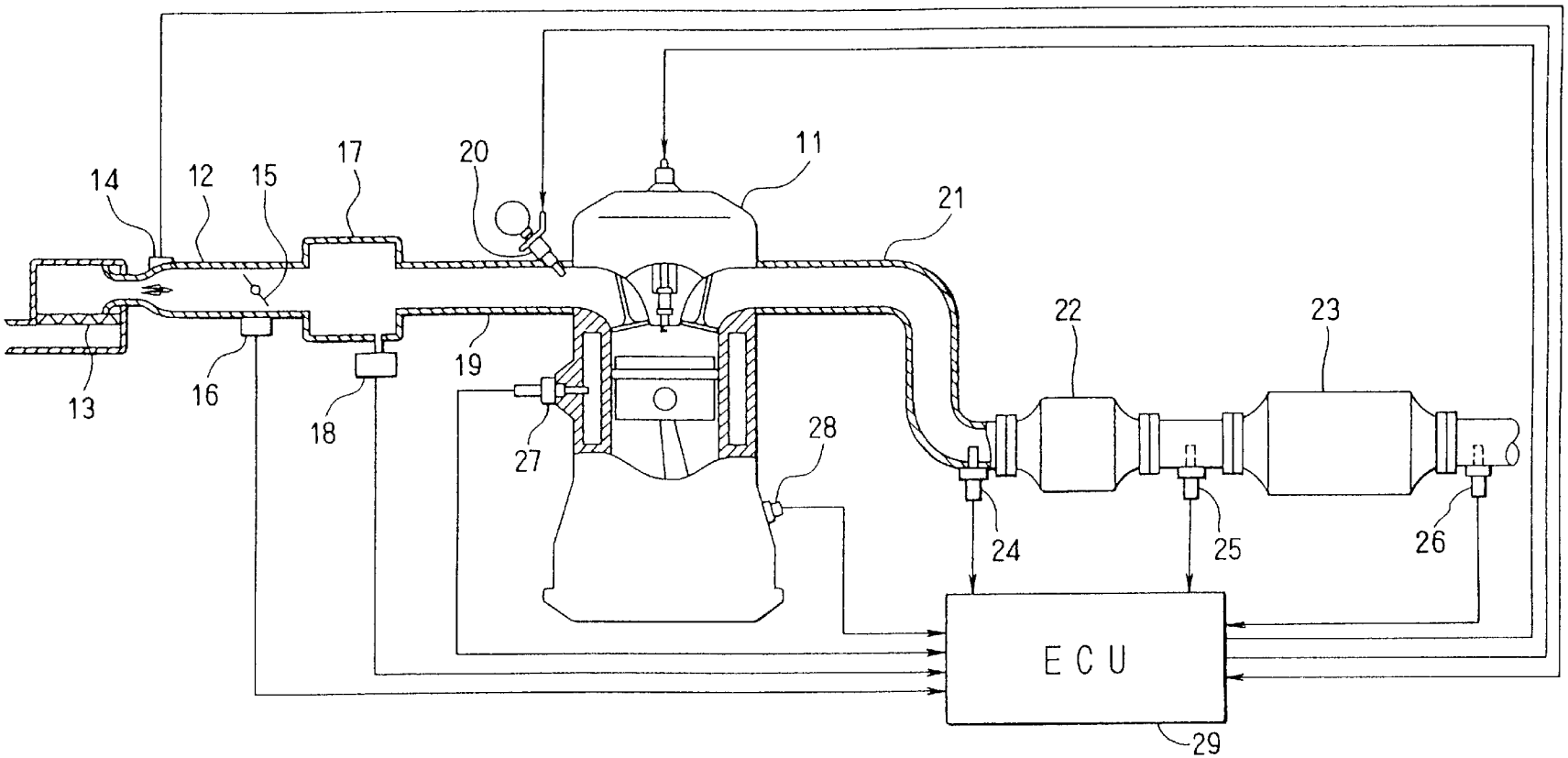
FIG. 1 is a schematic view showing an engine control system (first embodiment)

DETAILED DESCRIPTION OF PREFERRED EMBODIMENT (First Embodiment)

A first embodiment of the present invention will be described hereinbelow with reference to the drawings. First, referring to FIG. 1, the schematic configuration of a whole engine control system will be described. In the most upstream portion of an intake pipe 12 of an engine 11 as an internal combustion engine, an air cleaner 13 is provided. On the downstream side of the air cleaner 13, an air flow meter 14 for detecting an intake air volume is provided. On the downstream side of the air flow meter 14, a throttle valve 15 and a throttle angle sensor 16 for detecting a throttle angle are provided.

Further, on the downstream side of the throttle valve 15, a surge tank 17 is provided. The surge tank 17 is provided with an intake pipe pressure sensor 18 for detecting an intake pipe pressure. The surge tank 17 is provided with an intake manifold 19 for introducing air into each of cylinders of the engine 11. Near the intake port of the intake manifold 19 of each cylinder, a fuel injection valve 20 for injecting fuel is attached.

At some midpoint of an exhaust pipe 21 of the engine 11, an upstream catalyst 22 and a downstream catalyst 23 each of which is a three-way catalyst or the like for reducing CO, HC, NOx, and the like in exhaust gases are provided in series. Further, on the upstream and downstream sides of the upstream catalyst 22 and on the downstream side of the downstream catalyst 23, a first sensor 24, a second sensor 25, and a third sensor 26 are installed, respectively. In this case, as the first sensor 24, an air-fuel ratio sensor (linear A/F sensor) for outputting a linear air-fuel ratio signal according to the air-fuel ratio of exhaust gases flowing in the upstream catalyst 22 is used. As the second and third sensors 25 and 26, oxygen sensors of which output voltages are inverted according to the air-fuel ratio (rich or lean) of the exhaust gases flowing from the catalysts 22 and 23 are used. The second sensor 25 functions as upstream catalyst state detecting means for detecting an adsorbing state of the upstream catalyst 22, and the third sensor 26 functions as downstream catalyst state detecting means for detecting an adsorbing state of the downstream catalyst 23. In a manner similar to the first sensor 24, as the second sensor 25 and/or the third sensor 26, air-fuel ratio sensor(s) (linear A/F sensor(s)) can be used. Obviously, an oxygen sensor may be used as the first sensor 24.

To the cylinder block of the engine 11, a cooling water temperature sensor 27 for detecting the temperature of cooling water and a crank angle sensor 28 for detecting engine speed NE are attached.

Outputs of the various sensors are input to an engine control unit (hereinbelow, described as an "ECU") 29. The ECU 29 is constructed mainly by a microcomputer. By executing each of programs of FIGS. 2–4 stored in a built-in ROM (storage medium), the ECU 29 plays the role of air-fuel ratio controlling means for closed loop controlling the air-fuel ratio. The processes of each of the programs will now be described hereinbelow.

Figure 2:
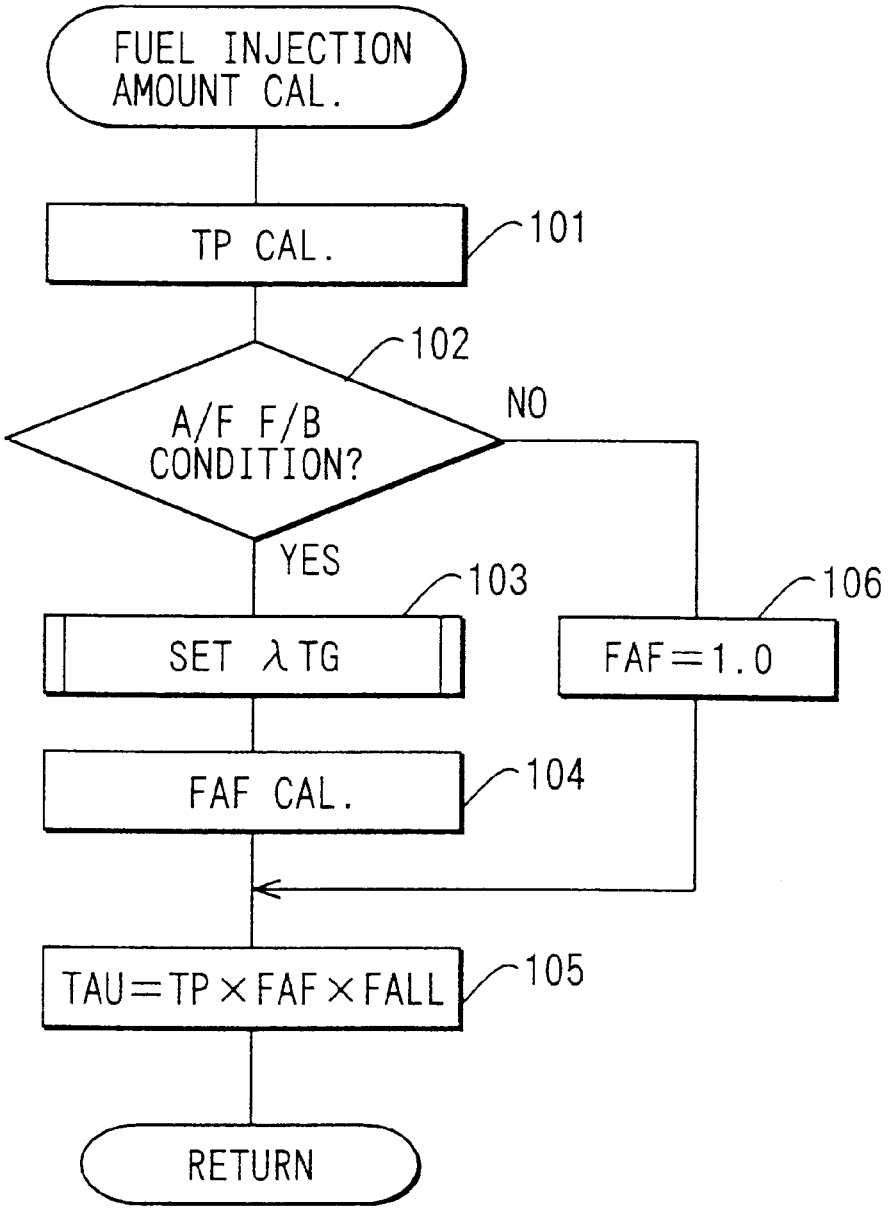
FIG. 2 is a flowchart showing a flow of a fuel injection amount calculating program (first embodiment)

A fuel injection amount calculating program in FIG. 2 is a program for setting a required fuel injection amount TAU through a closed loop control on the air-fuel ratio and is executed every predetermined crank angle. When the program is activated, first, in step 101, a basic fuel injection amount TP is calculated from a map or the like on the basis of operation condition parameters such as intake pipe pressure, engine speed, and the like at present. In step 102, whether air-fuel ratio closed loop control conditions are satisfied or not is determined. The air-fuel ratio closed loop control conditions are such that the engine cooling water temperature is equal to or higher than a predetermined temperature, and the engine operating conditions are not in a high rotational speed/heavy load area. When all the conditions are satisfied, the air-fuel ratio feedback conditions are satisfied.

When it is determined in step 102 that the air-fuel ratio closed loop control conditions are not satisfied, the program advances to step 106 where an air-fuel ratio correction factor FAF is set to "1.0". After that, the program advances to step 105. In this case, feedback correction of the air-fuel ratio is not performed.

On the other hand, when it is determined in step 102 that the air-fuel ratio closed loop control conditions are satisfied, the program advances to step 103 where a target air-fuel ratio setting program of FIG. 3 which will be described hereinlater is executed to set a target air-fuel ratio λTG on the upstream side of the upstream catalyst 22. In step 104, according to a deviation between an output (air-fuel ratio of the exhaust gases) of the first sensor 24 on the upstream side of the upstream catalyst 22 and the target air-fuel ratio λTG, the air-fuel ratio correction factor FAF is calculated.

After that, in step 105, by using the basic fuel injection amount TP, air-fuel ratio correction factor FAF, and an another correction factor FALL, the fuel injection amount TAU is calculated by the following equation and the program is finished.

$$TAU=TP\times FAF\times FALL$$

The processes of a target air-fuel ratio setting program in FIG. 3 executed in step 103 in FIG. 2 will now be described. When the program is started, first, in step 201, a target voltage setting program of FIG. 4 is executed to set a target voltage vtg of the second sensor 25 from a map in accordance with an output voltage (air-fuel ratio on the downstream side of the downstream catalyst 23) of the third sensor 26. The map characteristics of the target voltage vtg are as follows. In an area where the output voltage of the third sensor 26 is in a predetermined range (A<output voltage<B), the higher the output voltage of the third sensor 26 becomes, the lower the target voltage Vtg of the second sensor 25 becomes. In the area where the output voltage of the third sensor 26 is equal to or lower than the predetermined value A, the target voltage Vtg of the second sensor 25 becomes constant at the upper limit value. In the area where the output voltage of the third sensor 26 is equal to or higher than the predetermined value B, the target voltage Vtg of the second sensor 25 becomes constant at the lower limit value.

Figure 3:
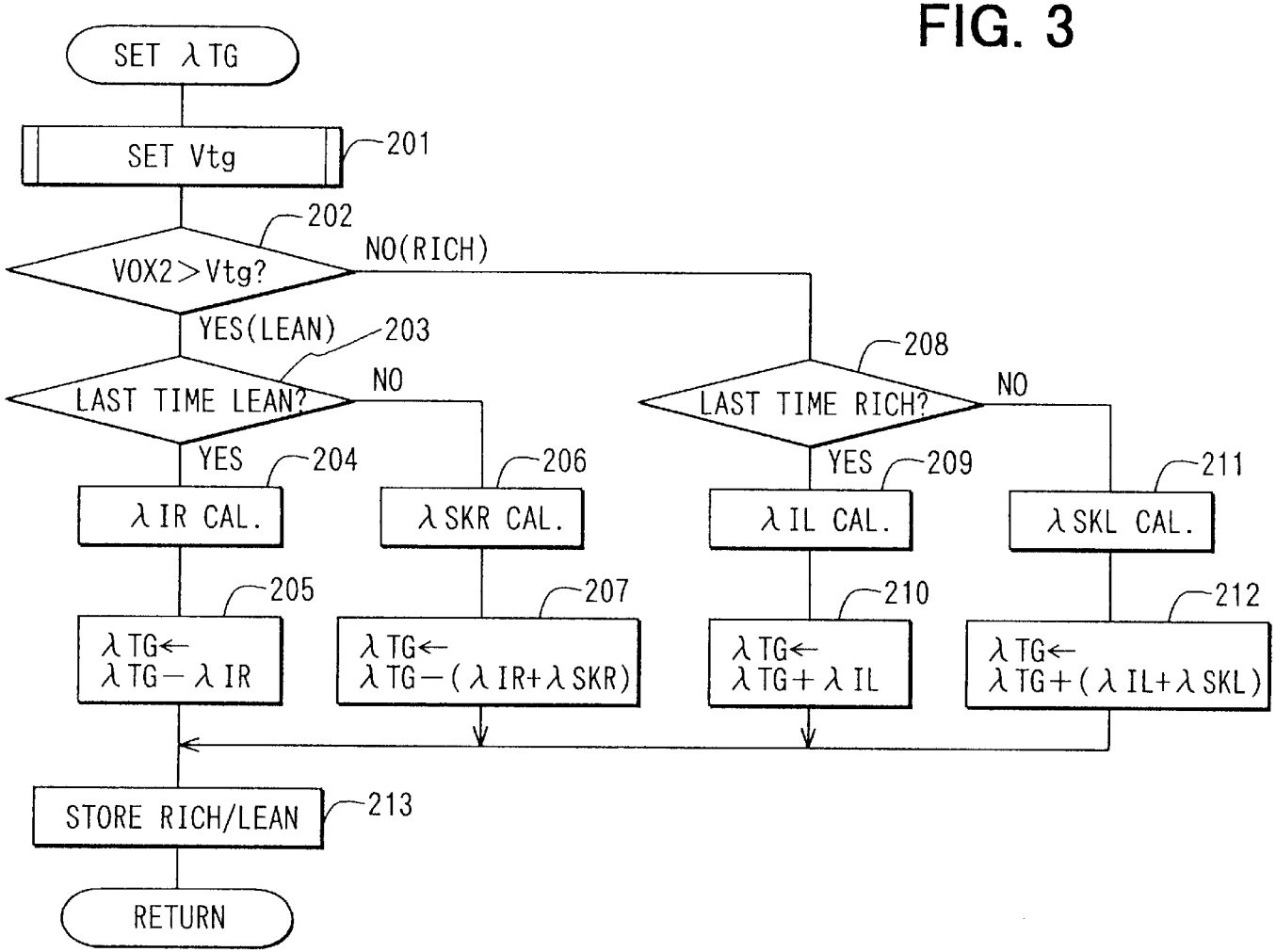
FIG. 3 is a flowchart showing a flow of a target air-fuel ratio setting program (first embodiment)
Figure 4:
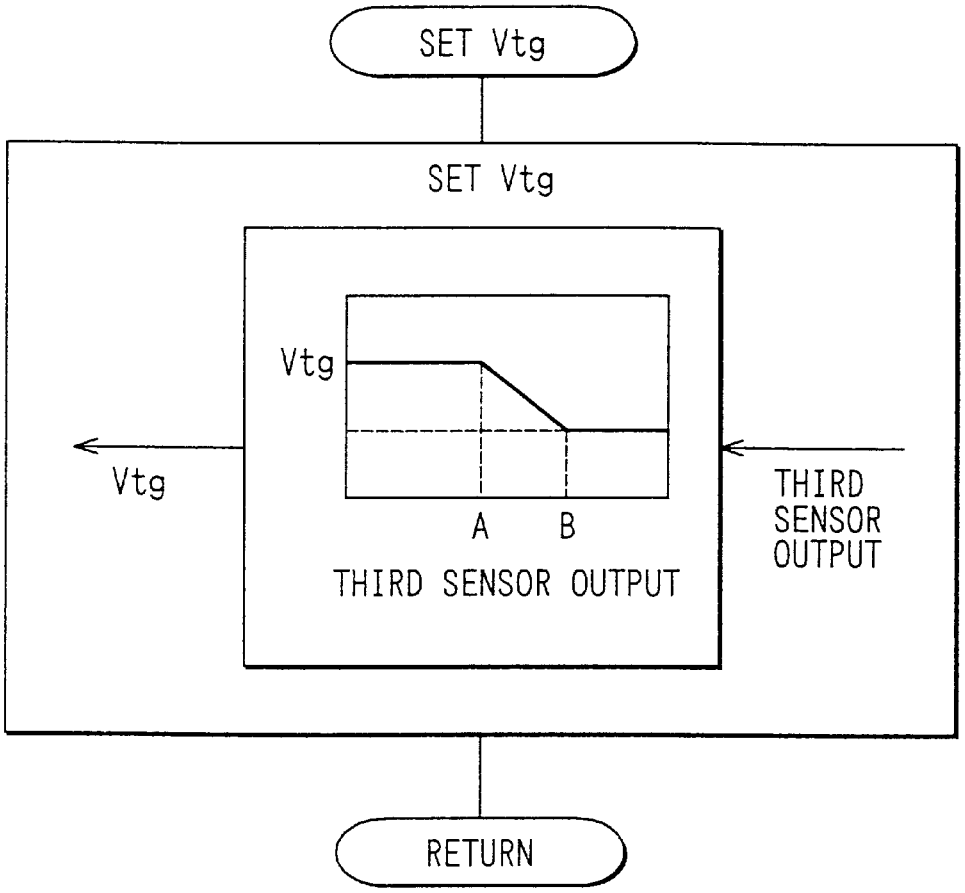
FIG. 4 is a flowchart showing a flow of a target voltage setting program (first embodiment)

After setting the target voltage Vtg, the program advances to step 202 in FIG. 3 where whether the output voltage VOX2 of the second sensor 25 disposed on the downstream side of the upstream catalyst 22 is higher than the target voltage Vth or not is determined, thereby determining either an amount of adsorbing the components on the rich side or an amount of adsorbing the components on the lean side of the upstream catalyst 22 is large. If the amount of adsorbing the components on the lean side is large, the program advances to step 203 where whether the amount of adsorbing the components on the lean side was large last time also or not is determined. If YES, the program advances to step 204 where an integral λIR to the rich side is calculated from a map or the like in accordance with a present intake air volume. The integral λIR to the rich side is set to become smaller as the current intake air volume increases. After calculating the integral λIR to the rich side, the program advances to step 205 where the target air-fuel ratio λTG is corrected to the rich side only by λIR. The resultant air-fuel ratio at this time is stored (step 213) and the program is finished.

In the case where the adsorption amount of the components on the rich side was large last time and the adsorption amount of the components on the lean side was large this time, the program advances to step 206 where a skip amount λSKR to the rich side is calculated from a map or the like in accordance with an output of the third sensor 26 (the adsorption state of the downstream catalyst 23). It is consequently set so that as the adsorption amount of the components on the lean side of the downstream catalyst 23 increases, the skip amount λSKR to the rich side increases. After calculation of the skip amount λSKR to the rich side, the program advances to step 207 where the target air-fuel ratio λTG is corrected to the rich side only by λIR+λSKR. The resultant air-fuel ratio is stored (step 213), and the program is finished.

On the other hand, when it is determined in step 202 that the output voltage VOX2 of the second sensor 25 is lower than the target voltage Vtg (the adsorption amount of the components on the rich side of the upstream catalyst 22 is large), the program advances to step 208 where whether the adsorption amount of the components on the rich side was also large or not is determined. If YES, the program advances to step 209 where an integral λIL to the lean side is calculated from a map or the like in accordance with a present intake air volume. It is set so that as the intake air volume increases, the integral λIL to the lean side decreases. After calculating the integral λIL to the lean side, the program advances to step 210 where the target air-fuel ratio λTG is corrected to the lean side only by λIL, the resultant air-fuel ratio is stored (step 213), and the program is finished.

When the adsorption amount of the components on the lean side was large last time and the adsorption amount of the components on the rich side is large this time, the program advances to step 211 where the skip amount λSKL to the lean side is calculated from a map or the like in accordance with an output of the third sensor 26 (adsorption state of the downstream catalyst 23). It is set so that the skip amount λSKL to the lean side increases as the amount of adsorbing the components on the rich side of the downstream catalyst 23 increases. After that, the program advances to step 212 where the target air-fuel ratio λTG is corrected to the lean side only by λIL+λSKL, the resultant air-fuel ratio is stored (step 213), and the program is finished.

Figure 5:
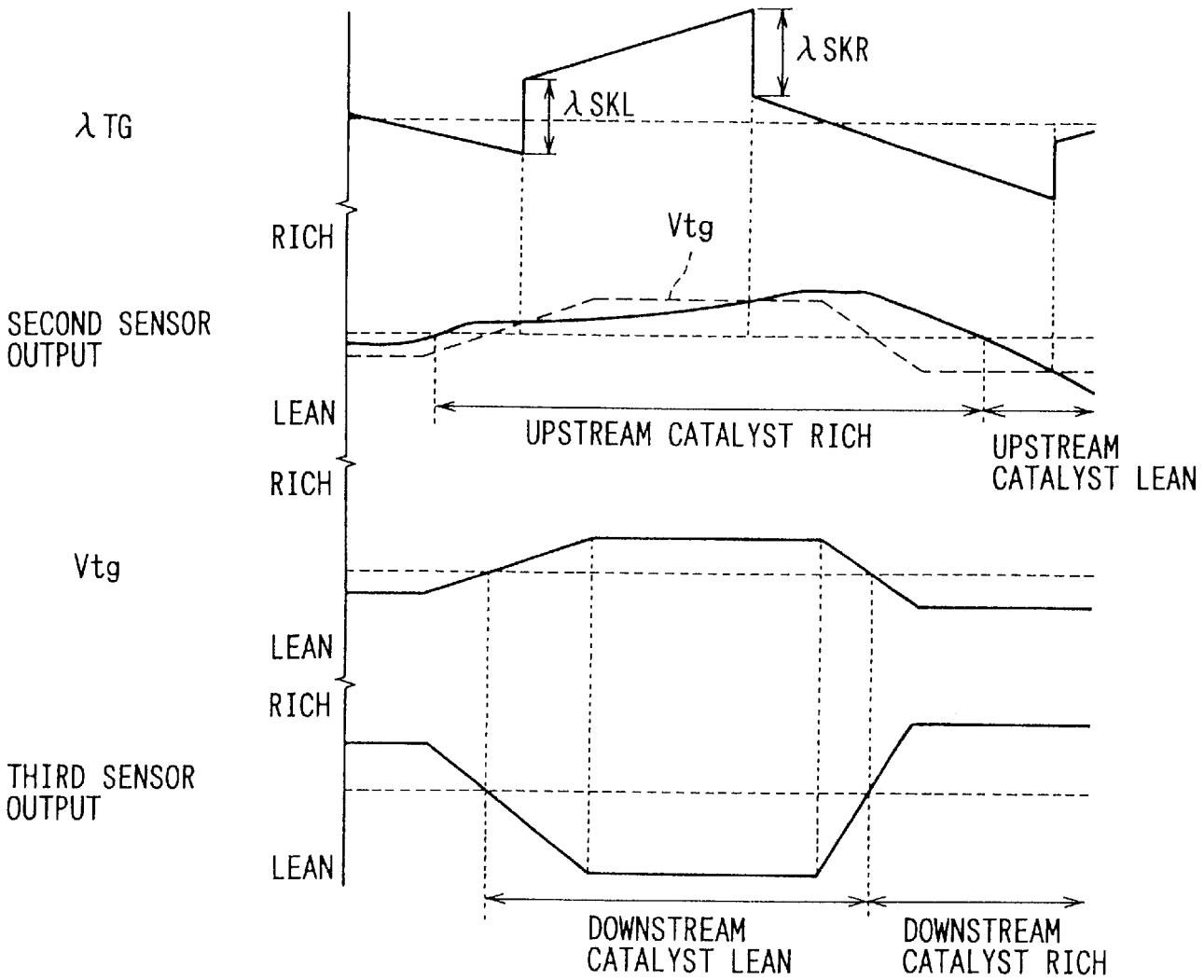
FIG. 5 is a time chart showing a target air-fuel ratio, an output of a second sensor, a target voltage, and an output of a third sensor (first embodiment)
Figure 6:
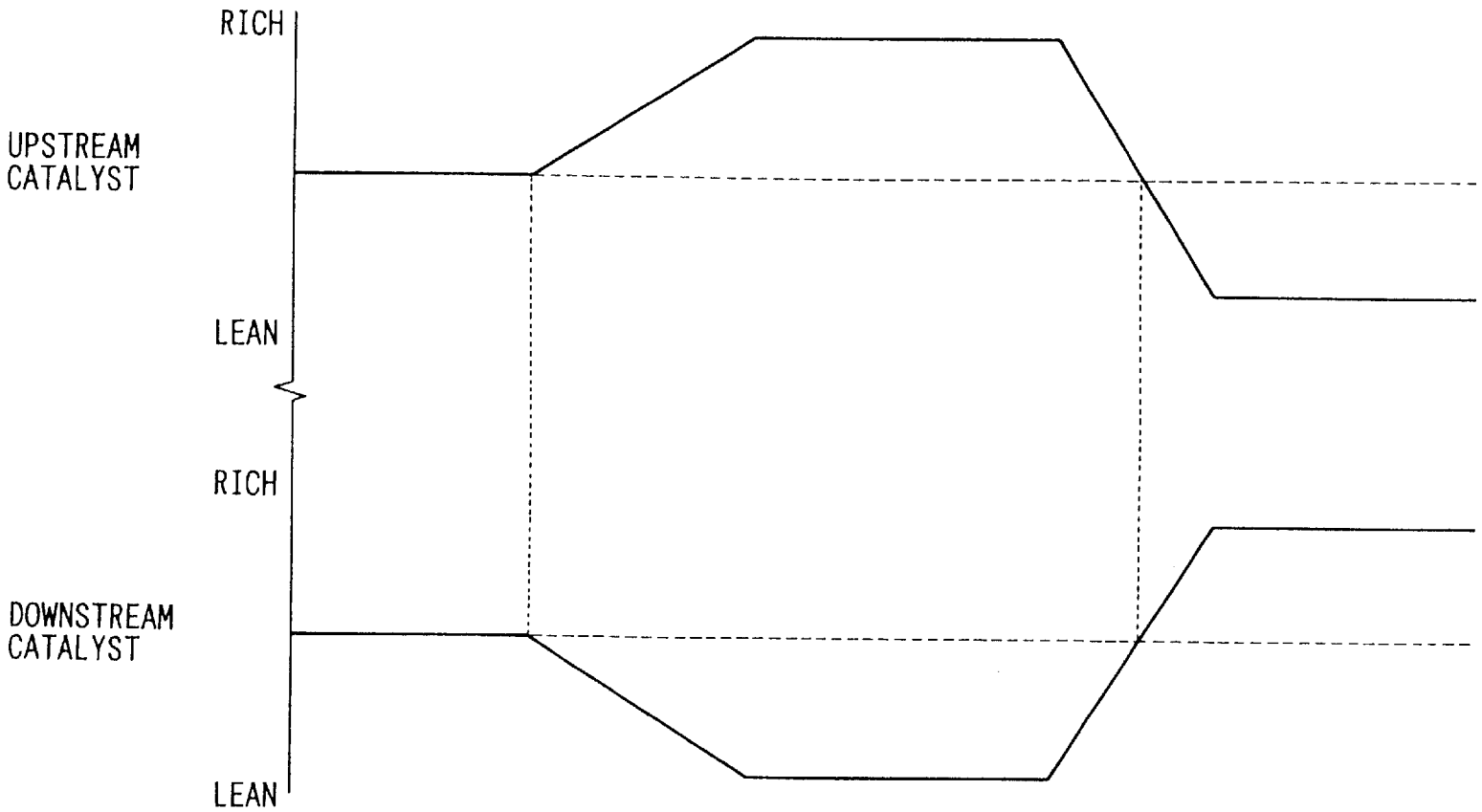
FIG. 6 is a time chart showing a relation between the state of an upstream catalyst and the state of a downstream catalyst (first embodiment)

The behavior of the aforementioned air-fuel ratio control of the embodiment will now be described by referring to the time chart of FIG. 5. According to an output voltage (state of the downstream catalyst 23) of the third sensor 26 on the downstream side of the downstream catalyst 23, the target voltage vtg of the second sensor 25 on the downstream side of the upstream catalyst 22 is set. When the adsorption amount of the components on the lean side of the downstream catalyst 23 is large, the target voltage vtg of the second sensor 25 is set to the rich side. When the air-fuel ratio after the downstream catalyst 23 is rich, the target voltage Vtg of the second sensor 25 is set to the lean side.

During the engine operation, the output voltage of the second sensor 25 is compared with the target voltage Vtg. Each time the output voltage of the second sensor 25 crosses the target voltage Vtg, the target air-fuel ratio λTG on the upstream side of the upstream catalyst 22 is skipped to the rich or lean side. By performing such a control, the air-fuel ratio is controlled so that when the adsorption amount of the components on the rich side of the downstream catalyst 23 is large, the adsorption amount of the components on the lean side of the upstream catalyst 22 is large. Similarly, the air-fuel ratio is controlled so that when the adsorption amount of the components on the lean side of the downstream catalyst 23 is large, the adsorption amount of the components on the rich side of the upstream catalyst 22 is large.

For example, when the adsorption amount of the components on the rich side of the upstream catalyst 22 is large, the catalytic conversion efficiency of the components on the lean side (NOx and the like) in the exhaust gases of the upstream catalyst 22 is high but that of the components on the rich side (HC, CO, and the like) is relatively low.

Consequently, the amount of the components on the rich side in the exhaust gases emitted from the upstream catalyst 22 is relatively large. In this case, since it is controlled so that the adsorption amount of the components on the lean side of the downstream catalyst 23 becomes large, the components on the rich side which cannot be reduced by the upstream catalyst 22 can be efficiently reduced by the downstream catalyst 23 of which adsorption amount of the components on the lean side is large. On the other hand, when the adsorption amount of the components on the lean side of the upstream catalyst 22 is large, the amount of the components on the lean side in the exhaust gases flown from the upstream catalyst 22 becomes relatively large. In this case, it is controlled so that the adsorption amount of the components on the rich side of the downstream catalyst 23 is large, the components on the lean side which cannot be reduced by the upstream catalyst 22 can be efficiently reduced by the downstream catalyst 23 of which adsorption amount of the components on the rich side is large. In such a manner, the components on the rich and lean sides in the exhaust gases can be efficiently reduced by effectively using both the upstream catalyst 23 and the downstream catalyst 24, and the catalytic conversion efficiency can be increased.

Further, in the first embodiment, at the time of setting the target voltage Vtg of the second sensor 25 in accordance with an output voltage of the third sensor 26, the upper and low limit values of the target voltage Vtg are provided to limit the target voltage Vtg within a predetermined range. Consequently, the adsorption amount of the components on the rich/lean side of the upstream catalyst 22 can be limited within the predetermined range. Thus, the catalytic conversion efficiency of the upstream catalyst 22 can be prevented from being decreased due to excessive correction of the air-fuel ratio.

According to the present invention, it is also possible to control so that the air-fuel ratio of the exhaust gases flowing from the upstream catalyst 22 (output of the second sensor 25) is opposite to the rich/lean side of the components of the large adsorption amount in the exhaust gases of the downstream catalyst 23 (output of the third sensor 26). In this case as well, in a manner similar to the foregoing embodiment, the components on the rich and lean sides in the exhaust gases can be efficiently reduced by effectively using both the upstream catalyst 22 and the downstream catalyst 23. Thus, the catalytic conversion efficiency can be increased.

Although the two catalysts 25 and 26 are disposed in series in the exhaust pipe 21 in the configuration of the system in FIG. 1, the invention can be also applied to a configuration in which three or more catalysts are disposed and are divided into two catalyst groups, and each catalyst group is regarded as one catalyst.

(Second Embodiment)

A second embodiment will be described with reference to FIGS. 7–10. The configuration of a whole engine control system and the fuel injection amount calculation program are the same as in the first embodiment.

The processes of a target air-fuel ratio setting program in FIG. 7 executed in step 103 in FIG. 2 will now be described.

This is a program for executing a second closed loop control for setting the target air-fuel ratio λTG on the basis of an output of the second sensor 25 and an output of the third sensor 26.

Figure 8:
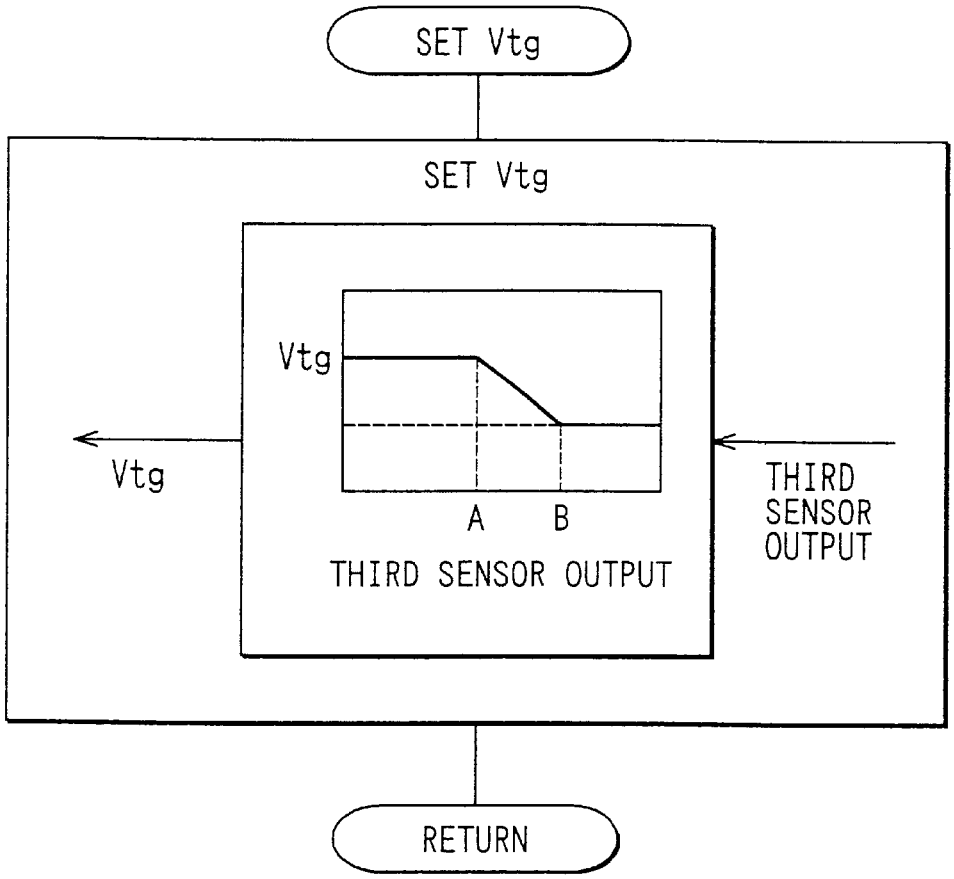
FIG. 8 is a flowchart showing a flow of a target voltage setting program (second embodiment)

When the program is started, first, in step 301, a target voltage setting program in FIG. 8 is executed to set a target voltage Vtg of the second sensor 25 from a map in accordance with an output voltage of the third sensor 26 (air-fuel ratio on the downstream side of the downstream catalyst 23). The map characteristics of the target voltage Vtg are as follows. In an area where the output voltage of the third sensor 26 is in a predetermined range (A<output voltage<B), the higher the output voltage of the third sensor 26 becomes, the lower the target voltage Vtg of the second sensor 25 becomes. In the area where the output voltage of the third sensor 26 is equal to or lower than the predetermined value A, the target voltage Vtg of the second sensor 25 is constant at the upper limit value. In the area where the output voltage of the third sensor 26 is equal to or higher than the predetermined value B, the target voltage Vtg of the second sensor 25 is constant at the lower limit value.

Figure 7:
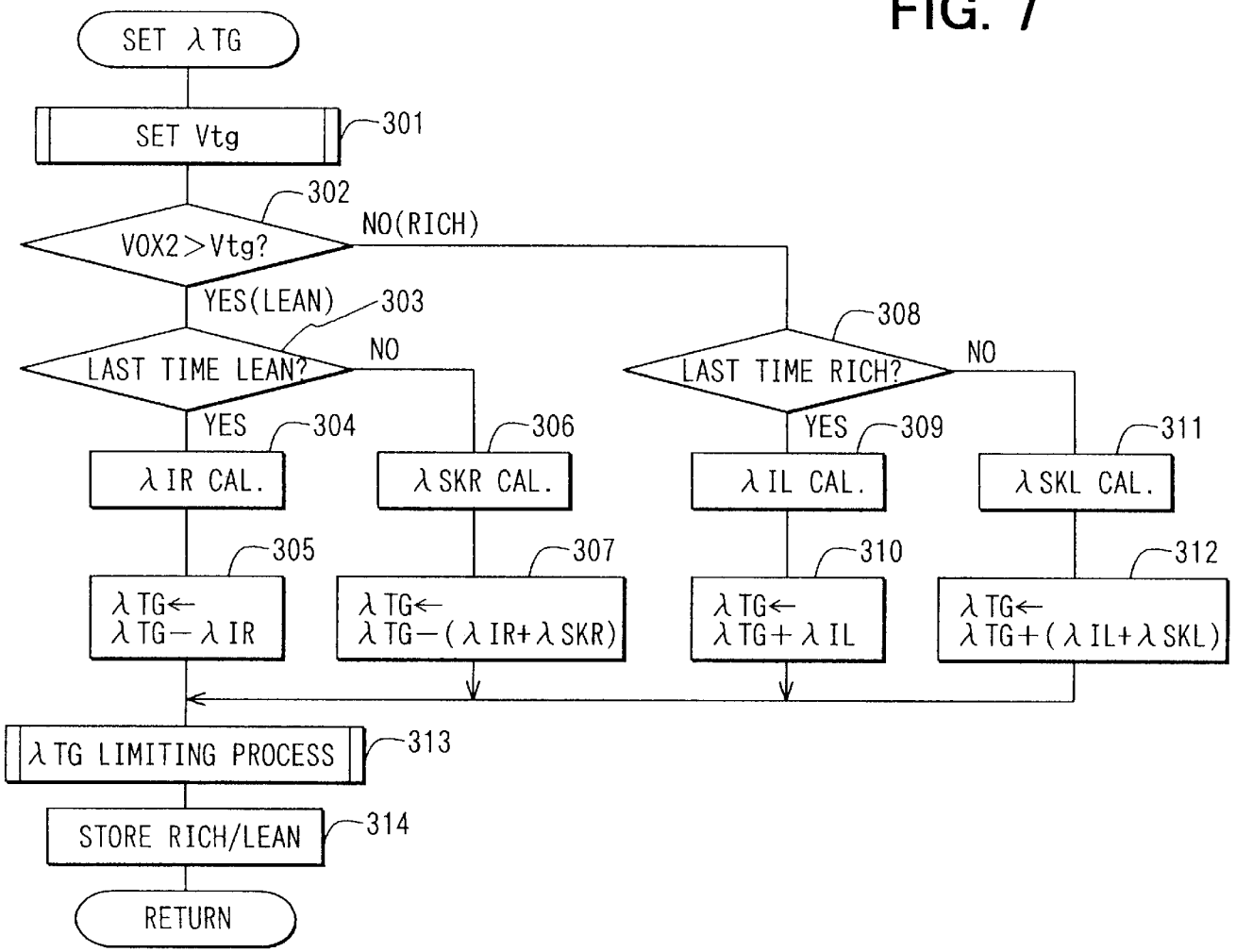
FIG. 7 is a flowchart showing a flow of a target air-fuel ratio setting program (second embodiment)

After setting the target voltage Vtg, the program advances to step 302 in FIG. 7 where whether the output voltage VOX2 of the second sensor 25 disposed downstream of the upstream catalyst 22 is higher than the target voltage Vtg or not is determined, thereby determining the state of the upstream catalyst 22. When the adsorption amount of the components on the lean side is large, the program advances to step 303 where whether the adsorption amount of the components on the lean side was also large last time or not is determined. If "Yes", the program advances to step 304 where an integral λIR to the rich side is calculated from a map or the like in accordance with a present intake air volume. After calculating the integral λIR to the rich side, the program advances to step 305 where the target air-fuel ratio λTG is corrected to the rich side only by λIR, and the program advances to step 313.

In the case where the adsorption amount of the components on the rich side was large last time and that of the components on the lean side is large this time, the program advances to step 306 where a skip amount λSKR to the rich side is calculated from a map or the like in accordance with an output of the third sensor 26 (an adsorption state of the downstream catalyst 23). After calculating the skip amount λSKR to the rich side, the program advances to step 307 where the target air-fuel ratio λTG is corrected to the rich side only by λIR+λSKR, and the program advances to step 313.

On the other hand, when it is determined in step 302 that the output voltage VOX2 of the second sensor 25 is higher than the target voltage Vtg (the adsorption amount of the components on the rich side of the upstream catalyst 22 is large), the program advances to step 308 where whether the adsorption amount of the components on the rich side of the upstream catalyst 22 was also large last time is determined. If "Yes", the program advances to step 309 where an integral λIL to the lean side is calculated from a map or the like in accordance with a present intake air volume. After calculating the integral λIL to the lean side, the program advances to step 310 where the target air-fuel ratio λTG is corrected to the lean side only by λIL, and the program advances to step 313.

When the adsorption amount of the components on the lean side was large last time and that of the components on the rich side is large this time, the program advances to step 311 where the skip amount λSKL to the lean side is calculated from a map or the like in accordance with an output of the third sensor 26 (adsorption state of the downstream catalyst 23). After calculating the skip amount λSKL to the lean side, the program advances to step 312 where the target air-fuel ratio λTG is corrected to the lean side only by λIL+λSKL, and the program advances to step 313.

Figure 9:
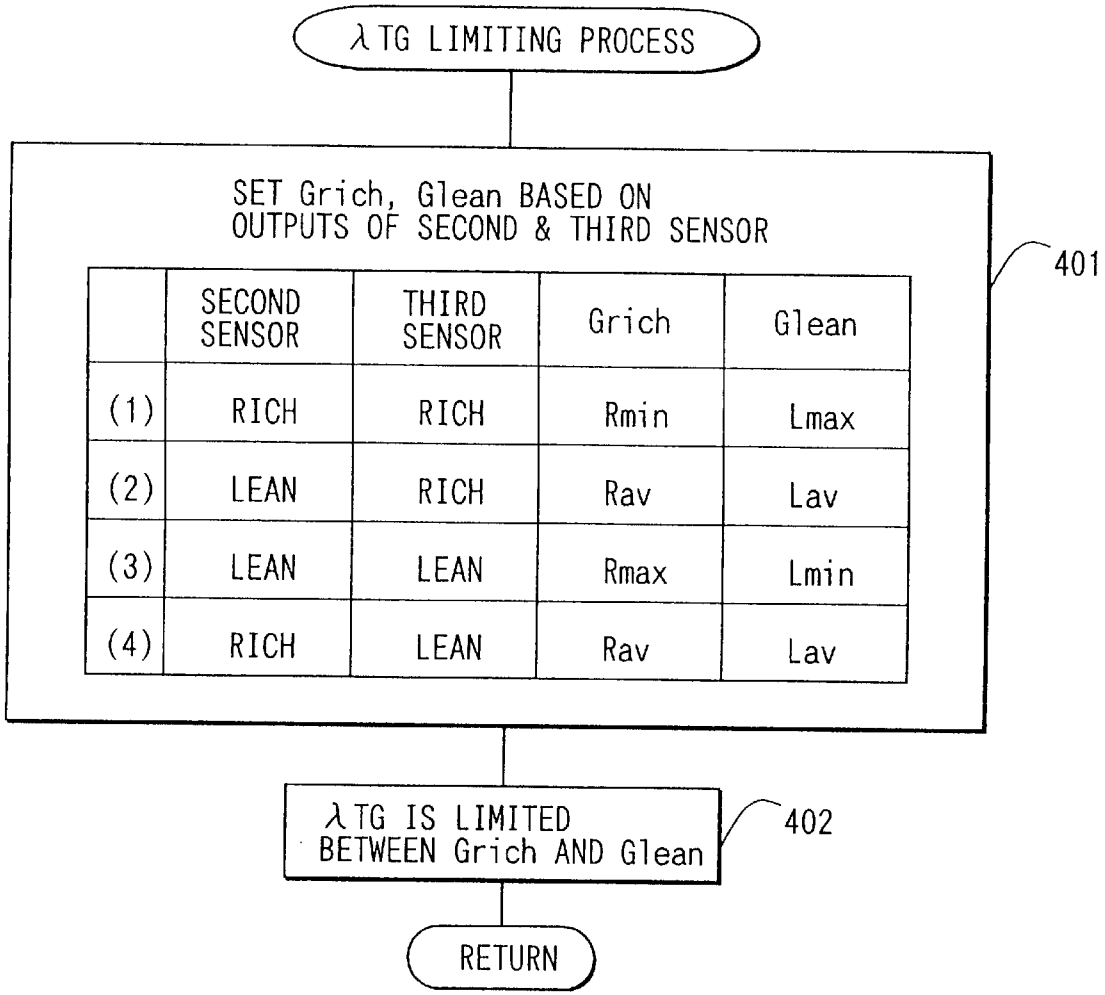
FIG. 9 is a flowchart showing a flow of a target air-fuel ratio limiting process program (second embodiment)

In step 313, a target air-fuel ratio limiting process program of FIG. 9 which will be described hereinlater is executed to limit the target air-fuel ratio λTG on the upstream side of the upstream catalyst 22 to be within a predetermined control range. After that, the program advances to step 314 where the resultant state of the upstream catalyst 22 at that time is stored, and the program is finished.

The processes of the target air-fuel ratio limiting program in FIG. 9 executed in step 313 in FIG. 7 will now be described. The program plays the role corresponding to target air-fuel ratio limiting means in the present invention. When the program is started, first, in step 401, in accordance with a combination of the air-fuel ratio (rich/lean) of an output of the second sensor 25 (state of the upstream catalyst 22) and the air-fuel ratio (rich/lean) of an output of the third sensor 26 (state of the downstream catalyst 23), a rich-side limit value Grich and a lean-side limit value Glean of the target air-fuel ratio λTG are set with reference to the table. At this time, there are the following four combinations (1) to (4) of the output of the second sensor 25 and the output of the third sensor 26.

(1) When both outputs of the second and third sensors 25 and 26 are on the rich side, the rich-side limit value Grich is switched to the limit value Rmin having a lower degree of richness than a normal value, and the lean-side limit value Glean is switched to a limit value Lmax having a higher degree of leanness than a normal value. The lean-side limit value Glean may be set to a normal value Lav.

(2) In the case where the output of the second sensor 25 is lean and the output of the third sensor 26 is rich, the rich-side limit value Grich and the lean-side limit value Glean are switched to normal values Rav and Lav, respectively.

(3) When both outputs of the second and third sensors 25 and 26 are lean, the lean-side limit value Glean is switched to a limit value Lmin having a lower degree of leanness than a normal value, and the rich-side limit value Grich is switched to a limit value Rmax having a higher degree of richness than a normal value.

(4) When the output of the second sensor 25 is rich and the output of the third sensor 26 is lean, the rich-side limit value Grich and the lean-side limit value Glean are switched to normal values Rav and Lav, respectively. Rav is set to an intermediate value of Rmax and Rmin, and Lav is set to an intermediate value of Lmax and Lmin.

After setting the rich-side limit value Grich and the lean-side limit value Glean as described above, the program advances to step 402 where the target air-fuel ratio λTG updated in any of the steps 305, 307, 310, and 312 of the target air-fuel ratio setting program of FIG. 3 is limited by the rich-side limit value Grich and the lean-side limit value Glean. Specifically, when the target air-fuel ratio λTG before the limiting process is in the range between the limit values Grich and Glean, the target air-fuel ratio λTG before the limiting process is used as it is as the final target air-fuel ratio λTG. When the target air-fuel ratio λTG before the limiting process is deviated to the rich side more than the rich-side limit value Grich, the final target air-fuel ratio λTG is replaced by the rich -side limit value Grich. When the target air-fuel ratio λTG before the limiting process is deviated to the lean side more than the lean-side limit value Glean, the final air-fuel ratio λTG is replaced by the lean-side limit value Glean. Consequently, the target air-fuel ratio λTG is limited between the rich-side limit value Grich and the lean-side limit value Glean.

An execution of the air-fuel ratio closed loop control of the above-described second embodiment will be described by using a time chart in FIG. 10. In the time chart in FIG. 10, behaviors of a comparative example are indicated by broken lines.

In the comparative example, the rich-side and lean-side limit values Grich and Glean are fixed to constant values. The air-fuel ratio of the exhaust gases entering the downstream catalyst 23 fluctuates relatively largely according to the engine operating conditions and the state of the upstream catalyst 22. Consequently, when the rich-side and lean-side limit values Grich and Glean are fixed to constant values, the air-fuel ratio of the exhaust gases entering the downstream catalyst 23 may be deviated from the proper range. Further, there is a tendency that it takes time for the air-fuel ratio deviated from the proper range to recover to the proper range. Consequently, depending on the engine operating conditions and the like, there is the possibility that the catalytic conversion efficiency of the downstream catalyst 23 decreases, and the exhaust emission increases.

In contrast, in the second embodiment, according to a combination of the output of the second sensor 25 (state of the upstream catalyst 22) and an output of the third sensor 26 (state of the downstream catalyst 23), the rich-side and lean-side limit values Grich and Glean are switched.

Figure 10:
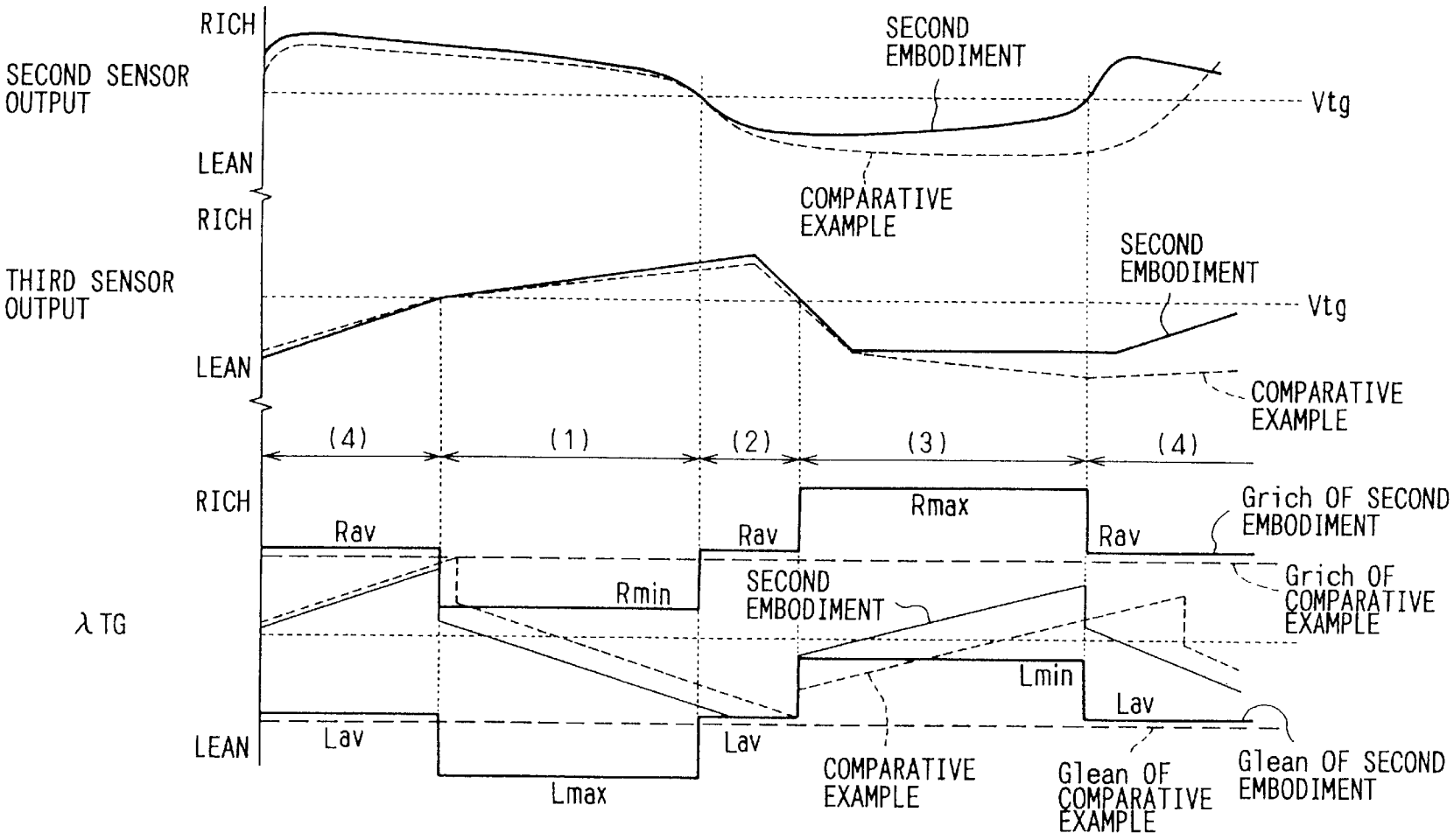
FIG. 10 is a time chart showing an output of a second sensor, an output of a third sensor, a target air-fuel ratio, and a target air-fuel ratio limiting value (second embodiment)

For example, in the period (1) in FIG. 10, both the outputs of the second and third sensors 25 and 26 are on the rich side.

In this state, both the adsorbing amounts of the components on the rich side of the upstream catalyst 22 and the downstream catalyst 23 become large, the amount of the components on the rich side in the exhaust gases emitted from the catalysts 22 and 23 tend to become relatively large.

In the case where both of the outputs of the second and third sensors 25 and 26 become rich, the rich-side limit value Grich is switched to the limit value Rmin having a lower degree of richness. By the switching, the control range of the target air-fuel ratio λTG is shifted to the leaner side than a normal value, so that the air-fuel ratio of the exhaust gases is suppressed from becoming richer. It prevents the upstream catalyst 22 and the downstream catalyst 23 from being saturated with the components on the rich side, and the conversion efficiency of the components on the rich side in the exhaust gases can be assured.

In the period of (3) in FIG. 10, both of the outputs of the second and third sensors 25 and 26 are on the lean side. In this state, the adsorption amounts of the components on the lean side of the upstream and downstream catalysts 22 and 23 are large, and there is a tendency that the amount of the components on the lean side in the exhaust gases exhausted from each of the catalysts 22 and 23 becomes relatively large.

In the case where both of the outputs of the second and third sensors 25 and 26 become lean, therefore, the lean-side limit value Glean is switched to the limit value Lmin having a lower degree of leanness than normal value. By the switching, the control range of the target air-fuel ratio λTG is shifted to the rich side, and the degree of leanness of the air-fuel ratio of the exhaust gases is suppressed from becoming higher. The upstream and downstream catalysts 22 and 23 are prevented from being saturated with the components on the lean side, and the conversion efficiency of the components on the lean side in the exhaust gases can be assured.

In the periods (2) and (4) in FIG. 10, one of the outputs of the second and third sensors 25 and 26 is lean and the other output is rich. In this state, the adsorption amount of the components on the rich side of one of the upstream and downstream catalysts 22 and 23 is large, and that of the components on the lean side of the other catalyst is large. Therefore, the components on the rich and lean sides in the exhaust gases can be efficiently reduced by using the upstream and downstream catalysts 22 and 23 in good balance.

When one of the outputs of the second and third sensors 25 and 26 is lean and the other output is rich, the rich-side limit value Grich and the lean-side limit value Glean are switched to the normal values Rav and Lav, respectively. By setting the control range of the target air-fuel ratio λTG around the stoichiometric ratio as a center and controlling the air-fuel ratio of the exhaust gases around the stoichiometric ratio, the components on the rich and lean sides are efficiently reduced by using the upstream and downstream catalysts 22 and 23 in good balance.

The switch values Rmin, Rav, Rmax of the rich-side limit value Grich and the switch values Lmin, Lav, and Lmax of the lean-side limit value Glean are fixed values in the embodiment. Each of the switch values may be set by a map, a numerical expression, or the like in accordance with the output of the second sensor 25 and/or the output of the third sensor 26. In such a manner, the correction amount of the target air-fuel ratio λTG can be set to a proper value according to the states (the adsorption amounts of the components on the rich/lean side) of the upstream catalyst 22 and the downstream catalyst 23, so that the control accuracy can be improved.

In the second embodiment, according to the combination of the air-fuel ratio (rich/lean) of the output of the second sensor 25 and the air-fuel ratio (rich/lean) of the output of the third sensor 26, the limit value of the target air-fuel ratio λTG is switched. Alternately, control gains of a second closed loop (for example, skip amounts λSKR and λSKL, and/or the integrals λIR and λIL of the target air-fuel ratio λTG) may be switched in accordance with the air-fuel ratio (rich/lean) of the output of the second sensor 25 and that of the output of the third sensor 26.

In such a manner, the target air-fuel ratio λTG can be changed with high response by switching the control gain in accordance with the states of the upstream and downstream catalysts 22 and 23. Consequently, the exhaust gases can be efficiently treated by efficiently using both of the upstream and downstream catalysts 22 and 23. In this case, the switch value of the control gain may be a fixed value or may be set by a map, a mathematical expression, or the like in accordance with the outputs of the second and third sensors 25 and 26.

Further, according to the combination of the air-fuel ratio (rich/lean) of the second sensor 25 and that of the third sensor 26, both of the control range of the target air-fuel ratio λTG and the control gain of the second closed loop control can be switched.

In the second embodiment, the target voltage Vtg of the second sensor 25 is set according to the output voltage of the third sensor 26 (air-fuel ratio on the downstream side of the downstream catalyst 23) by the target air-fuel ratio setting program in FIG. 7. According to whether the output voltage VOX2 of the second sensor 25 is higher than the target voltage Vtg or not, the state of the upstream catalyst 22 is determined, and the target air-fuel ratio λTG is set. The method of setting the target air-fuel ratio λTG may be variously changed. For example, either the second sensor 25 or the third sensor 26 is selected according to the engine operating conditions, the states of the catalysts 22 and 23, and the like, and the target air-fuel ratio λTG may be set on the basis of an output of the selected sensor.

The present invention is not limited to the exhaust emission control system using only three-way catalysts but can be applied also to an exhaust emission control system using a combination of a three-way catalyst and another catalyst (such as NOx catalyst) and an exhaust emission control system using catalysts other than the three-way catalyst.

(Third Embodiment)

A third embodiment will be described with reference to FIGS. 11–19. The configuration of a whole engine control system (see FIG. 1) and the fuel injection amount calculation program (see FIG. 2) are the same as in the first embodiment.

Outputs of the various sensors are input to an ECU 29. The ECU 29 is constructed mainly by a microcomputer. By executing each of programs of FIGS. 14–18 stored in a built-in ROM (storage medium), the control method is switched to any of the cases (1) through (4) in accordance with a combination of determination results of normal/abnormal states of the second and third sensors 25 and 26 to closed loop control the air-fuel ratio. In the following description, "closed loop control" will be described as "Closed loop control".

Figure 11:
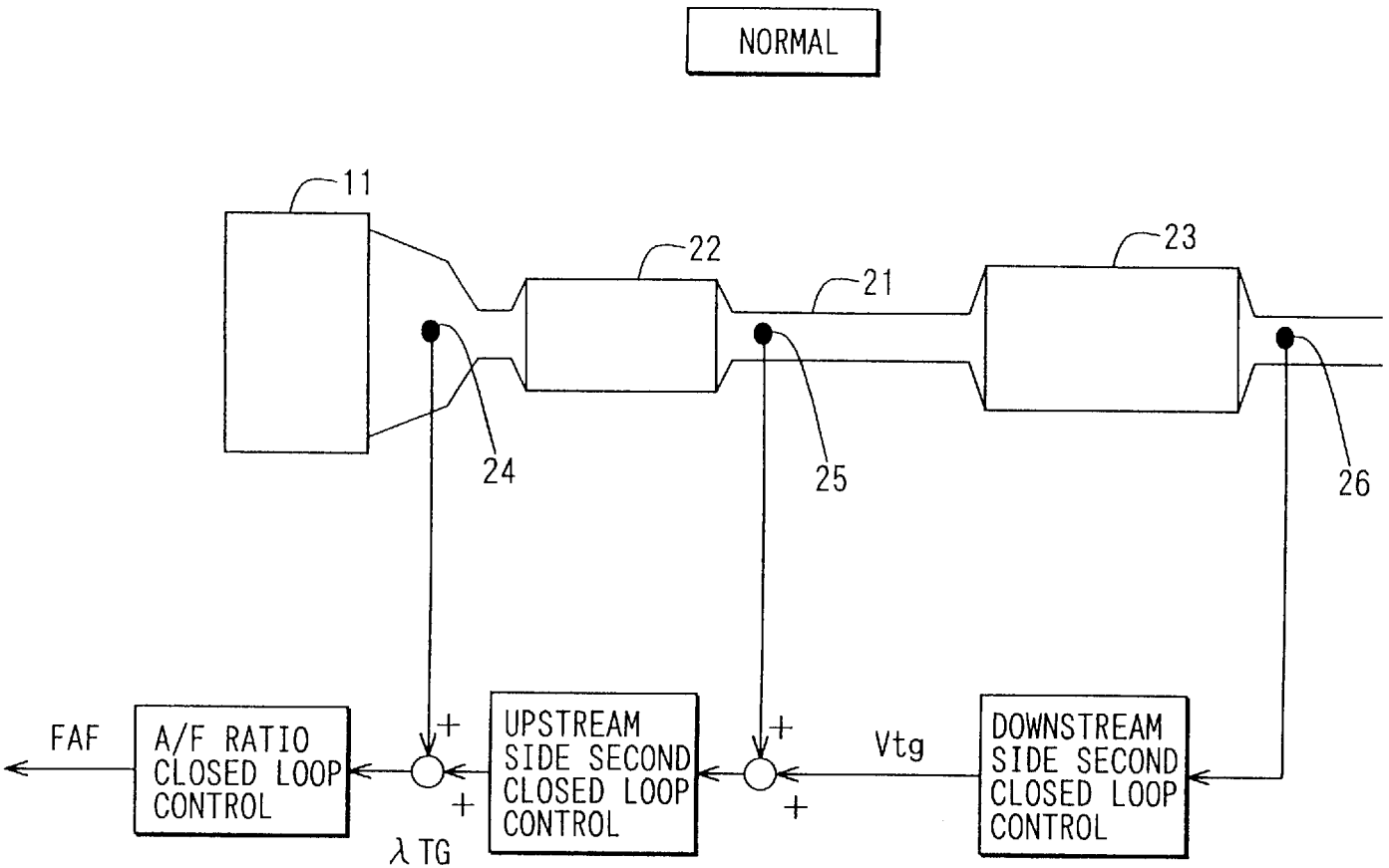
FIG. 11 is a block diagram for explaining an operation of an air-fuel ratio control system in the case where outputs of both a second sensor and a third sensor are normal (third embodiment)

(1) When outputs of both the second and third sensors 25 and 26 are normal, as shown in FIG. 11, a downstream-side second closed loop control for setting the target output Vtg of the second sensor 25 upstream of the downstream catalyst 23 (target air-fuel ratio on the upstream side of the downstream catalyst 23) is performed on the basis of the output of the third sensor 26 downstream of the downstream catalyst 23. Also, an upstream-side second closed loop control for setting a target output of the first sensor 24 upstream of the upstream catalyst 22 (target air-fuel ratio λTG on the upstream side of the upstream catalyst 22) is carried out on the basis of a deviation between the output of the second sensor 25 upstream of the downstream catalyst 23 and the target output Vtg. The functions correspond to downstream-side second closed loop control means and upstream-side second closed loop control means in the present invention.

Further, on the basis of a deviation between the output of the first sensor 24 upstream of the upstream catalyst 22 and its target output (target air-fuel ratio λTG), an air-fuel ratio correction factor FAF is calculated. The function corresponds to air-fuel ratio closed loop control means in the present invention.

Figure 12:
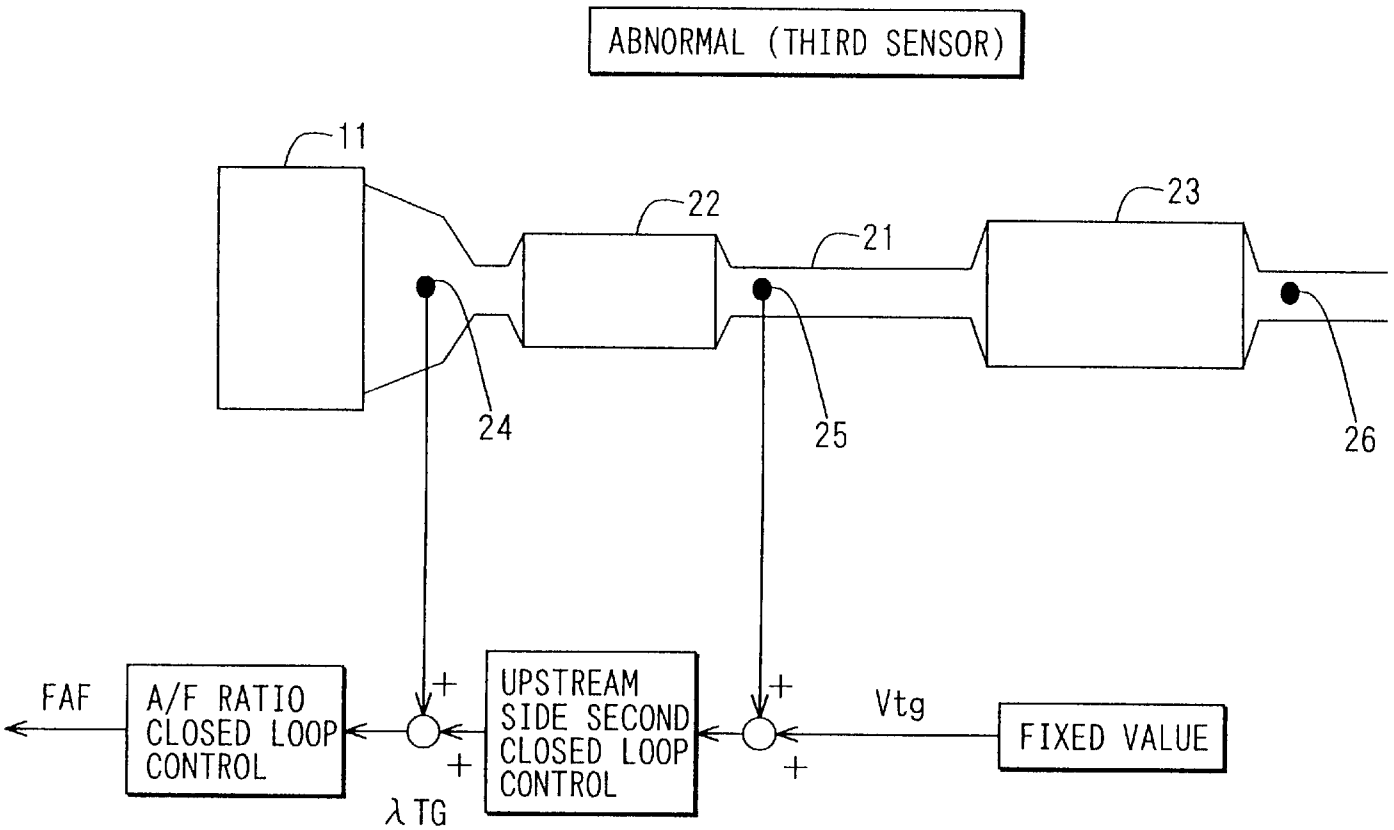
FIG. 12 is a block diagram for explaining the operation of the air-fuel ratio control system in the case where an output of the third sensor is abnormal (third embodiment)

(2) When the output of the third sensor 26 is abnormal (including the case where it is not activated yet), as shown in FIG. 12, the downstream-side second closed loop control is stopped and the upstream-side second closed loop control is executed as follows. The target output Vtg of the second sensor 25 upstream of the downstream catalyst 23 is set to a preset fixed value (or learn value). On the basis of a deviation between the output of the second sensor 25 and the target output Vtg, the target output of the first sensor 24 upstream of the upstream catalyst 22 (target air-fuel ratio λTG on the upstream side of the upstream catalyst 22) is set. The function corresponds to fail-safe means.

On the basis of the deviation between the output of the first sensor 24 and the target output of the first sensor 24 (target air-fuel ratio λTG), the air-fuel ratio correction factor FAF is calculated.

Figure 13:
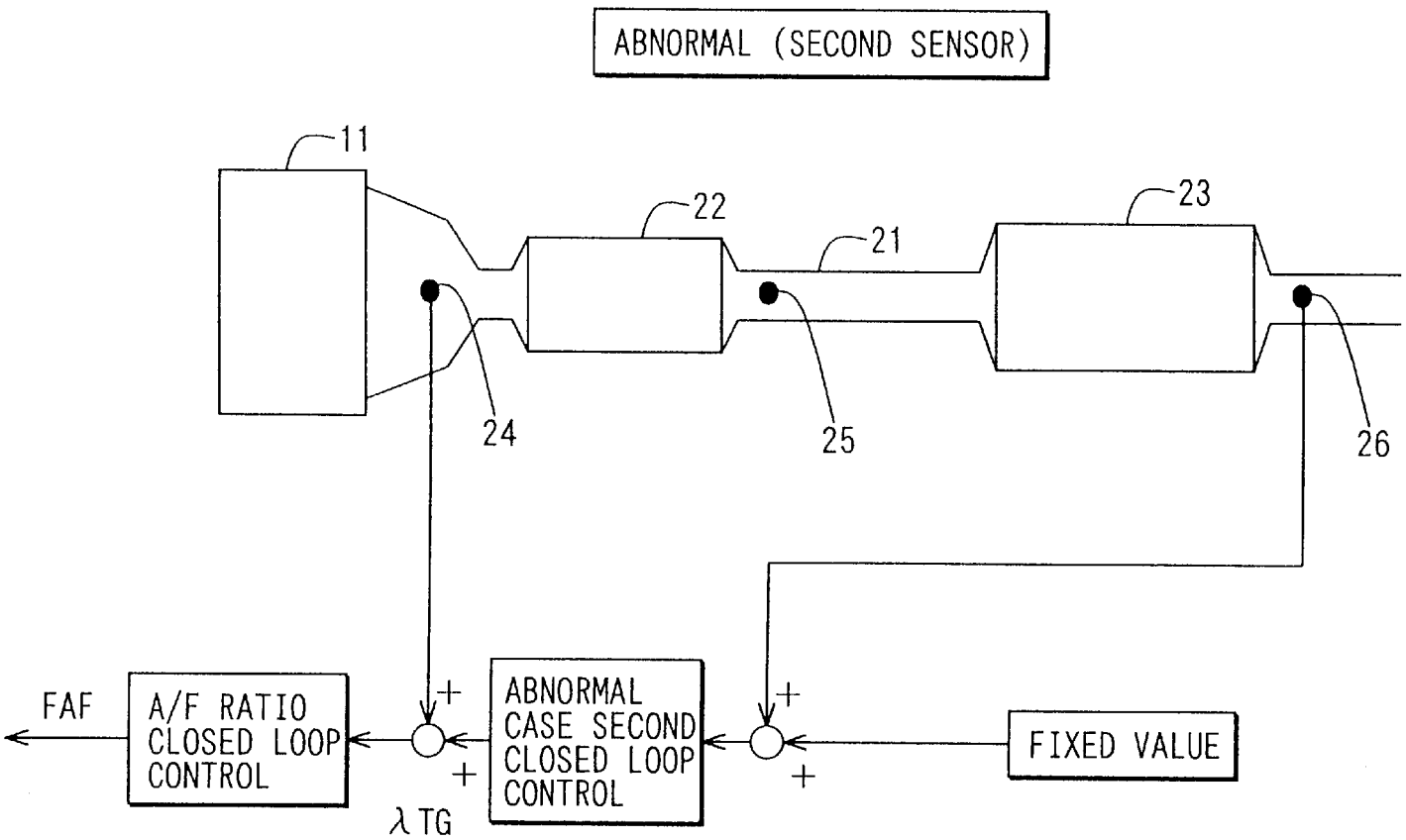
FIG. 13 is a block diagram for explaining an operation of the air-fuel ratio control system in the case where an output of the second sensor is abnormal (third embodiment)

(3) In the case where an output of the second sensor 25 is abnormal (including the case where it is not activated yet), as shown in FIG. 13, both the downstream-side second closed loop control and the upstream-side second closed loop control are stopped and, instead, a second closed loop control in an abnormal case is executed as follows. On the basis of a deviation between the output of the third sensor 26 downstream of the downstream catalyst 23 and a preset fixed value, the target output of the first sensor 24 upstream of the upstream catalyst 22 (target air-fuel ratio λTG on the upstream side of the upstream catalyst 22) is set. The function also corresponds to fail-safe means. The air-fuel ratio correction factor FAF is calculated on the basis of a deviation of the output of the first sensor 24 and the target output (target air-fuel ratio λTG) of the first sensor 24.

(4) When outputs of both the second sensor 25 and the third sensor 26 are abnormal (including the case where they are not activated yet), all the second closed loop controls are stopped. The target output of the first sensor 24 upstream of the upstream catalyst 22 (target air-fuel ratio λTG on the upstream side of the upstream catalyst 22) is set to a preset fixed value (or learn value). The air-fuel ratio correction factor FAF is calculated on the basis of the deviation between the output of the first sensor 24 and the target output (target air-fuel ratio λTG) of the first sensor 24.

The processes of each of the programs for executing the controls (1)–(4) will now be described.

As described above, the fuel injection amount calculation program are the same as in the first embodiment (see FIG. 2).

The processes of a target air-fuel ratio setting program in FIG. 14 executed in step 103 of FIG. 2 will now be described. In the program, according to a combination of the determination results (normal/abnormal states) of the second and third sensors 25 and 26 determined by a sensor output abnormal state detecting program which will be described hereinlater, by any of the methods (1) to (4) (FIGS. 11–13), the second closed loop control is executed to thereby set a target output of the first sensor 24 upstream of the upstream catalyst 22 (target air-fuel ratio λTG on the upstream side of the upstream catalyst 22).

When the program is started, first, in steps 501–503, a combination of the normal/abnormal states of the second and third sensors 25 and 26 is determined. According to the determination results, a second closed loop control is executed by any of the following methods (1) to (4).

Figure 16:
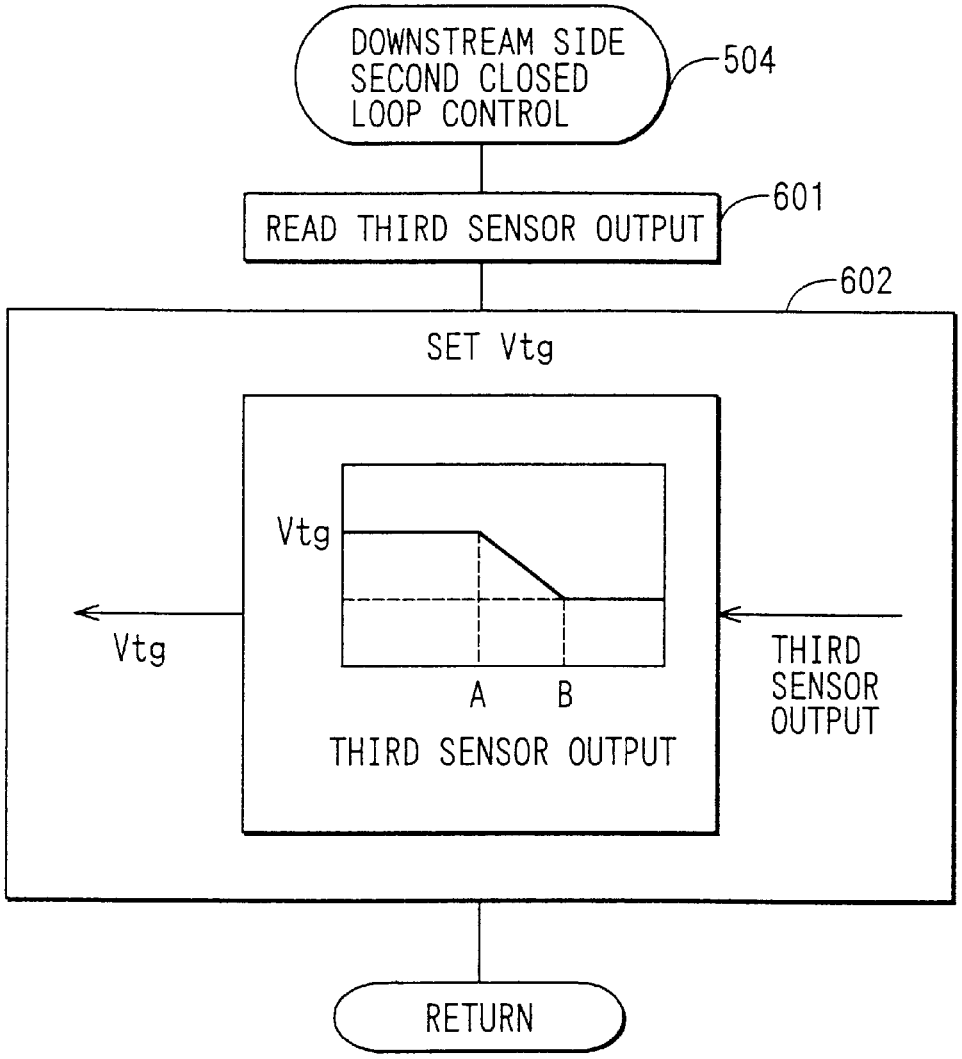
FIG. 16 is a flowchart showing a flow of a downstream-side second closed loop control program (third embodiment)

(1) When outputs of both the second and third sensors 25 and 26 are normal, that is, determination results in steps 501 and 502 are "Yes", the program advances to step 504 where a downstream-side second closed loop control program of FIG. 16 which will be described hereinlater is executed. On the basis of an output of the third sensor 26 downstream of the downstream catalyst 23, the target output Vtg of the second sensor 25 upstream of the downstream catalyst 23 (target air-fuel ratio on the upstream side of the downstream catalyst 23) is set.

After that, the program advances to step 505 where a rich-side limit value and a lean-side limit value as a control range of the target air-fuel ratio λTG on the upstream side of the upstream catalyst 22 are set to a rich-side limit value and a lean-side limit value in a normal state, respectively. In step 508, an upstream-side second closed loop control program of FIG. 17 which will be described hereinlater is executed to set the target output of the first sensor 24 upstream of the upstream catalyst 22 (target air-fuel ratio λTG) on the basis of a deviation between the output of the second sensor 25 upstream of the downstream catalyst 23 and the target output Vtg of the second sensor 25.

After that, in step 509, the target air-fuel ratio λTG is subjected to a limiting process by using the rich-side limit value and the lean-side limit value in the normal state set in step 505, thereby calculating the final target air-fuel ratio λTG.

(2) When the output of the second sensor 25 is normal and the output of the third sensor 26 is abnormal (including the case where it is not activated yet), that is, "Yes" in step 501 and "No" in step 502, the program advances to step 506 where the upstream-side second closed loop control is stopped, and the target output Vtg of the second sensor 25 upstream of the downstream catalyst 23 is set to a preset fixed value (or learn value). After that, the program advances to step 507 where the rich-side and lean-side limit values for the target air-fuel ratio λTG are set to rich-side and lean-side limit values in an abnormal state, respectively. In this case, the rich-side limit value in the abnormal state (lean-side limit value in the abnormal state) is set to a value having a richness degree (leanness degree) lower than the rich-side limit value in the normal state (lean-side limit value in the normal state).

Figure 17:
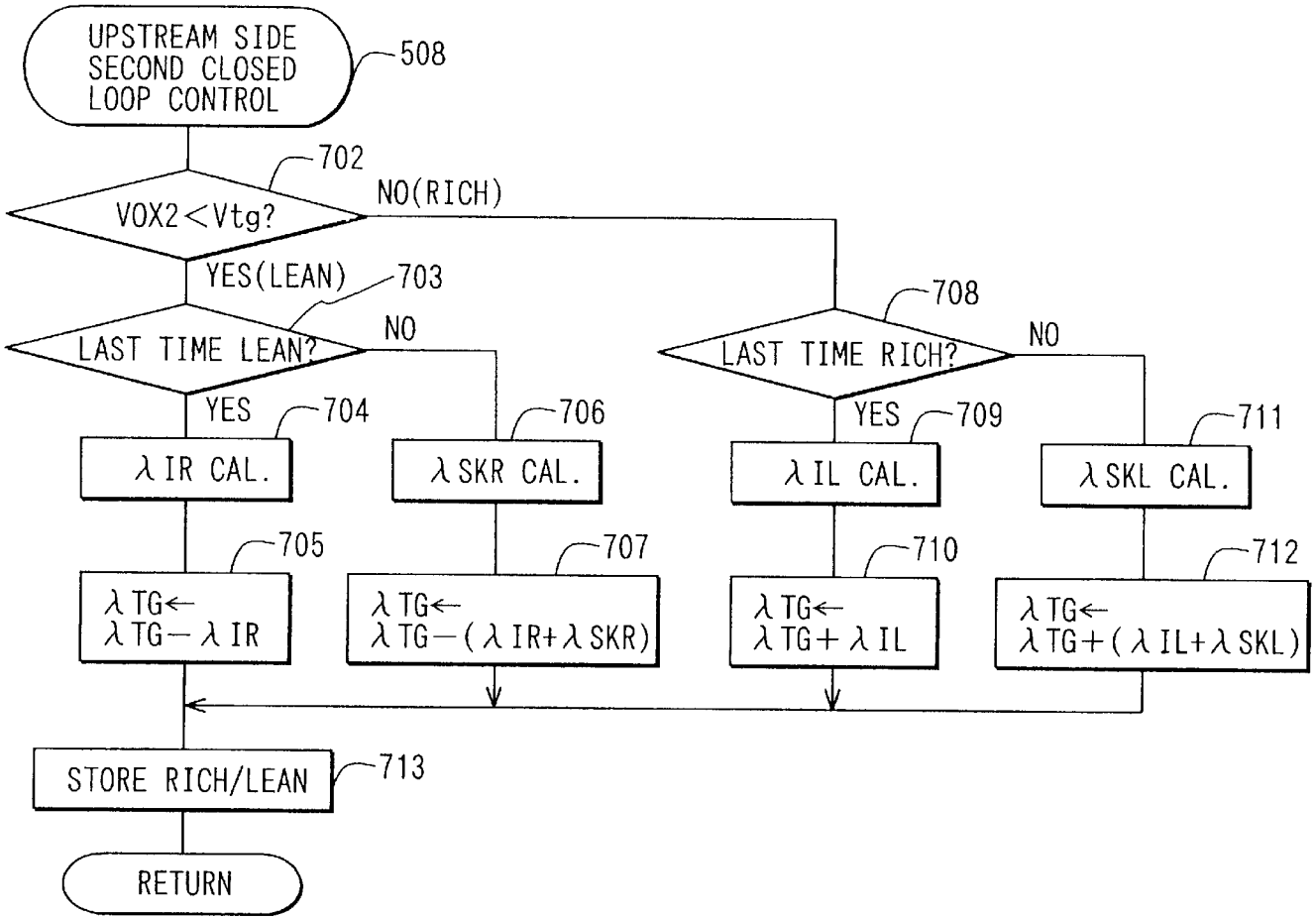
FIG. 17 is a flowchart showing a flow of an upstream-side second closed loop control program (third embodiment)

After that, in step 508, an upstream-side second closed loop control program of FIG. 17 which will be described hereinlater is executed to set the target output of the first sensor 24 upstream of the upstream catalyst 22 (target air-fuel ratio λTG on the upstream side of the upstream catalyst 22) on the basis of a deviation between the output of the second sensor 25 upstream of the downstream catalyst 23 and the target output Vtg (fixed value or learn value) of the second sensor 25. After that, in step 509, the target air-fuel ratio λTG is subjected to the limiting process by using the rich-side and lean-side limit values in the abnormal state set in step 507, thereby obtaining the final target air-fuel ratio λTG.

Figure 15:
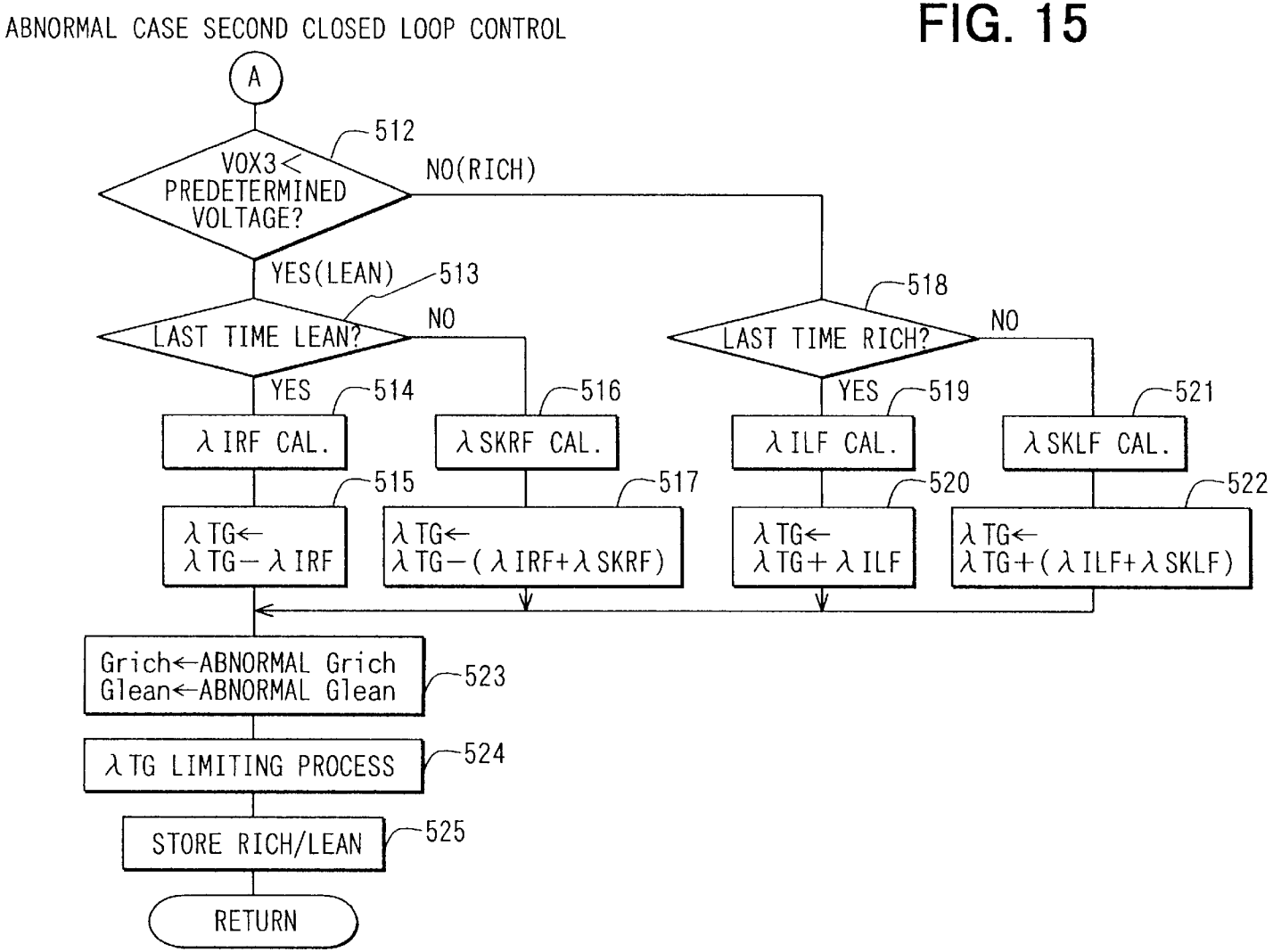
FIG. 15 is a flowchart showing a flow of the target air-fuel ratio setting program (third embodiment)

(3) When the output of the second sensor 25 is abnormal (including the case where it is not activated yet) and the output of the third sensor 26 is normal, that is, "No" in step 501 and "Yes" in step 503, both the downstream-side second closed loop control and the upstream-side second closed loop control are stopped. Instead, processes in step 512 and subsequent steps in FIG. 15 are executed to carry out the second closed loop control in the abnormal state for setting the target output of the first sensor 24 upstream of the upstream catalyst 22 (target air-fuel ratio λTG on the upstream side of the upstream catalyst 22) on the basis of a deviation between the output of the third sensor 26 downstream of the downstream catalyst 23 and a preset predetermined voltage (fixed value) as follows.

First, in step 512, whether the state of the downstream catalyst 23 is lean or rich is determined depending on whether an output voltage VOX of the third sensor 26 downstream of the downstream catalyst 23 is lower than a predetermined voltage (voltage around the stoichiometric ratio) or not. When the state of the downstream catalyst 23 is lean, the program advances to step 513 where whether the state of the downstream catalyst 23 was lean also in the last time or not is determined. If "Yes", the program advances to step 514 where an integral λIRF to the rich side of the second closed loop control in the abnormal state is calculated from a map or the like in accordance with a current intake air volume. The integral λIRF to the rich side of the second closed loop control in the abnormal state is set to a value smaller than the integral λIR in the normal state used in an upstream-side second closed loop control program of FIG. 17 which will be described hereinlater. After calculating the integral λIRF to the rich side, the program advances to step 515 where the target air-fuel ratio λTG is corrected to the rich side only by the integral λIRF to the rich side. After that, the program advances to step 523.

When the state was rich last time and is changed to the lean side this time, the program advances to step 516 where a skip amount λSKRF to the rich side is calculated from a map or the like in accordance with the output of the third sensor 26. The skip amount λSKRF to the rich side in the second closed loop control in the abnormal state is set to a value smaller than the rich skip amount λSKR to the rich side in the normal state used in the upstream-side second closed loop control program of FIG. 17 which will be described hereinlater. After calculating the skip amount λSKRF to the rich side, the program advances to step 517 where the target air-fuel ratio λTG is corrected to the rich side only by λIR+λSKRF, and the program advances to step 523.

On the other hand, when it is determined in step 512 that the output voltage VOX3 of the third sensor 26 is higher than the target voltage Vtg (the state of the downstream catalyst 23 is on the rich side), the program advances to step 518 where whether the state of the downward catalyst 23 was also rich last time or not is determined. If "Yes", the program advances to step 519 where an integral λILF to the lean side is calculated from a map or the like in accordance with a present intake air volume. The integral λILF to the lean side in the abnormal state is set to a value smaller than the integral λIL in the normal state used in the upstream-side second closed loop control program which will be described hereinlater. After calculating the integral λILF to the lean side, the program advances to step 520 where the target air-fuel ratio λTG is corrected to the lean side only by λILF. After that, the program advances to step 523.

When the state was lean last time and is changed to the rich side this time, the program advances to step 521 where the skip amount λSKLF to the lean side is calculated from a map or the like in accordance with an output of the third sensor 26 (adsorption state of the downstream catalyst 23). The skip amount λSKLF to the lean side in the second closed loop control in the abnormal state is set to a value smaller than the skip amount λSKL to the rich side in the normal state used in the upstream second closed loop control program of FIG. 17 which will be described hereinlater. After calculating the skip amount λSKLF to the lean side, the program advances to step 522 where the target air-fuel ratio λTG is corrected to the lean side only by λILF+λSKLF, and the program advances to step 523.

In step 523, the rich-side limit value and the lean-side limit value for the target air-fuel ratio λTG are set to those in the abnormal state. At this time, the rich-side limit value in the abnormal state (lean-side limit value in the abnormal state) is set to a value having the degree of richness (degree of leanness) lower than that of the rich-side limit value in the normal state (lean-side limit value in the normal state).

After that, the program advances to step 524 where the target air-fuel ratio λTG is subjected to a limiting process by using the rich-side and lean-side limit values in the abnormal state, thereby calculating the final target air-fuel ratio λTG. In step 525, the rich/lean side of the upstream catalyst 22 at that time is stored, and the program is finished.

Figure 14:
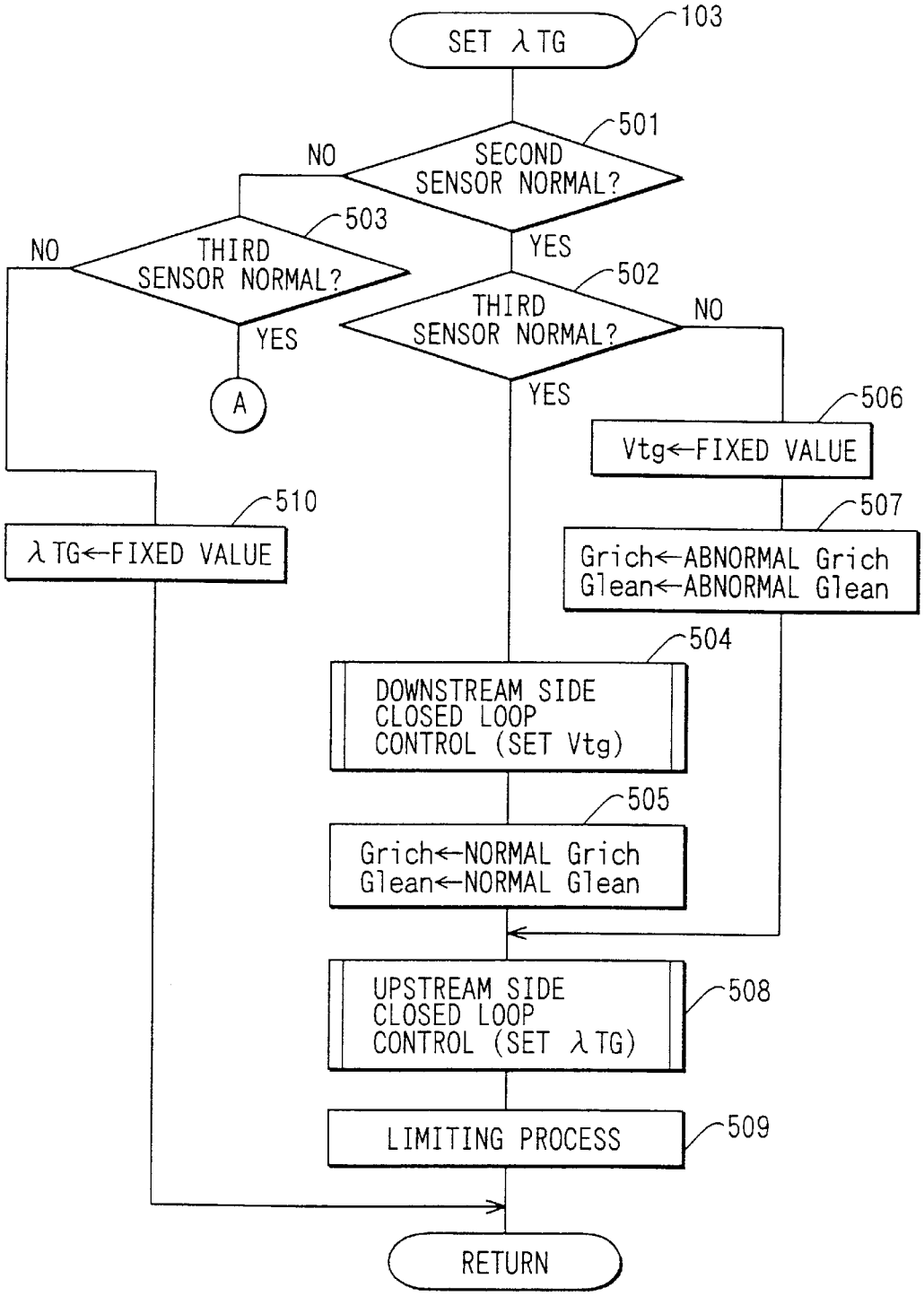
FIG. 14 is a flowchart showing a flow of a target air-fuel ratio setting program (third embodiment)

(4) When the outputs of both the second and third sensors 25 and 26 are abnormal (including the case where they are not activated yet), that is, "No" in both steps 501 and 503 in FIG. 14, all the second closed loop controls described above are stopped, and the program advances to step 510. In step 510, the target output of the first sensor 24 upstream of the upstream catalyst 22 (target air-fuel ratio λTG on the upstream side of the upstream catalyst 22) is set to a preset fixed value (or learn value), and the program is finished.

Next, the processes of the downstream-side second closed loop control program in FIG. 16 executed in step 504 in FIG. 14 will now be described. The program is executed only when the outputs of both the second and third sensors 25 and 26 are normal.

When the program is started, first, in step 601, the output of the third sensor 26 downstream of the downstream catalyst 23 (air-fuel ratio on the downstream side of the downstream catalyst 23) is read. In step 602, the target voltage Vtg of the second sensor 25 is set from a map in accordance with the output voltage of the third sensor 26. The map characteristics of the target voltage Vtg are as follows. In an area where the output voltage of the third sensor 26 is in a predetermined range (A<output voltage<B), the higher the output voltage of the third sensor 26 is, the lower the target voltage Vtg of the second sensor 25 is. In an area where the output voltage of the third sensor 26 is equal to or lower than the predetermined value A, the target voltage Vtg of the second sensor 25 is constant at the upper limit value. In an area where the output voltage of the third sensor 26 is equal to or higher than the predetermined value B, the target voltage Vtg of the second sensor 25 is constant at the lower limit value.

Thus, the target voltage Vtg of the second sensor 25 is set so that either the state of the upstream catalyst 22 and the state of the downstream catalyst 23 is rich and the other one is rich. As a result, the rich-side components and lean-side components in the exhaust gases can be efficiently reduced by effectively using both the upstream and downstream catalysts 22 and 23, and the catalytic conversion efficiency can be increased.

The processes of the upstream-side second closed loop control program of FIG. 17 executed in step 508 in FIG. 14 will now be described. The program is executed when the output of the second sensor 25 upstream of the downstream catalyst 23 is normal irrespective of whether the output of the third sensor 26 downstream of the downstream catalyst 23 is normal or abnormal.

When the program is started, first, in step 701, whether the state of the upstream catalyst 22 is lean or rich is determined depending on whether an output voltage VOX2 of the second sensor 25 is lower than the target voltage Vtg or not. When the outputs of both the second and third sensors 25 and 26 are normal, the target voltage Vtg set by the downstream-side second closed loop control program of FIG. 16 is used. When an output of the third sensor 26 is abnormal, the fixed value (or learn value) set in step 506 in FIG. 14 is used as the target voltage Vtg.

When it is determined in step 702 that the output voltage VOX2 of the second sensor 25 is lower than the target voltage Vtg (the state of the upstream catalyst 22 is lean), the program advances to step 703 where whether the state was lean also in the last time or not is determined. If "Yes", the program advances to step 704 where an integral λIR to the rich side is calculated from a map or the like in accordance with a current intake air volume. When the outputs of both the second and third sensors 25 and 26 are normal, the integral λIR is set to the integral to the rich side in the normal state. When the output of the third sensor 26 is abnormal, the integral λIR to the rich side is set to an integral to the rich side in the abnormal state which is smaller than that in the normal state. After calculating the integral λIR to the rich side, the program advances to step 705 where the target air-fuel ratio λTG is corrected to the rich side only by the integral λIR. After that, the program advances to step 713.

When the state was rich last time and is changed to the lean side this time, the program advances to step 706 where a skip amount λSKR to the rich side is calculated from a map or the like in accordance with the output of the second sensor 25 (adsorption state of the upstream catalyst 22). When the outputs of both the second and third sensors 25 and 26 are normal, the skip amount λSKR to the rich side is set to the skip amount to the rich side in the normal state. When the output of the third sensor 26 is abnormal, the skip amount λSKR to the rich side is set to the skip amount to the rich side in the abnormal state which is smaller than the skip amount to the rich side in the normal state. After calculating the skip amount λSKR to the rich side, the program advances to step 707 where the target air-fuel ratio λTG is corrected to the rich side only by λIR+λSKR, and the program advances to step 713.

On the other hand, when it is determined in step 702 that the output voltage VOX2 of the second sensor 25 is higher than the target voltage Vtg (the state of the upstream catalyst 22 is on the rich side), the program advances to step 708 where whether the state was also rich last time or not is determined. If "Yes", the program advances to step 709 where the integral λIL to the lean side is calculated from a map or the like in accordance with a present intake air volume. When the outputs of both the second and third sensors 25 and 26 are normal, the integral λIL to the lean side is set to the integral to the lean side in the normal state. When the output of the third sensor 26 is abnormal, the integral λIL to the lean side is set to the integral to the lean side in the abnormal state which is smaller than that in the normal state. After calculating the integral λIL to the lean side, the program advances to step 710 where the target air-fuel ratio λTG is corrected to the lean side only by λIL. After that, the program advances to step 713.

When the state was lean last time and is changed to the rich side this time, the program advances to step 711 where the skip amount λSKL to the lean side is calculated from a map or the like in accordance with an output of the third sensor 26 (adsorption state of the downstream catalyst 23). When the outputs of both the second and third sensors 25 and 26 are normal, the skip amount λSKL to the lean side is set to the skip amount to the lean side in the normal state. When an output of the third sensor 26 is abnormal, the skip amount λSKL to the lean side is set to the skip amount to the lean side in the abnormal state which is smaller than that in the normal state. After calculating the skip amount λSKL to the lean side, the program advances to step 712 where the target air-fuel ratio λTG is corrected to the lean side only by λIL+λSKL, and the program advances to step 713.

In step 713, the rich/lean state of the upstream catalyst 22 at that time is stored, and the program is finished.

Figure 18:
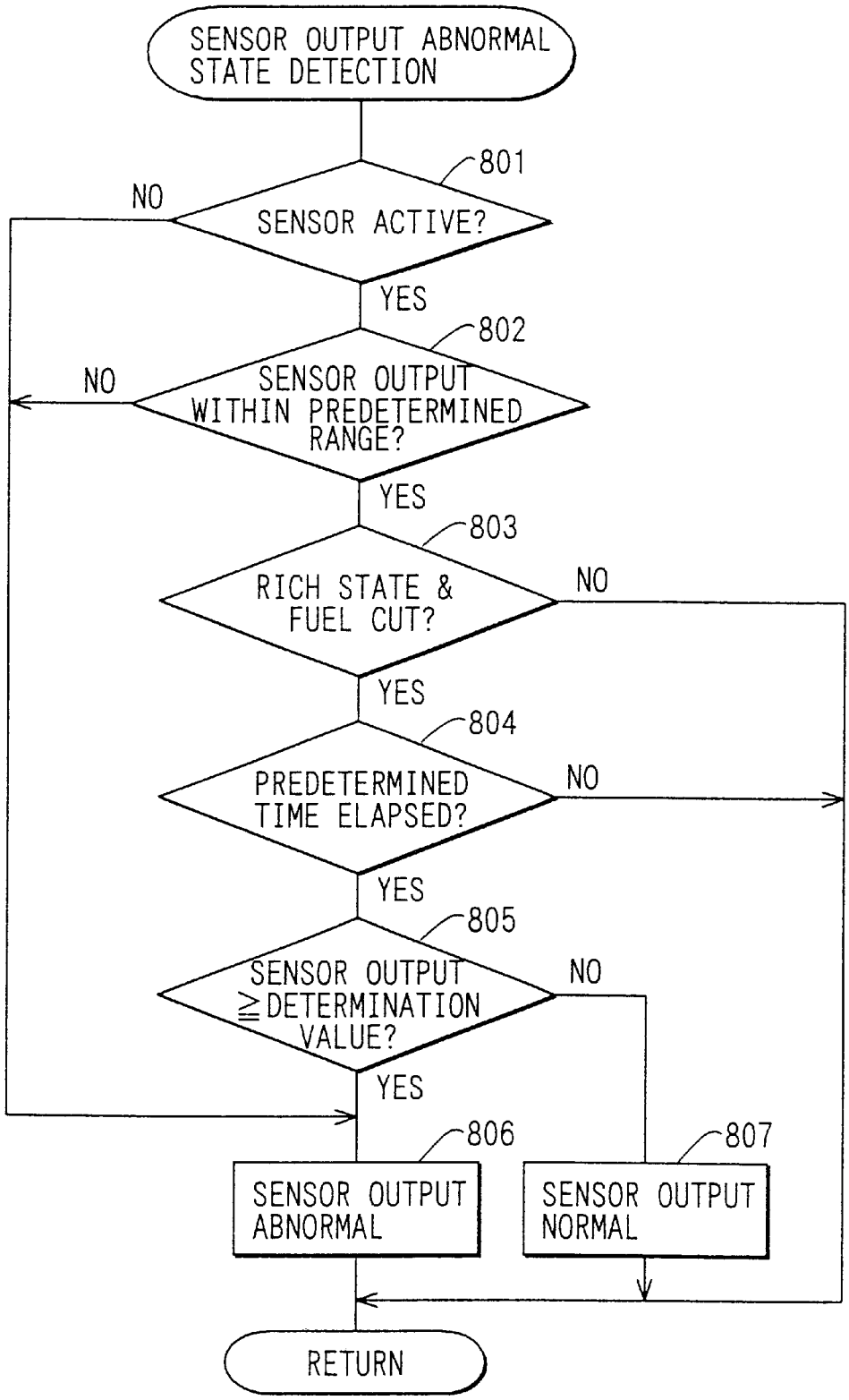
FIG. 18 is a flowchart showing a flow of a sensor output abnormal state detecting program (third embodiment)

The processes of a sensor output abnormal state detecting program in FIG. 18 will now be described. The program is executed every predetermined time or every predetermined crank angle during engine operation and plays the role of sensor diagnosing means in the present invention. The program is executed with respect to each of the second and third sensors 25 and 26, there by determining the normal/abnormal state of each of the sensors 25 and 26. In the following description, the second and third sensors 25 and 26 will be collectively called a sensor.

When the program is started, first, whether the temperature of the sensor has been increased to the active state or not is determined (step 801). The active state of the sensor may be determined by directly detecting the sensor temperature by a thermistor or the like or by estimating the sensor temperature from exhaust temperature, cooling water temperature, an integrated value of a fuel injection amount after starting the engine, elapsed time since the start, a resistance value of the sensor, or the like. When the sensor is not activated yet, the program advances to step 806 and it is determined that the sensor output is abnormal.

On the other hand, when the temperature of the sensor has been increased to the active state, the program advances to step 802 where whether or not the sensor output is in a predetermined range from the minimum voltage to the maximum voltage in the normal state is determined. If "No", a failure such as disconnection or short circuit can be considered, so that the program advances to step 806 where it is determined that the sensor output is abnormal. When the sensor output is within the predetermined range, the program advances to step 803 where whether the sensor output is in a rich state and the fuel is cut or not is determined. If "No", the program is finished without performing the subsequent processes.

After that, at the time point when the fuel is cut in a state where the sensor output is rich, the program shifts from step 803 to step 804. In step 804, whether or not a predetermined time has elapsed since the sensor output crosses from the rich side to the lean side (that is, whether or not a time required for the output of the normal sensor to decrease to almost the minimum voltage has elapsed) is determined. If "No", the program is finished without performing the subsequent processes.

After that, when the predetermined time has elapsed since the time point when the sensor output crosses from the rich side to the lean side, the program advances from step 804 to step 805. In step 805, the sensor output at that time point is compared with a predetermined determination value. When the sensor output is equal to or larger than the determination value, the program advances to step 806 where it is determined that the sensor output is abnormal. On the contrary, when the sensor output is smaller than the determination value, the program advances to step 806 where it is determined that the sensor output is normal.

Figure 19:
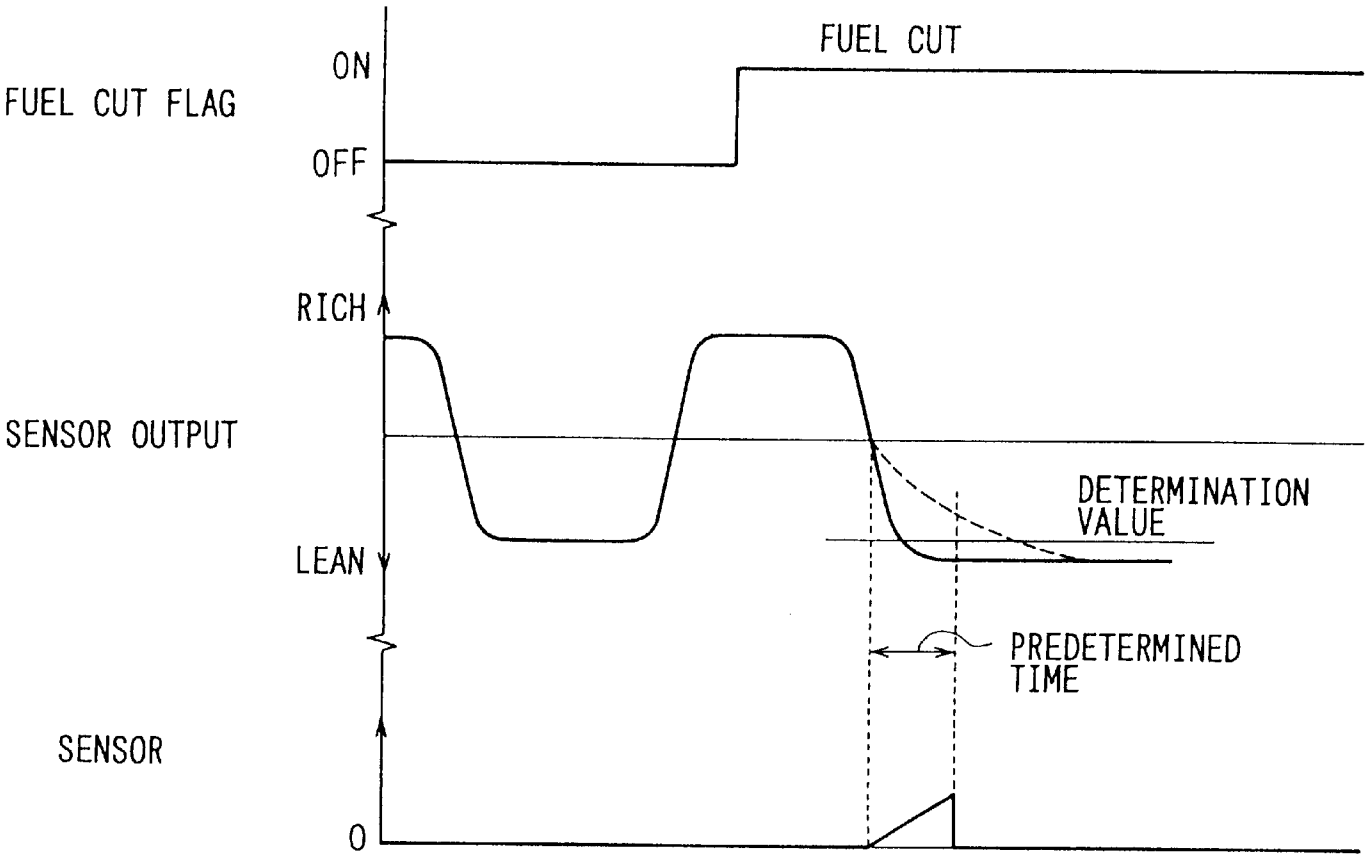
FIG. 19 is a time chart for explaining a sensor output abnormal state detecting method (third embodiment)

An example of executing the above-described sensor output abnormal state detecting program will be described by referring to the time chart of FIG. 19. When the fuel is cut in the state where the sensor output is rich, the air-fuel ratio of the exhaust gas becomes lean, so that the sensor output is changed from the rich side to the lean side. When the sensor is normal, as shown by a solid line in FIG. 19, after the fuel cut, the sensor output decreases to the minimum voltage (limit voltage on the lean side) with high response. However, when the sensor deteriorates, the response decreases, and the sensor output decreases to around the minimum voltage after the fuel cut at lower speed. Thus, at the time point when the predetermined time has elapsed since the sensor output crosses from the rich side to the lean side (that is, the time point when the time required for the output of the normal sensor to decrease to almost the minimum voltage has elapsed), the sensor output at that time point is compared with a predetermined determination value (minimum voltage+α). When the sensor output is lower than the determination value, it is determined that the sensor output is normal. When the sensor output is equal to or larger than the determination value, it is determined that the sensor output is abnormal.

It is also possible to determine whether the sensor output is normal or abnormal by measuring required time since the sensor output crosses from the rich side to the lean side until the sensor output reaches the determination value and detecting whether the required time is shorter than the predetermined time or not.

The method of detecting the abnormal state of the sensor output may be variously changed. For example, whether the sensor output is normal or abnormal may be determined from the relation between a sensor application voltage and a detection current.

In the above-described third embodiment, when the output of the third sensor 26 is abnormal (including the case where it is not activated yet) out of the two sensors 25 and 26 used for the second closed loop control for setting the target output of the first sensor 24 upstream of the upstream catalyst 22 (target air-fuel ratio λTG on the upstream side of the upstream catalyst 22), as shown in FIG. 12, the target output Vtg of the second sensor 25 is set to the preset fixed value (or learn value). On the basis of the deviation between the output of the second sensor 25 and the target output Vtg, the target output of the first sensor 24 upstream of the upstream catalyst 22 (target air-fuel ratio λTG on the upstream side of the upstream catalyst 22) is set. When the output of the second sensor 25 is abnormal (including the case where it is not activated yet), as shown in FIG. 13, on the basis of the deviation between the output of the third sensor 26 and the preset fixed value, the target output of the first sensor 24 upstream of the upstream catalyst 22 (target air-fuel ratio ATG on the upstream side of the upstream catalyst 22) is set. In the embodiment, therefore, even in the case where one of the two sensors 25 and 26 used for the second closed loop control becomes abnormal, the second closed loop control in which the states of the catalysts 22 and 23 are reflected to some extent can be performed by using the sensor which functions normally. Thus, the deterioration in exhaust gas conversion efficiency can be minimized.

Moreover, in the third embodiment, when one of the two sensors 25 and 26 is abnormal, the control gains (skip amount and the integral) and the control range (limit values) of the second closed loop control are lowered as compared with those in the normal state. Consequently, the control in which a margin is provided for the conversion efficiency of the two catalysts 22 and 23 can be performed. The adsorption states of the two catalysts 22 and 23 can be therefore prevented from being saturated with the lean-side components or rich-side components.

Although both the control gains and the control range are lowered in the abnormal state in the third embodiment, only one of the control gains and the control range can be lowered. Obviously, the control gains and the control range may not be switched according to the normal/abnormal state.

(Fourth Embodiment)

A fourth embodiment will be described with reference to FIGS. 20–23. The configuration of a whole engine control system (see FIG. 1), the fuel injection amount calculation program (see FIG. 2), and the target air-fuel ratio setting program (see FIG. 3) are the same as in the first embodiment.

Outputs of various sensors are input to an ECU 29. The ECU 29 is constructed mainly by a microcomputer. By executing each of programs stored in a built-in ROM (storage medium), the air-fuel ratio is closed loop controlled on the basis of outputs of the first to third sensors 24–26.

Figure 20:
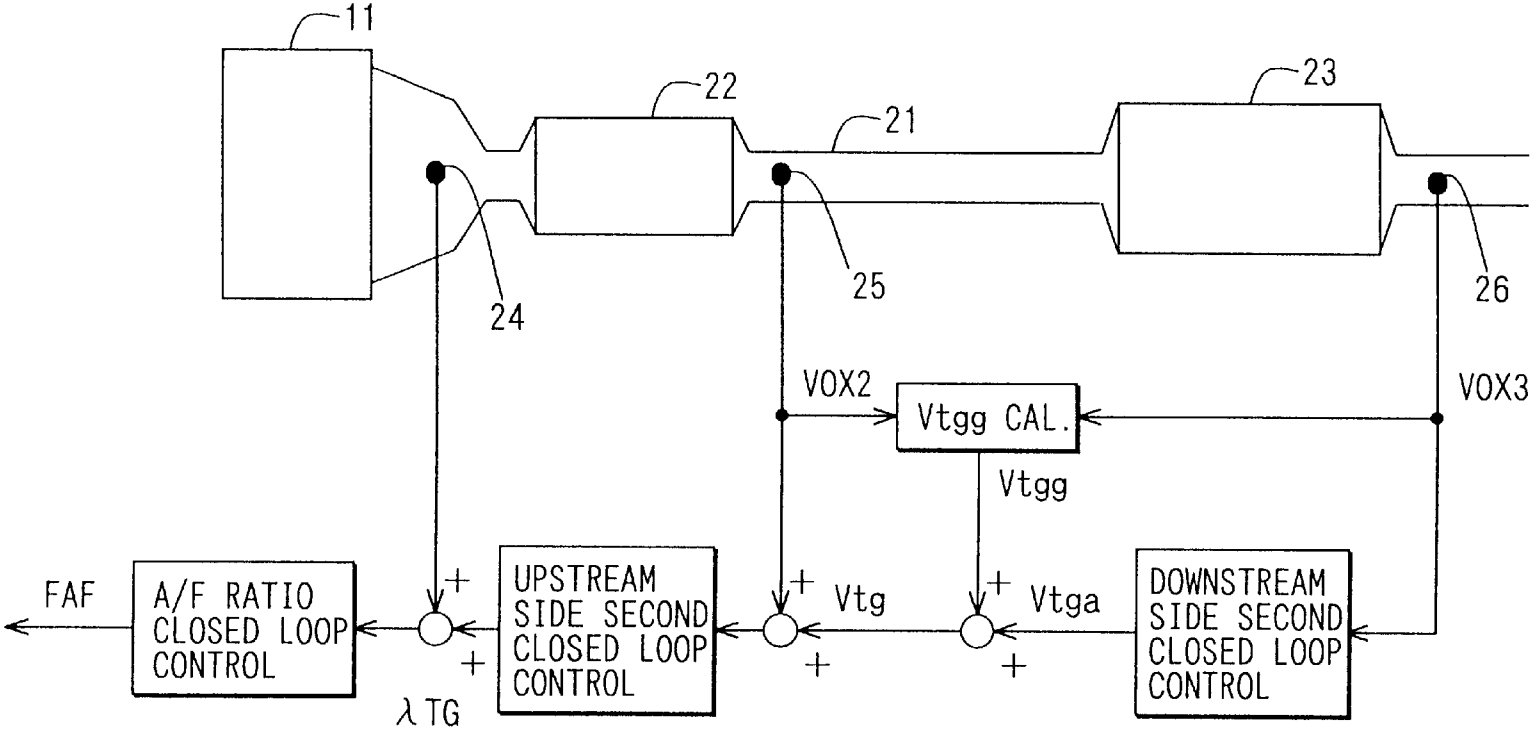
FIG. 20 is a block diagram for explaining an operation of an air-fuel ratio control system (fourth embodiment)

The air-fuel ratio Closed loop control is executed as follows. As shown in FIG. 20, a downstream-side second closed loop control for setting a target output Vtga of the second sensor 25 upstream of the downstream catalyst 23 (target air-fuel ratio on the upstream side of the downstream catalyst 23) is performed on the basis of an output of the third sensor 26 downstream of the downstream catalyst 23. This function corresponds to downstream-side second closed loop control means and upstream-side second closed loop control means in the present invention.

Further, a learn correction amount Vtgg for the target output Vtga of the second sensor 25 set in the downstream-side second closed loop control is calculated on the basis of a deviation between the output of the second sensor 25 and the output of the third sensor 26. The learn correction amount Vtgg is added to the target output Vtga of the second sensor 25 set in the downstream-side second closed loop control, thereby obtaining the final target output Vtg. The function corresponds to learning means in the present invention.

On the other hand, an upstream-side second closed loop control for setting a target output of the first sensor 24 upstream of the upstream catalyst 22 (target air-fuel ratio λTG on the upstream side of the upstream catalyst 22) is executed on the basis of a deviation between the output of the second sensor 25 upstream of the downstream catalyst 23 and the target output Vtg. The function corresponds to upstream-side second closed loop control means in the present invention.

Further, on the basis of a deviation between the output of the first sensor 24 upstream of the upstream catalyst 22 and the target output (target air-fuel ratio λTG) of the first sensor 24, an air-fuel ratio correction factor FAF is calculated. The function corresponds to air-fuel ratio closed loop control means in the present invention.

Figure 21:
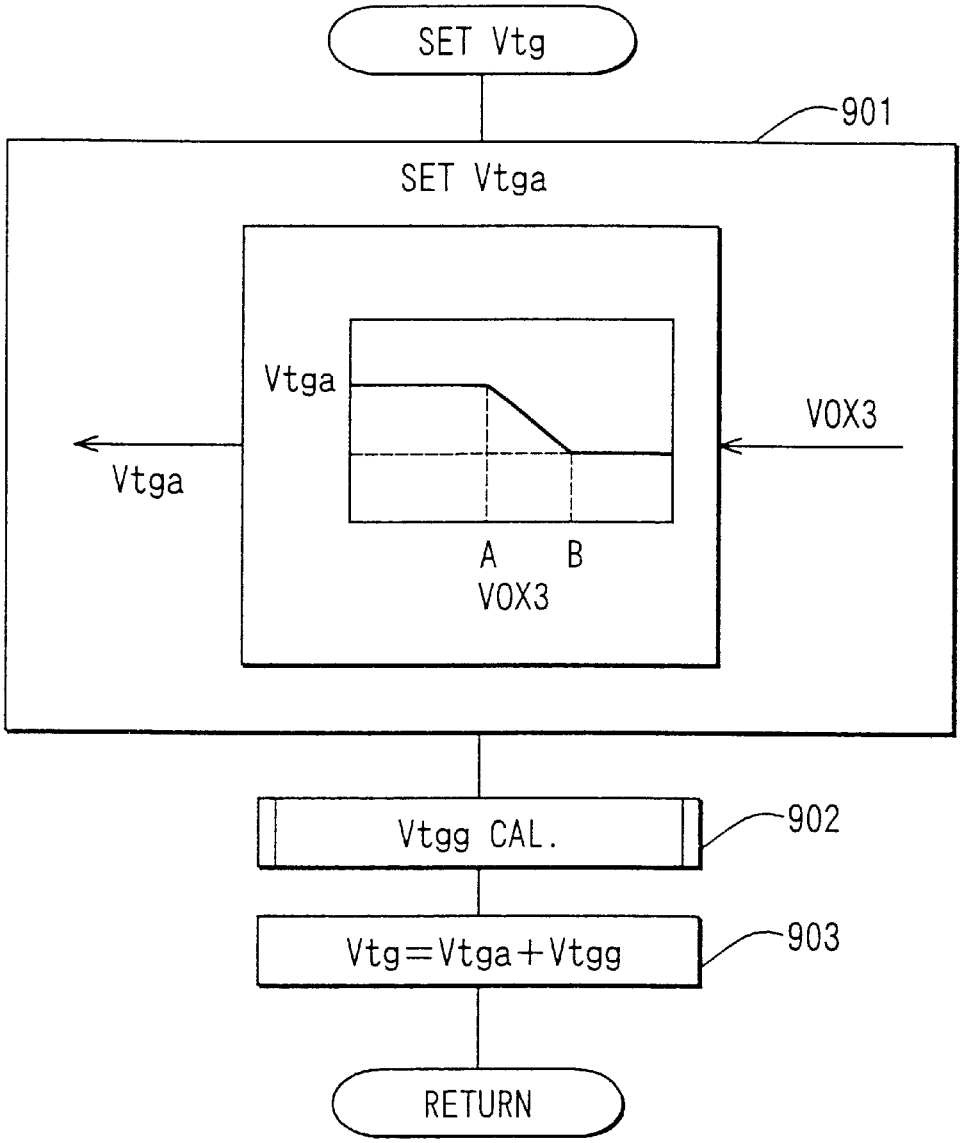
FIG. 21 is a flowchart showing a flow of a second sensor target voltage setting program (fourth embodiment)

The processes of a second sensor target voltage setting program of FIG. 21 executed in step 201 in FIG. 3 will be described. When the program is started, first, in step 901, a target voltage Vtga of the second sensor 25 is set from a map in accordance with an output voltage VOX3 of the third sensor 26. The map characteristics of the target voltage Vtga are as follows. In an area where the output voltage VOX3 of the third sensor 26 is in a predetermined range (A<output voltage<B), the higher the output voltage VOX3 of the third sensor 26 becomes, the lower the target voltage Vtga of the second sensor 25 becomes. In an area where the output voltage VOX3 of the third sensor 26 is equal to or lower than the predetermined value A, the target voltage Vtga of the second sensor 25 is constant at the upper limit value. In an area where the output voltage VOX3 of the third sensor 26 is equal to or higher than the predetermined value B, the target voltage Vtga of the second sensor 25 is constant at the lower limit value.

By the operation, the target voltage Vtga of the second sensor is set so that one of the states of the upstream catalyst 22 and the downstream catalyst 23 becomes rich, and the state of the other catalyst becomes lean. As a result, the components on the rich side and the components on the lean side in the exhaust gases can be efficiently reduced by effectively using both the upstream and downstream catalysts 22 and 23. Thus, the improved exhaust gas reducing efficiency can be achieved.

After setting the target voltage Vtga of the second sensor in accordance with the output voltage VOX3 of the third sensor 26 in step 901, the program advances to step 902. In step 902, a learn correction amount calculating program of FIG. 22 which will be described hereinlater is executed to calculate a learn correction amount Vtgg to the target output Vtga of the second sensor 25 on the basis of a deviation between outputs of the second and third sensors 25 and 26. After that, in step 903, the learn correction amount Vtgg is added to the target voltage Vtga of the second sensor 25 set in the downstream-side second closed loop control (step 901), thereby obtaining a final target output Vtg.

$$Vtg=Vtga+Vtgg$$

Figure 22:
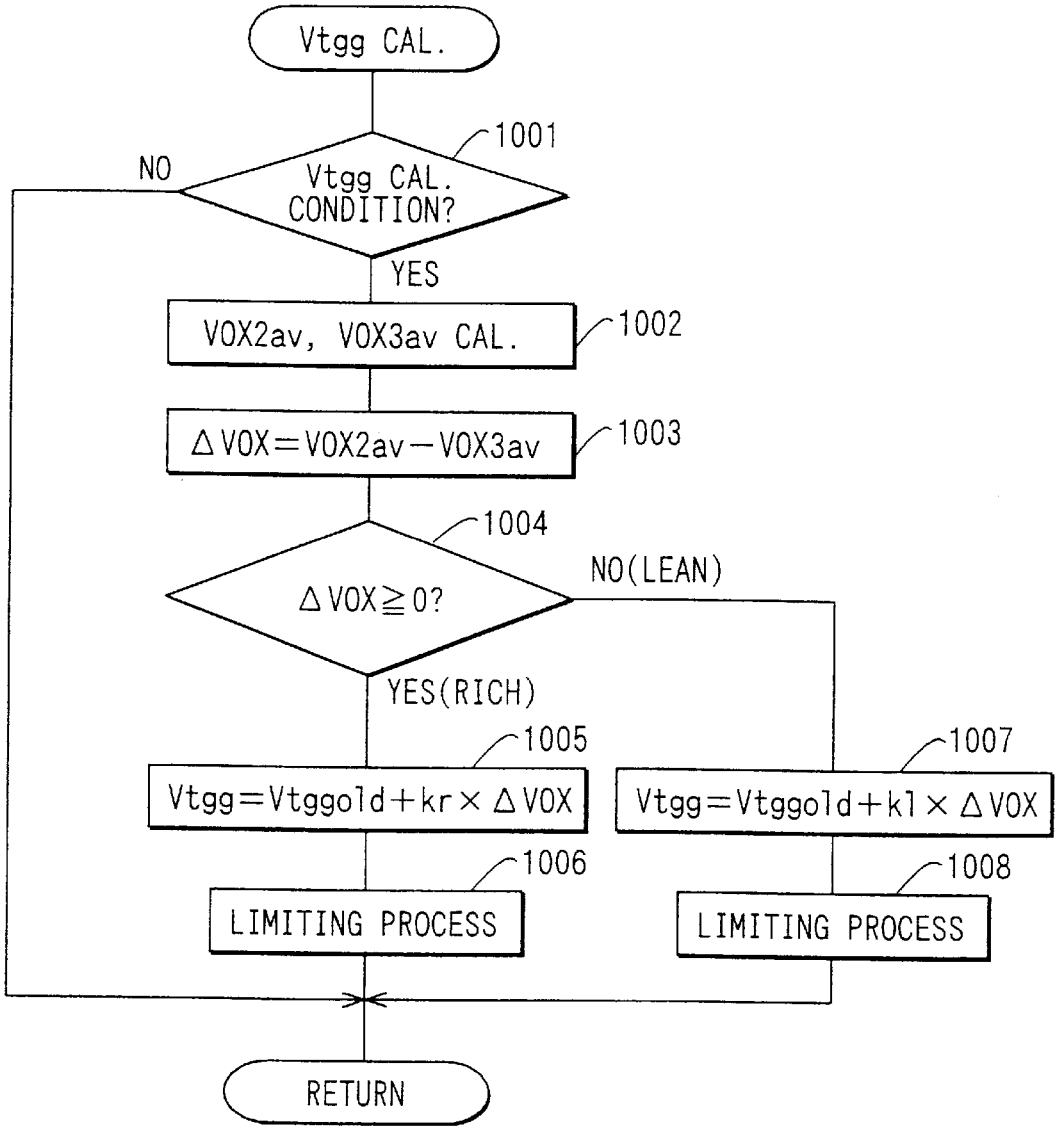
FIG. 22 is a flowchart showing a flow of a learning correction amount calculating program (fourth embodiment)

The processes of the learn correction amount calculating program in FIG. 22 executed in step 902 in FIG. 21 will be described. When the program is started, first, in step 1001, whether learn correction amount calculating conditions are satisfied or not is determined. The learn correction amount calculating conditions are, for example, the following conditions (1) and (2).

(1) The intake air volume is equal to or larger than a predetermined value.

(2) The second closed loop control is being executed.

Whether the intake air volume is equal to or larger than the predetermined value may be determined from an output of the air flow meter 14.

When even one of the two conditions (1) and (2) is not satisfied, the learn correction amount calculating conditions are not satisfied, and the program is finished without performing the subsequent learning process. The process of step 1001 corresponds to a learning inhibiting means in the present invention.

On the other hand, when both of the two conditions (1) and (2) are satisfied, the learning process instep 1002 and subsequent steps is executed as follows. First, in step 1002, the outputs VOX2 of the second sensor 25 and the outputs VOX3 of the third sensor 26 are separately subjected to an averaging process, thereby obtaining averaged values VOX2av and VOX3av. The averaging process may be performed by, for example, using a smoothing process (first-order lag process) or calculating an arithmetic mean of outputs in a predetermined time. In the case of using the smoothing process, it is sufficient to calculate the averaged values VOX2av and VOX3av by the following equations.

$$VOX2av=VOX2avold\times(k-1)/k+VOX2/k$$

$$VOX3av=VOX3avold\times(k-1)/k+VOX3/k$$

where, VOX2avold and VOX3avold denote VOX2av and VOX3av of last time, respectively, and k denotes a smoothing coefficient.

In the case of calculating the averaged values VOX2av and VOX3av by obtaining the arithmetic mean, it is sufficient to simply add up sensor outputs in a period of calculating the arithmetic mean, and divide an integrated value by the number of sampling times of the sensor outputs (the number of sensor outputs added).

After calculating the averaged values VOX2av and VOX3av, the program advances to step 1003 where a deviation ΔVOX between the averaged values VOX2av and VOX3av of the outputs of the second and third sensors 25 and 26 is calculated.

$$\Delta VOX=VOX2av-VOX3av$$

After that, in step 1004, whether the deviation ΔVOX is equal to or larger than zero is determined, thereby determining whether or not the averaged value VOX2av of the outputs of the second sensor 25 is on the richer side than the averaged value VOX3av of the outputs of the third sensor 26. When it is on the rich side (ΔVOX>0), the program advances to step 1005 where the learn correction value Vtgg on the rich side is calculated by the following equation.

$$Vtgg=Vtggold+kr\times\Delta VOX$$

where Vtggold denotes the learn correction amount Vtgg on the rich side of last time and kr denotes a learn ratio on the rich side for determining the degree of reflecting ΔVOX in the learn correction amount Vtggold on the rich side of last time.

After calculating the learn correction amount Vtgg on the rich side, the program advances to step 1006 where the learn correction amount Vtgg on the rich side is subjected to a limiting process with a limit value on the rich side (limit value on the positive side). Specifically, when the learn correction amount Vtgg on the rich side calculated in step 1005 is equal to or lower than the limit value on the rich side, the lean correction amount Vtgg on the rich side is used as it is. When the learn correction amount Vtgg on the rich side calculated in step 1005 is on the richer side than the limit value on the rich side, the learn correction amount Vtgg on the rich side is set to the limit value on the rich side.

On the other hand, when it is determined in step 1004 that ΔVOX is smaller than zero, that is, the averaged value VOX2av of the outputs of the second sensor 25 is on the leaner side than the averaged value VOX3av of the outputs of the third sensor 26, the program advances to step 1007 where the learn correction amount Vtg on the lean side is calculated by the following equation.

$$Vtgg=Vtggold+kl\times\Delta VOX$$

where, Vtggold denotes the learn correction amount Vtgg on the lean side of last time, and kl denotes a learn ratio on the lean side for determining the degree of reflecting ΔVOX in the learn correction amount Vtggold on the lean side of last time. The learn ratio kl on the lean side may be set to the same value as the learn ratio kr on the rich side but preferably set to a different value. The response of each of the sensors 25 and 26 in the case where the state changes from the rich side to the lean side is faster than that in the case where the state changes from the lean side to the rich side. Consequently, when the learn ratio kl on the lean side and the learn ratio kr on the rich side are set to proper values in accordance with the responses, the learning correction can be carried out under conditions adapted to each of the response on the lean side and the response on the rich side.

After calculating the learn correction amount Vtgg on the lean side, the program advances to step 1008 where the learn correction amount Vtgg on the lean side is subjected to a limiting process with the limit value on the lean side (limit value on the negative side). Specifically, when the learn correction amount Vtgg on the lean side calculated in step 1007 is equal to or lower than the limit value on the lean side, the learn correction amount Vtgg on the lean side is used as it is. When the learn correction amount Vtgg on the lean side calculated in step 1007 is on the leaner side than the limit value on the lean side, the learn correction amount Vtgg on the lean side is set to the limit value on the lean side.

Figure 23:
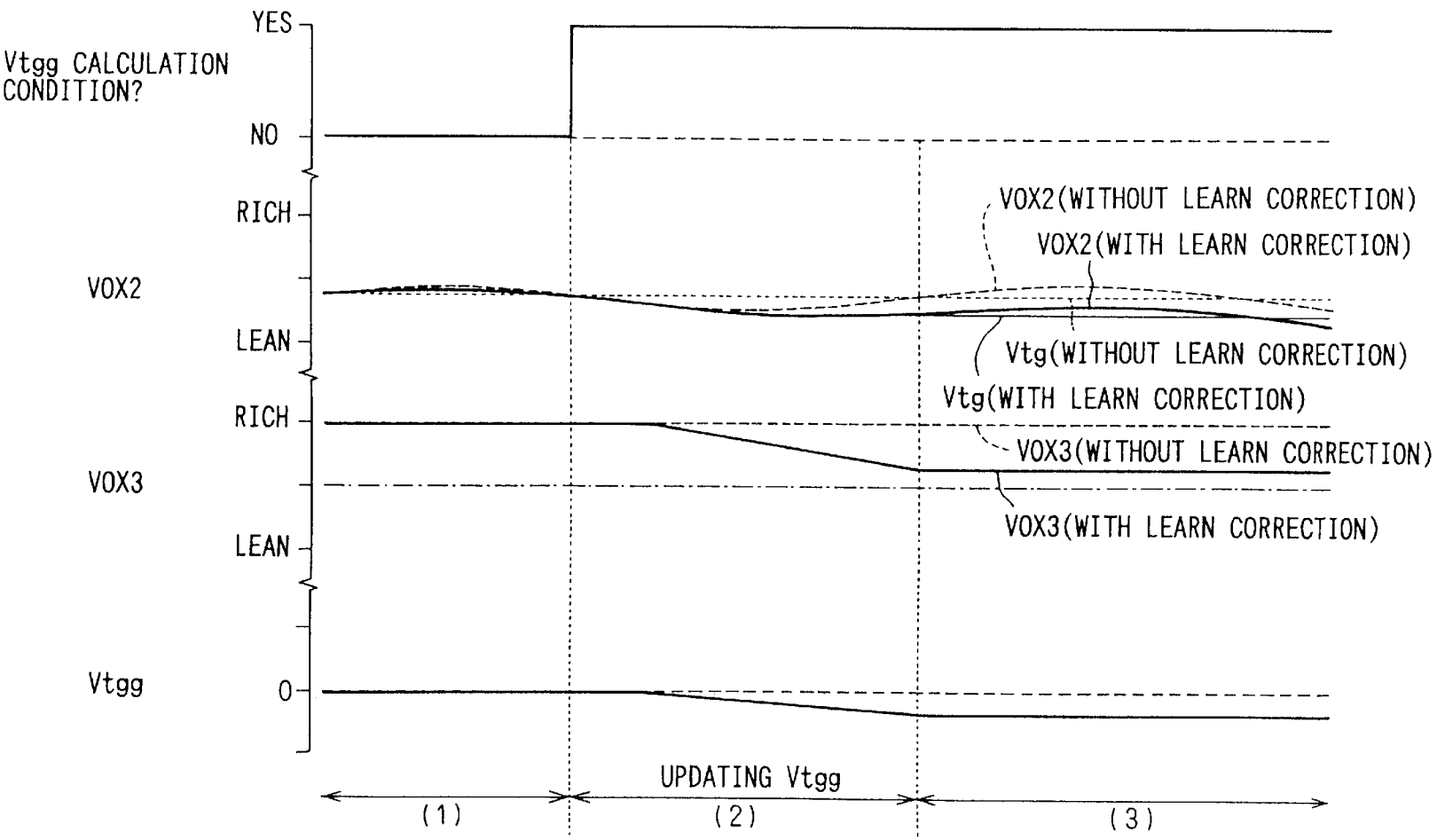
FIG. 23 is a time chart showing an example of an air-fuel ratio control (fourth embodiment)

An example of the air-fuel ratio Closed loop control with the learn correction function of the fourth embodiment will be described with reference to the time chart in FIG. 23. The time chart in FIG. 23 shows an example of the learning correction when the second sensor 25 upstream of the downstream catalyst 23 deteriorates and the output VOX2 of the second sensor 25 is deviated to the lean side with respect to the true value. In this case, even when the output VOX2 of the second sensor 25 is slightly on the lean side, in reality, it is in the rich state.

In a period (1) in FIG. 23, the learn correction amount calculating conditions are not satisfied, so that the learning correction is not performed. In the example, since the output VOX3 of the third sensor 26 is strongly on the rich side, the target output Vtg of the second sensor 25 is set to the lean side by the downstream-side second closed loop control. However, the output VOX2 of the second sensor 25 is deviated to the lean side with respect to the true value. Thus, even in a state where the air-fuel ratio on the upstream side of the downstream catalyst 23 is actually controlled to the target value Vtg, it is determined that the air-fuel ratio on the upstream side of the downstream catalyst 23 is on the lean side with respect to the target value Vtg. As a result, although it is unnecessary to control the air-fuel ratio to the rich side in reality, the air-fuel ratio is continuously controlled to the rich side, and the output VOX3 of the third sensor 26 sticks to the rich side.

After that, in a period (2) in FIG. 23, the learn correction amount calculating conditions are satisfied, and the learning correction of the target output Vtg of the second sensor 25 is executed. In the beginning of the learning operation, the deviation ΔVOX between the outputs of the second and third sensors 25 and 26 is a value on the negative side (lean side). Thus, the learn correction amount Vtgg is gradually corrected to the negative side (lean side), and the target output Vtg of the second sensor 25 is corrected to the lean side. Since the air-fuel ratio is controlled to the leaner side than before, the output VOX3 of the third sensor 26 gradually moves from the strong rich state to the weak rich state (or stoichiometric state).

After that, in a period (3) in FIG. 7, the control state of the air-fuel ratio is stabilized, the deviation ΔVOX between the outputs of the second and third sensors 25 and 26 decreases, and the learn correction amount Vtgg becomes almost constant. The learn correction amount Vtgg calculated in this state corresponds to a deviation to the lean side of the output VOX2 of the second sensor 25. By correcting the target output Vtg of the second sensor 25 with the learn correction amount Vtgg, a high-accuracy air-fuel ratio control in which a deviation in the output characteristic due to manufacture variations, deterioration with time, and the like of the second sensor 25 is compensated can be performed. Also in the case where the output characteristic of the third sensor 26 is deviated due to manufacture variations, deterioration with time, and the like of the third sensor 26, it can be similarly compensated by the learning correction.

On the contrary, when the learning correction is not performed, if the output characteristic of the sensor is deviated to the lean or rich side due to the manufacture variations, deterioration with time, and the like, the air-fuel ratio is controlled in the direction of correcting the deviation. As a result, the air-fuel ratio is always controlled to the lean or rich side of the target air-fuel ratio only by the amount of the deviation of the output characteristic of the sensor. Therefore, the exhaust gas reducing efficiency accordingly deteriorates.

In the example shown in FIG. 23, the output VOX2 of the second sensor 25 is deviated to the lean side. When the learning correction is not performed, although it is unnecessary to control the air-fuel ratio to the rich side in reality, the air-fuel ratio is continuously controlled to the rich side. As shown by broken line in FIG. 23, the output VOX3 of the third sensor 26 is controlled so as to stick to the rich side. When such a state continues, there is the possibility that the adsorption amount of the rich-side components such as HC, CO, and the like of the downstream catalyst 23 becomes saturated, and the exhaust amount of the rich-side components to the atmosphere increases.

In contrast, in the fourth embodiment, the target output Vtg of the second sensor 25 is subjected to the learning correction on the basis of the deviation ΔVOX between the outputs of the second. and third sensors 25 and 26. Thus, the high-precision air-fuel ratio control in which the deviation in the control system due to manufacture variations, deterioration with time, and the like of the sensor system is compensated can be performed. The exhaust gas reducing efficiency can be improved without being influenced by the manufacture variations, deterioration with time, and the like of the sensor system.

Moreover, in the fourth embodiment, outputs of each of the second and third sensors 25 and 26 are averaged, and the target output Vtg of the second sensor 25 is subjected to the learning correction on the basis of the deviation between the averaged values. Thus, erroneous learning correction due to noises occurring on the outputs of the sensors 25 and 26 and a temporary disturbance of the air-fuel ratio can be avoided. The stable learning correction which is not easily influenced by noises or a temporary disturbance of the air-fuel ratio can be performed.

Further, in the fourth embodiment, the learn correction amount on the rich side and that on the lean side are learned separately, so that the output characteristic on the rich side and that on the lean side can be separately learned, and the higher accuracy learning correction can be therefore achieved.

According to the fourth embodiment, in consideration that the responses of the sensors 25 and 26 vary according to the lean/rich state, the learn ratio kl on the lean side (update amount of the learn correction amount on the lean side) and the learn ratio kr on the rich side (update amount of the learn correction amount on the rich side) are set to different values in accordance with the responses. Thus, the learning correction can be performed under the conditions adapted to each of the response on the rich side and the response on the lean side. An updating speed (updating cycle) of the learn correction amount on the lean side and that on the rich side may be set to different values according to the responses.

When the intake air volume is small, the flow rate of the exhaust gases is low, and the efficiency of treating the exhaust gases in the upstream catalyst 22 increases. Thus, the gas components which are not reduced and enter the downstream catalyst 23 becomes smaller. Therefore, even when the air-fuel ratio on the upstream side of the downstream catalyst 23 (output of the second sensor 25) changes, response delay time until the change appears in the output of the third sensor 26 downstream of the downstream catalyst 23 becomes longer, and the learn accuracy is worsened due to this.

In consideration of this point, in the embodiment, the learning correction is inhibited when the intake air volume is smaller than a predetermined value, so that worseness in learn accuracy can be avoided.

(Fifth Embodiment)

A fifth embodiment will be described with reference to FIGS. 24–29. The configuration of a whole engine control system (see FIG. 1) is the same as in the first embodiment.

Outputs of the various sensors are input to an ECU 29. The ECU 29 is constructed mainly by a microcomputer. By executing each of programs which will be described hereinlater stored in a built-in ROM (storage medium), the air-fuel ratio is closed loop controlled on the basis of outputs of the first to third sensors 24–26.

During a normal air-fuel ratio Closed loop control, a downstream-side second closed loop control for setting a target output Vtg of the second sensor 25 upstream of the downstream catalyst 23 (target air-fuel ratio on the upstream side of the downstream catalyst 23) is performed on the basis of an output of the third sensor 26 downstream of the downstream catalyst 23. Subsequently, an upstream-side second closed loop control for setting a target output of the first sensor 24 upstream of the upstream catalyst 22 (target air-fuel ratio λTG on the upstream side of the upstream catalyst 22) is executed on the basis of a deviation between the output of the second sensor 25 upstream of the downstream catalyst 23 and the target output Vtg of the second sensor 25. On the basis of a deviation between the output of the first sensor 24 upstream of the upstream catalyst 22 and the target output (target air-fuel ratio λTG) of the first sensor 24, an air-fuel ratio correction factor FAF is calculated. The function of controlling the air-fuel ration in such a manner corresponds to air-fuel ratio closed loop control means in the present invention.

Further, the ECU 29 executes a rich-side control for temporarily setting the air-fuel ratio to the rich side after the fuel cut is finished. The ECU 29 changes the target air-fuel ratio λTG on the upstream side of the upstream catalyst 22 (target output of the first sensor 24) in accordance with the output of the second sensor 25 downstream of the upstream catalyst 22 during the rich-side control, thereby changing the degree of richness of the air-fuel ratio, and determines a timing of finishing the rich control on the basis of the output of the third sensor 26 downstream of the downstream catalyst 23. The function corresponds to rich-side control means in the present invention.

The processes of each of programs in FIGS. 24–28 for executing the controls will be described.

Figure 24:
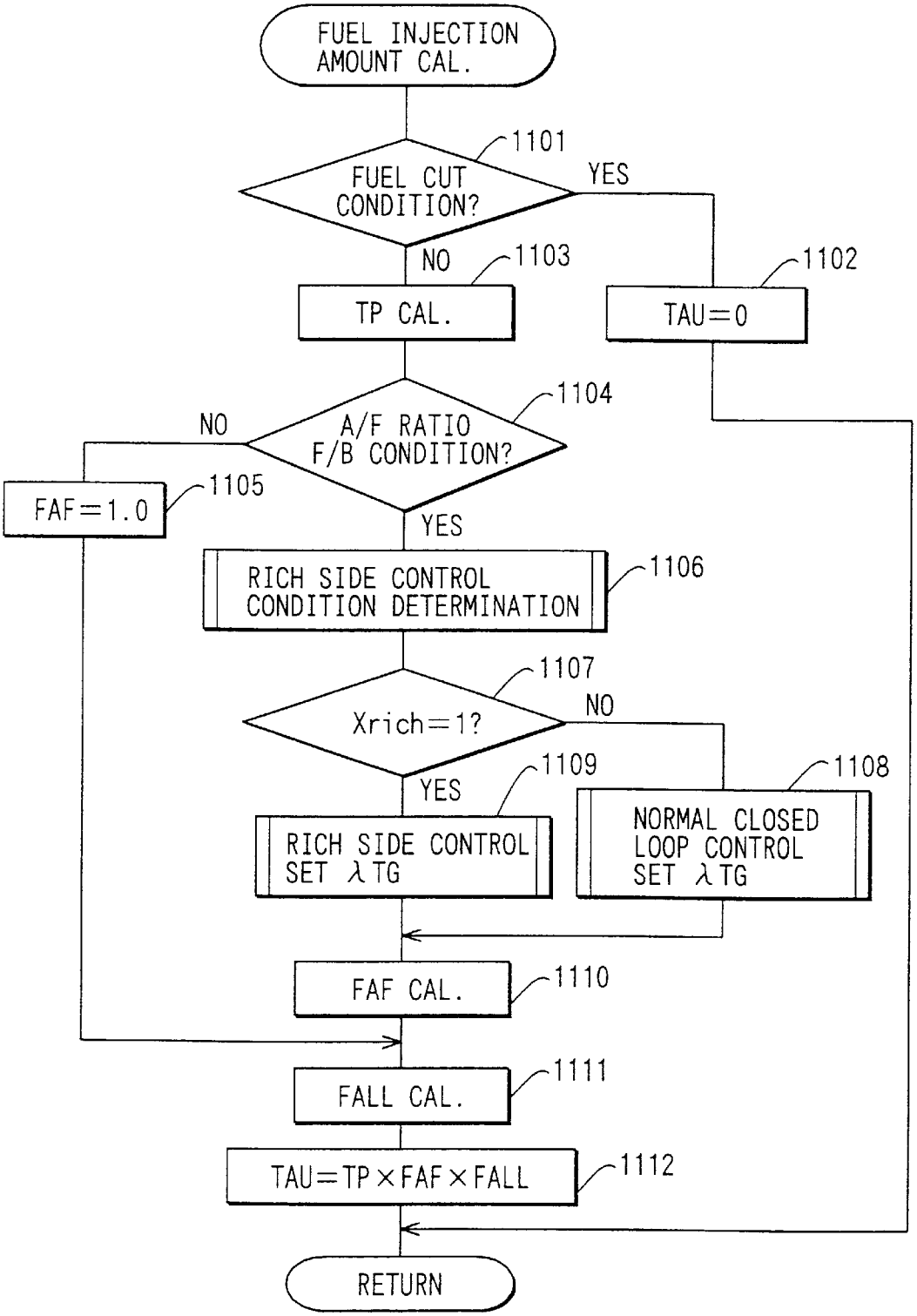
FIG. 24 is a flowchart showing a flow of a fuel injection amount calculating program (fifth embodiment)

A fuel injection amount calculating program in FIG. 24 sets a required fuel injection amount TAU via an air-fuel ratio Closed loop control and is executed every predetermined crank angle during engine operation. When the program is started, first, in step 1101, whether a fuel cut condition is satisfied or not is determined. The fuel cut condition is that, for example, an accelerator is not totally operated and engine speed is equal to or higher than a predetermined value (fuel cut at the time of deceleration), or the engine speed is in what is called a red zone or higher (fuel cut at the time of high speed). If the fuel cut condition is satisfied, the program advances to step 1102 where the required fuel injection amount TAU is set to zero to cut the fuel, and the program is finished.

On the other hand, when the fuel cut condition is not satisfied, in step 1103, a basic fuel injection amount TP is calculated from a map or the like on the basis of operating condition parameters such as current intake pipe pressure and engine speed. In step 1104, whether air-fuel ratio F/B conditions are satisfied or not is determined. The air-fuel ratio F/B conditions are such that an engine cooling water temperature is equal to or higher than a predetermined temperature, and the engine operating conditions are not in a high speed and heavy load area. When all of the conditions are satisfied, the air-fuel ratio F/B conditions are satisfied.

If the air-fuel ratio F/B conditions are not satisfied, the program advances to step 1105 where an air-fuel ratio correction factor FAF is set to "1.0", and advances to step 1111. In this case, the air-fuel ratio F/B correction is not made.

Figure 25:
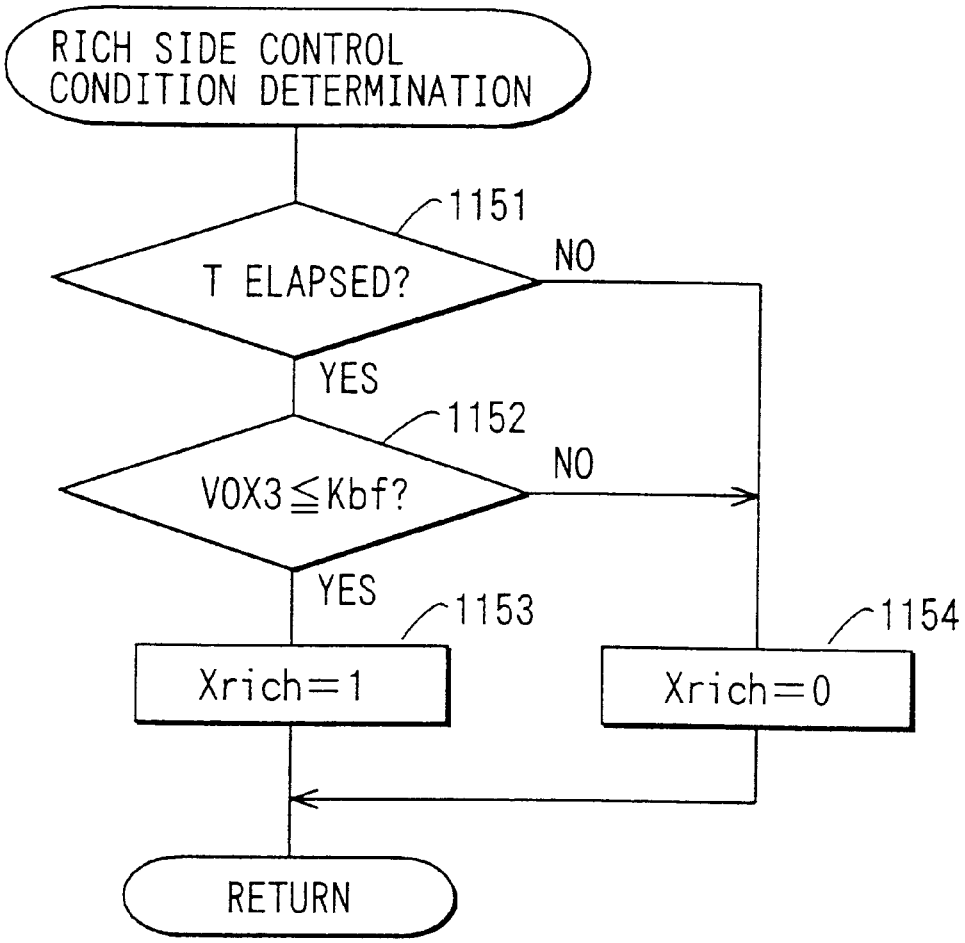
FIG. 25 is a flowchart showing a flow of a rich-side control execution condition determining program (fifth embodiment)
Figure 26:
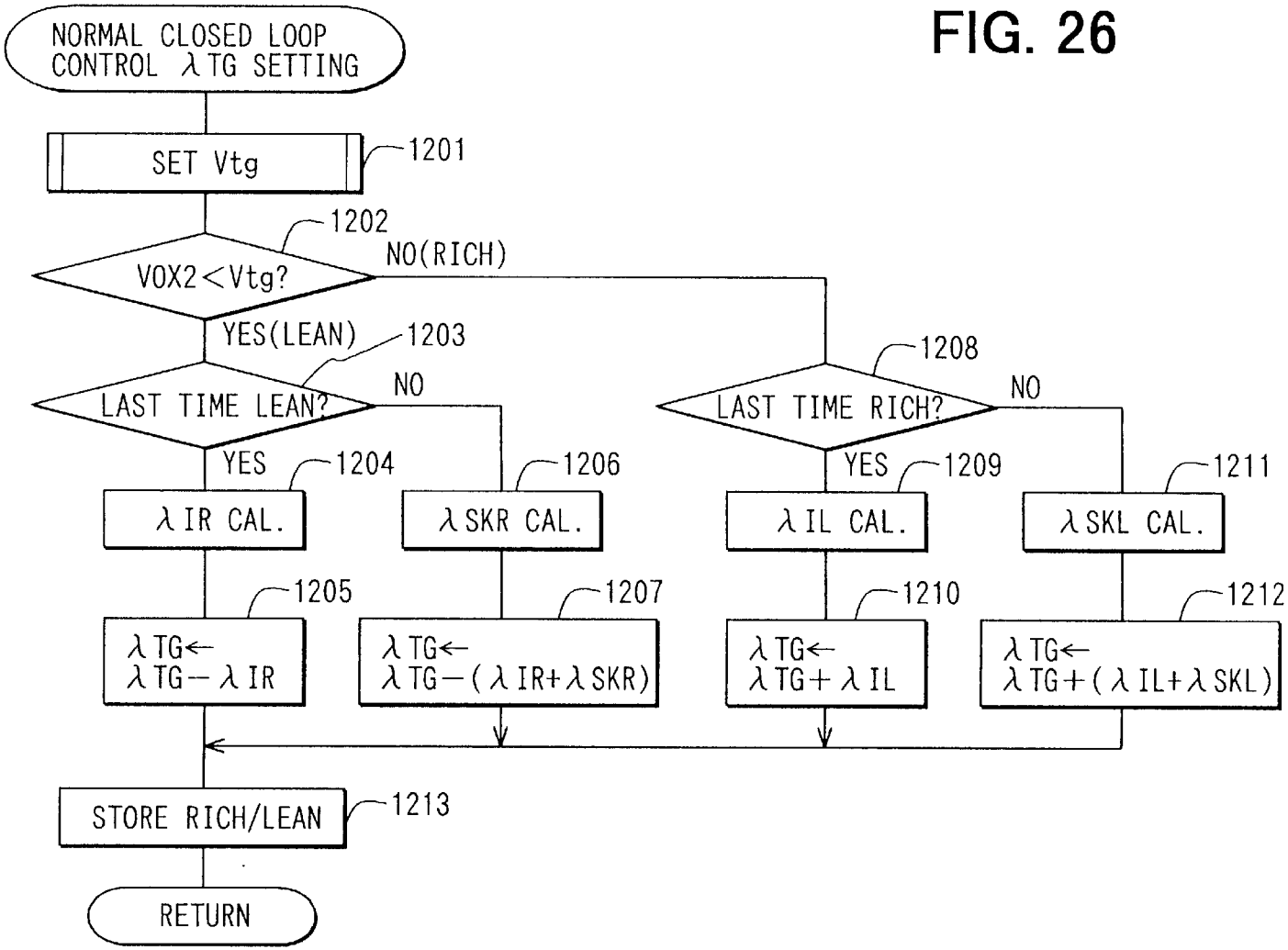
FIG. 26 is a flowchart showing a flow of a normal closed loop control target air-fuel ratio setting program (fifth embodiment)

On the other hand, when it is determined in step 1104 that the air-fuel ratio F/B conditions are satisfied, the program advances to step 1106. In step 1106, a rich-side control execution condition determining program in FIG. 25 which will be described hereinlater is executed to determine whether rich-side execution conditions after completion of the fuel cut are satisfied or not, and a rich-side control flag Xrich is set/reset. In step 1107, whether the rich-side control is being executed (rich-side control flag Xrich=1) or not is determined. As a result, when it is determined that the rich-side control (rich-side control flag Xrich=1) is not being performed, that is, when it is determined that a normal air-fuel ratio Closed loop control is being executed (rich-side control flag Xrich=0), the program advances to step 1108. In step 1108, a normal Closed loop control target air-fuel ratio setting program in FIG. 26 is executed to set the target air-fuel ratio λTG on the upstream side of the upstream catalyst 22. In step 1110, the air-fuel ratio correction factor FAF is calculated in accordance with a deviation between the output of the first sensor 24 upstream of the upstream catalyst 22 (air-fuel ratio of exhaust gases entering the upstream catalyst 22) and the target air-fuel ratio λTG.

Figure 28:
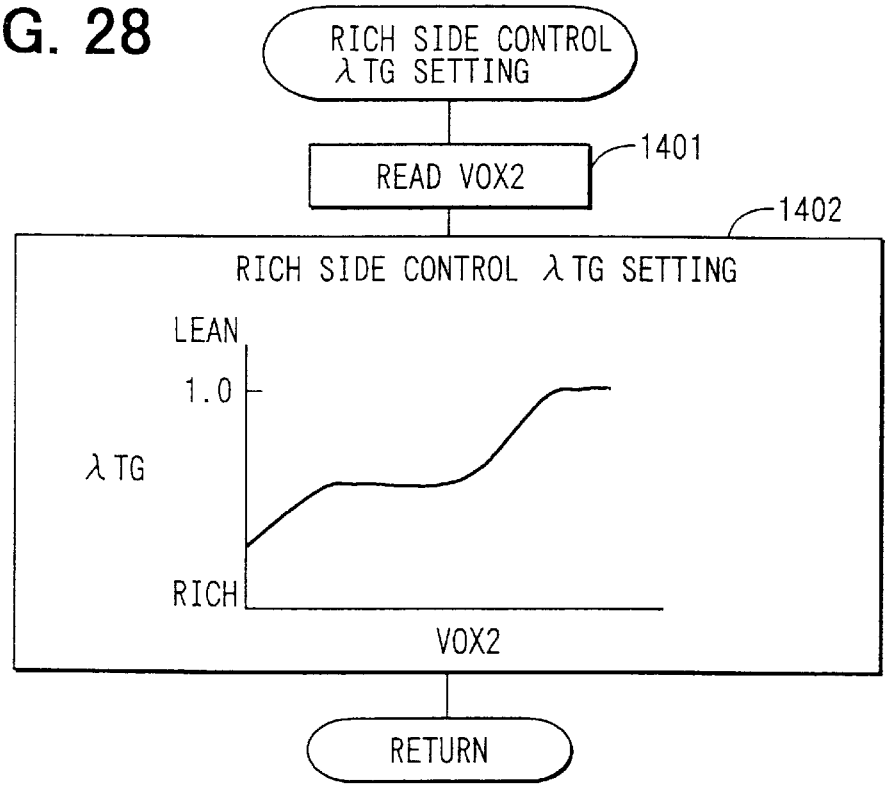
FIG. 28 is a flowchart showing a flow of a rich-side control target air-fuel ratio setting program (fifth embodiment)

On the other hand, when it is determined in step 1107 that the rich-side control is being executed (rich-side control flag Xrich=1), the program advances to step 1109 where a rich-side control target air-fuel ratio setting program in FIG. 28 is executed to set the target air-fuel ratio λTG on the upstream side of the upstream catalyst 22 to an air-fuel ratio which is set to the rich side in accordance with the output VOX2 of the second sensor 25 downstream of the upstream catalyst 22. In step 1110, according to the deviation between the output of the first sensor 24 upstream of the upstream catalyst 22 (air-fuel ratio of the exhaust gases entering the upstream catalyst 22) and the target air-fuel ratio λTG, the air-fuel ratio correction factor FAF is calculated.

In such a manner, after setting the air-fuel ratio correction factor FAF in step 1105 or 1110, in step 1111, various correction factors FALL other than the air-fuel ratio correction factor FAF (such as cooling water temperature correction factor, learn correction factor, and correction factor at the time of acceleration/deceleration) are calculated. After that, in step 1112, by using the basic fuel injection amount TP, air-fuel ratio correction factor FAF, and other various correction factors FALL, the required fuel injection amount TAU is calculated by the following equation, and the program is finished.

$$TAU=TP\times FAF\times FALL$$

The processes of the rich-side control execution condition determining program in FIG. 25 executed in step 1106 in the fuel injection amount calculating program of FIG. 24 will be described. When the program is started, in steps 1151 and 1152, whether both of the following two conditions (1) and (2) are satisfied or not is detected, thereby determining whether the rich-side execution conditions are satisfied or not.

(1) A predetermined time T has elapsed since the end of the fuel cut (step 1151).

(2) The output VOX3 of the third sensor 26 downstream of the downstream catalyst 23 is equal to or lower than a determination value Kbf and is on the lean side (step 1152).

Figure 29:
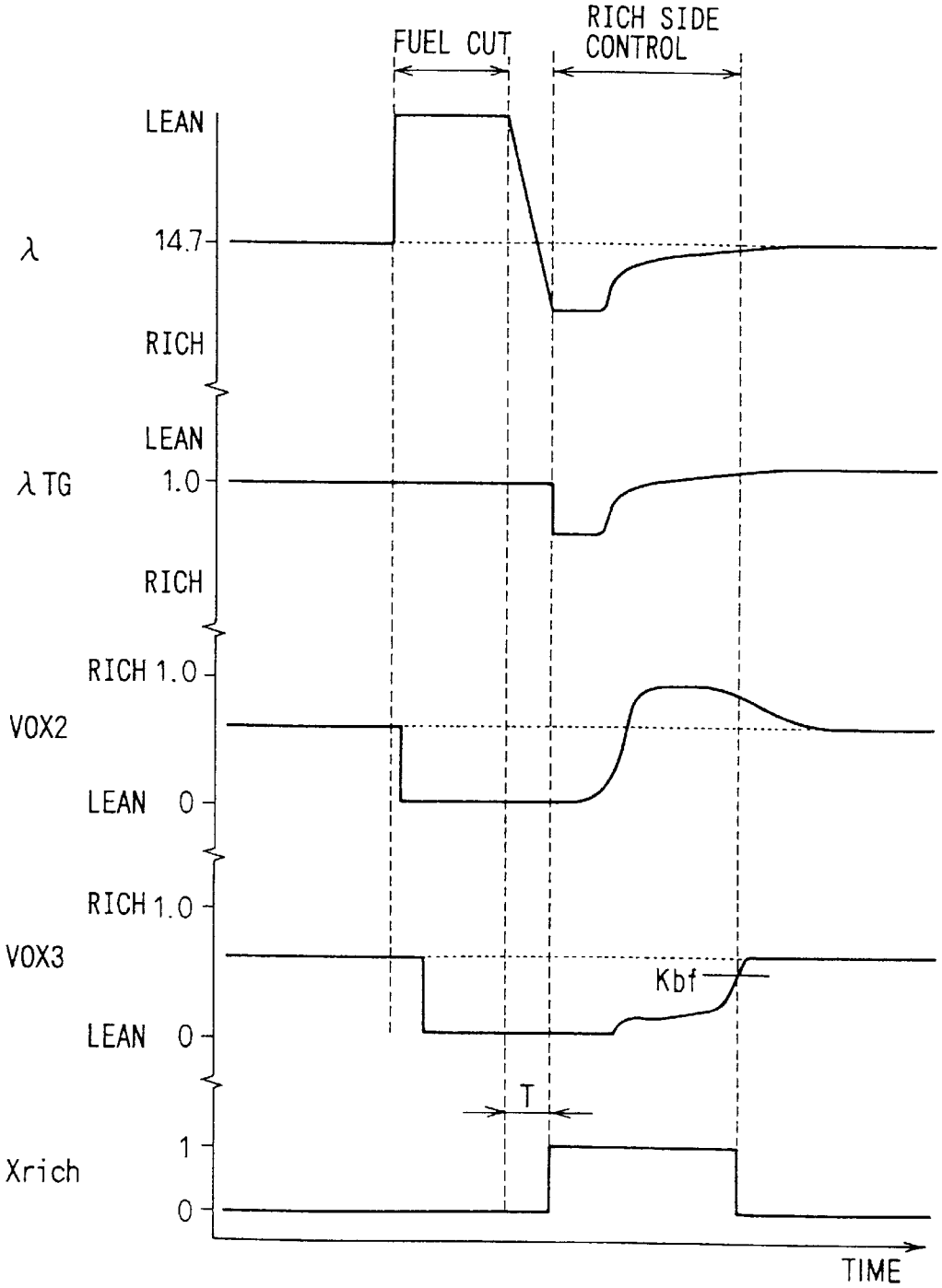
FIG. 29 is a time chart showing an example of an air-fuel ratio control (fifth embodiment).

The predetermined time T used in the determination of the condition (1) is set to a time corresponding to a response delay time since the fuel injection is restarted after the end of the fuel cut until the air-fuel ratio of the exhaust gases changes to the rich side (see FIG. 29). By the condition, the air-fuel ratio is prevented from being excessively corrected to the rich side at the start time of the rich-side control.

The determination value Kbf used in the determination of the condition (2) is set to a value around the stoichiometric ratio or a slightly lean-side value. Thus, when the air-fuel ratio on the downstream side of the downstream catalyst 23 is on the lean side of a predetermined value (stoichiometric ratio or a slightly lean-side value), the rich-side control is executed. When the air-fuel ratio on the downstream side of the downstream catalyst 23 becomes richer than the predetermined value, the rich-side control is finished and the program returns to the normal air-fuel ratio Closed loop control.

When both the two conditions (1) and (2) are satisfied, the rich-side control execution conditions are satisfied, and the program advances to step 1153 where the rich-side control flag Xrich is set to "1" indicating of rich-side control permission. On the other hand, when even one of the two conditions (1) and (2) is not satisfied, the rich-side control execution conditions are not satisfied. The program advances to step 1154 where the rich-side control flax Xrich is reset to "0" indicative of rich-side control inhibition.

The processes of a normal Closed loop control target air-fuel ratio setting program in FIG. 26 executed in step 1108 of the fuel injection amount calculating program in FIG. 24 will be described. The program is a program for setting the target output of the first sensor 24 upstream of the upstream catalyst 22 (target air-fuel ratio λTG on the upstream side of the upstream catalyst 22) during the normal air-fuel ratio Closed loop control.

Figure 27:
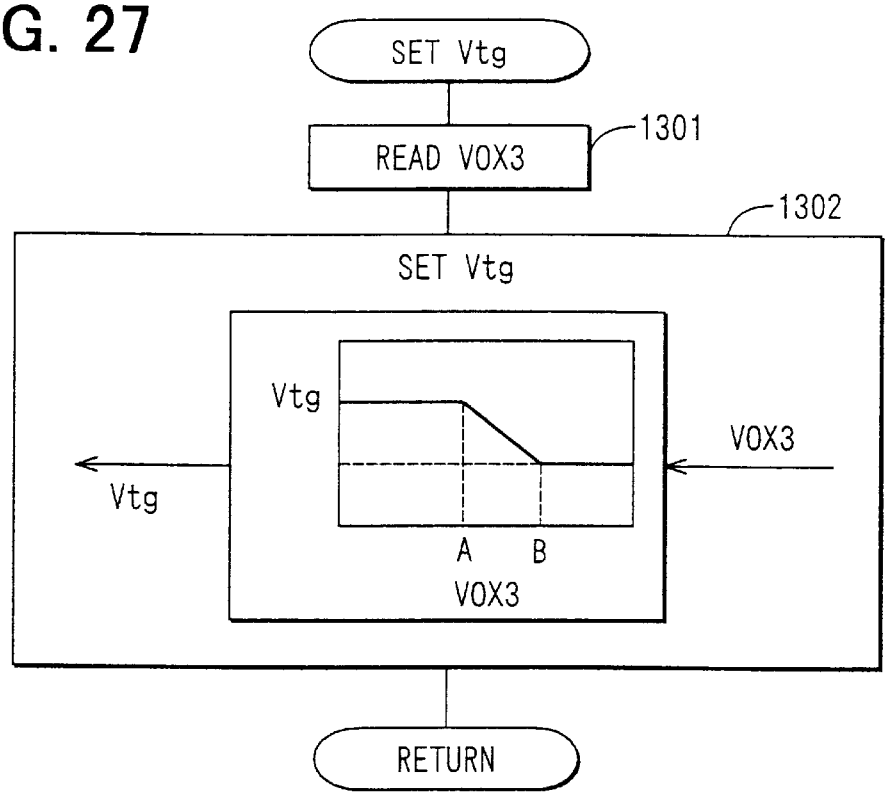
FIG. 27 is a flowchart showing a flow of a second sensor target voltage setting program (fifth embodiment)

When the program is started, first, in step 1201, a second sensor target voltage setting program in FIG. 27 is executed. According to the output voltage VOX3 of the third sensor 26 (air-fuel ratio on the downstream side of the downstream catalyst 23), the target voltage Vtg of the second sensor 25 is set from a map or the like. After that, the program advances to step 1202 where whether the state of the upstream catalyst 22 is lean or rich is determined by detecting whether the output voltage VOX2 of the second sensor 25 disposed downstream of the upstream catalyst 22 is lower than the target voltage Vtg or not. If the state is lean, in step 1203, whether the state was also lean last time or not is determined. If "Yes", in step 1204, an integral λIR to the rich side is calculated from a map or the like in accordance with the current intake air volume. It is set so that as the intake air volume increases, the integral λIR to the rich side decreases. After calculating the integral λIR to the rich side, the program advances to step 1205 where the target air-fuel ratio λTG is corrected to the rich side only by λIR, the rich/lean state at that time is stored (step 1213), and the program is finished.

When the state was rich last time and is changed to the lean side this time, the program advances to step 1206 where the skip amount λSKR to the rich side is calculated from a map or the like in accordance with the output of the third sensor 26 (adsorption state of the downstream catalyst 23). By the operation, it is set so that as the lean-side component adsorption amount of the downstream catalyst 23 increases, the skip amount λSKR to the rich side increases. After calculating the skip amount λSKR to the rich side, in step 1207, the target air-fuel ratio λTG is corrected to the rich side only by λIR+λSKR, the rich/lean state at that time is stored (step 1213), and the program is finished.

On the other hand, when it is determined in step 1202 that the output voltage VOX2 of the second sensor 25 is higher than the target voltage Vtg (state of the upstream catalyst 22 is rich), the program advances to step 1208 where whether the state was rich also last time or not is determined. If "Yes,", the program advances to step 1209 where the integral λIL to the lean side is calculated from a map or the like in accordance with a current intake air volume. At this time, it is set so that as the intake air volume increases, the integral λIL to the lean side decreases. After calculating the integral λIL to the lean side, the program advances to step 1210 where the target air-fuel ratio λTG is corrected to the lean side only by the integral λIL, the rich/lean state at that time is stored (step 1213), and the program is finished.

When the state was lean last time and is changed to the rich side this time, the program advances to step 1211 where a skip amount λSKL to the lean side is calculated from a map or the like in accordance with the output of the third sensor 26 (adsorption state of the downstream catalyst 23). By the operation, the skip amount λSKL to the lean side is set so as to increase as the rich-side component adsorption amount of the downstream catalyst 23 increases. After that, the program advances to step 1212 where the target air-fuel ratio λTG is corrected to the lean side only by λIL+λSKL, the rich/lean state at that time is stored (step 1213), and the program is finished.

The processes of a second sensor target voltage setting program in FIG. 27 executed in step 1201 in the normal Closed loop control target air-fuel ratio setting program in FIG. 26 will be described. When the program is started, first, in step 1301, the output voltage VOX3 of the third sensor 26 downstream of the downstream catalyst 23 is read. In step 1302, a target voltage Vtg of the second sensor 25 is set from a map or the like in accordance with the output voltage VOX3 of the third sensor 26. The map characteristics of the target voltage Vtg are as follows. In an area where the output voltage VOX3 of the third sensor 26 is in a predetermined range (A<VOX3<B), the higher the output voltage VOX3 of the third sensor 26 becomes, the lower the target voltage Vtg of the second sensor 25 becomes. In an area where the output voltage VOX3 of the third sensor 26 is equal to or lower than the predetermined value A, the target voltage Vtg of the second sensor 25 is constant at the upper limit value. In an area where the output voltage VOX3 of the third sensor 26 is equal to or higher than the predetermined value B, the target voltage Vtg of the second sensor 25 reaches the lower limit value and becomes constant.

By the operation, the target voltage Vtg of the second sensor 25 is set so that one of the states of the upstream catalyst 22 and the downstream catalyst 23 becomes rich, and the state of the other catalyst becomes lean. As a result, the components on the rich side and the components on the lean side in the exhaust gases can be efficiently reduced by effectively using both the upstream and downstream catalysts 22 and 23. Thus, the improved exhaust gas reducing efficiency can be achieved.

The processes of the rich-side control target air-fuel ratio setting program in FIG. 28 which is executed in step 1106 of the fuel injection amount calculating program in FIG. 24 will be described. The program is a program for setting the target air-fuel ratio λTG on the upstream side of the upstream catalyst 22 to an air-fuel ratio which is set to the rich side in accordance with the output VOX2 of the second sensor 25 downstream of the upstream catalyst 22 during the rich-side control after completion of the fuel cut.

When the program is started, first, in step 1401, the output VOX2 of the second sensor 25 downstream of the upstream catalyst 22 is read. In step 1402, the target air-fuel ratio λTG on the upstream side of the upstream catalyst 22 (target output of the first sensor 24) is set by a map or the like in accordance with the output VOX2 of the second sensor 25. The map characteristics of the target air-fuel ratio λTG are set so that the lower (the leaner) the output VOX2 of the second sensor 25 (air-fuel ratio on the downstream side of the upstream catalyst 22) becomes, the higher the richness degree of the target air-fuel ratio λTG becomes.

Although the target air-fuel ratio λTG is directly set in accordance with the output VOX2 of the second sensor 25 in step 1402, it is also possible to set a correction amount to the rich side (correction factor to the rich side) in accordance with the output VOX2 of the second sensor 25 and correct the normal target air-fuel ratio to the rich side by the correction amount to the rich side (correction factor to the rich side).

The characteristics of the air-fuel ratio control of the fifth embodiment will be described by using the time chart of FIG. 29. The time chart in FIG. 29 shows an example of the air-fuel ratio control when the fuel cut is executed. Since oxygen in the air taken into the cylinders of the engine 11 is not burnt but is exhausted as it is to the exhaust pipe 21 during the fuel cut, the amount of the components on the lean side (oxygen) in the exhaust gases entering the catalysts 22 and 23 largely increases. Thus, the lean-side component adsorption amount (oxygen adsorption amount) in the catalysts 22 and 23 largely increases, the outputs VOX2 and VOX3 of the sensors 25 and 26 downstream of the catalysts 22 and 23, respectively, decrease, and the outputs become on the lean side.

After that, when the fuel cut is finished and the fuel injection is re-started, the air-fuel ratio λ of the exhaust gases rapidly changes from lean to rich. At a time point after elapse of the predetermined time T corresponding to the response delay time since the end of the fuel cut until the air-fuel ratio λ of the exhaust gases changes to rich, the rich-side control flag Xrich is set to "1" indicative of the rich-side control permission, and the rich-side control is started. During the rich-side control, by changing the target air-fuel ratio λTG (target output of the first sensor 24) on the upstream side of the upstream catalyst 22 in accordance with the output VOX2 of the second sensor 25 downstream of the upstream catalyst 22 (air-fuel ratio on the downstream side of the upstream catalyst 22), the degree of richness in the air-fuel ratio λ is changed. Specifically, it is set so that as the output VOX2 of the second sensor 25 decreases (becomes leaner), the degree of richness of the target air-fuel ratio λTG becomes higher.

In the beginning of the rich-side control, the lean-side component adsorption amount of each of the catalysts 22 and 23 is the largest. After that, as the lean-side components adsorbed by each of the catalysts 22 and 23 react with the rich-side components (HC, CO, and the like) in the exhaust gases and the lean-side component adsorption amount of each of the catalysts 22 and 23 decreases, the output VOX2 of the second sensor 25 downstream of the upstream catalyst 22 increases (the degree of leanness decreases). It is set so that as the output VOX2 of the second sensor 25 increases, the degree of richness of the target air-fuel ratio λTG decreases.

Since the rich-side components in the exhaust gases exhausted from the engine 11 react with the adsorbed lean-side components as the exhaust gases pass from the upstream portion of the upstream catalyst 22 to the downstream during the rich-side control, the rich-side components in the exhaust gases become smaller with distance from the upstream side. Thus, the lean-side component adsorption amount of the upstream catalyst 22 decreases first and, with a little delay, the lean-side component adsorption amount of the downstream catalyst 23 decreases. In association with the decrease, the output VOX3 of the third sensor 26 downstream of the downstream catalyst 23 (air-fuel ratio on the downstream side of the downstream catalyst 23) changes from a strong lean zone to a weak lean zone.

After that, when the output VOX3 of the third sensor 26 (air-fuel ratio on the downstream side of the downstream catalyst 23) becomes richer than the determination value Kbf (stoichiometric ratio or a weak lean value), the rich control flag Xrich is reset to "0" indicative of the end of the rich-side control. By the operation, the rich-side control is finished and the program returns to the normal air-fuel ratio Closed loop control.

The lean-side components in the exhaust gases exhausted from engine 11 are adsorbed as the exhaust gases sequentially pass from the upstream side of the upstream catalyst 22 to the downstream area and the lean-side components in the exhaust gases decrease with distance from the upstream side. There is consequently a tendency that the lean-side component adsorption amount of the upstream catalyst 22 is larger than that of the downstream catalyst 23.

In consideration of this point, in the fifth embodiment, the degree of richness of the air-fuel ratio (target air-fuel ratio λTG) is changed according to the output of the second sensor 25 which changes according to the lean-side component adsorption amount of the catalyst of which lean-side component adsorption amount is larger (upstream catalyst 22) during the rich-side control Therefore, the lean-side component adsorption amount of the upstream catalyst 22 having the larger lean-side component adsorption amount can be reduced quickly, and the downstream catalyst 23 can be also recovered from a lean state as the upstream catalyst 22 recovers. Moreover, the timing of finishing the rich-side control is determined on the basis of the output of the third sensor 26 downstream of the downstream catalyst 23, so that the rich-side control can be executed sufficiently until the adsorption state of the two catalysts 22 and 23 recovers from the lean state to the stoichiometric state. By such a control, the lean-side component adsorption amount of the two catalysts 22 and 23 can be quickly reduced after the fuel cut is finished, and the exhaust gas reducing efficiency can be improved.

The present invention is not limited to the above-described embodiment. For example, setting may be made on the basis of outputs of both the second and third sensors 25 and 26 during the rich-side control after the fuel cut is finished. For example, the degree of richness in the air-fuel ratio (target air-fuel ratio λTG) set according to the output of the second sensor 25 may be corrected according to the output of the third sensor 26 during the rich-side control, or the degree of richness of the air-fuel ratio (target air-fuel ratio λTG) may be set according to an average value of outputs of both the second and third sensors 25 and 26.

Alternately, the sensor used for the rich-side control may be switched according to the operating conditions of the engine 11. For example, when a fuel cut time is short, the lean-side component adsorption amount of only the upstream catalyst 22 becomes large, and the lean-side component adsorption amount of the downstream catalyst 23 is not so large, the degree of richness of the air-fuel ratio (target air-fuel ratio λTG) may be changed according to only the output of the second sensor which changes according to the lean-side component adsorption amount of the upstream catalyst 22. When the fuel cut time is long and both the lean-side component adsorption amount of the upstream catalyst 22 and that of the downstream catalyst 23 become large, the degree of richness of the air-fuel ratio (target air-fuel ratio λTG) may be changed according to only the output of the third sensor 26 which changes according to the lean-side component adsorption amount of the downstream catalyst 23.

When the intake air volume is small (flow rate of the exhaust gases is low) like in an idle state, the degree that the rich-side components in the exhaust gases are consumed by the upstream catalyst 22 during the rich-side control increases and the amount of the rich-side components entering the downstream catalyst 23 decreases. Thus, the degree of richness of the air-fuel ratio (target air-fuel ratio λTG) may be changed according to only the output of the second sensor 25 which changes according to the lean-side component adsorption amount of the upstream catalyst 22. When the intake air volume is large (flow rate of the exhaust gas is high) like in a heavy load operation state, the amount of the rich-side components passing through the upstream catalyst 22 and entering the downstream catalyst 23 during the rich-side control increases. Therefore, the degree of richness of the air-fuel ratio (target air-fuel ratio λTG) may be changed according to only the output of the third sensor 26 which changes according to the lean-side component adsorption amount of the downstream catalyst 23. In any of the cases, the lean-side component adsorption amount of the catalysts 22 and 23 can be quickly reduced, and the exhaust gas reducing efficiency can be improved.

Although the rich-side control is performed after completion of the fuel cut in the fifth embodiment, when it is estimated that the lean-side component adsorption amount of the upstream catalyst 22 and/or the downstream catalyst 23 is equal to or larger than a predetermined value during the normal air-fuel ratio Closed loop control, the rich-side control may be executed to promptly reduce the lean-side component adsorption amount of the catalysts 22 and 23.

In the fifth embodiment, in the normal air-fuel ratio Closed loop control, the target voltage Vtg of the second sensor 25 is set according to the output voltage VOX3 of the third sensor 26 (air-fuel ratio on the downstream side of the downstream catalyst 23). By detecting whether the output voltage VOX2 of the second sensor 25 is higher than the target voltage Vtg or not, the rich/lean state of the upstream catalyst 22 is determined, and the target air-fuel ratio λTG is set. However, the method of setting the target air-fuel ratio λTG may be variously changed. For example, it is also possible to select one of the second and third sensors 25 and 26 in accordance with the engine operating conditions, states of the catalysts, and the like, and set the target air-fuel ratio λTG on the basis of an output of the selected sensor.

What is claimed is:

1. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

an upstream catalyst state detector for detecting or estimating a state of said upstream catalyst;

a downstream catalyst state detector for detecting or estimating a state of said downstream catalyst; and an air-fuel ratio controller for controlling an air-fuel ratio so that one of the states of said upstream and downstream catalysts is rich and the other of the states of said upstream and downstream catalysts is lean;

wherein at a time of controlling the state of said upstream catalyst to rich or lean in accordance with the state of said downstream catalyst, the air-fuel ratio controller limits a degree of rich/lean of said upstream catalyst to be within a predetermined range so that catalytic conversion efficiency of said upstream catalyst is more than a predetermined value.

2. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of exhaust gases flowing into said upstream catalyst;

a second sensor for detecting an air-fuel ratio or a rich/lean state of the exhaust gases flowing from said upstream catalyst;

a third sensor for detecting an air-fuel ratio or a rich/lean state of the exhaust gases flowing from said downstream catalyst;

an air-fuel ratio closed loop controller for setting a target air-fuel ratio based on at least one of an output of said second sensor and an output of said third sensor, and closed loop controlling an air-fuel ratio based on a deviation between the target air-fuel ratio and an output of said first sensor; and a target air-fuel ratio limiter for limiting the target air-fuel ratio in a predetermined control range, wherein said target air-fuel ratio limiter shifts the control range based on an output of said second sensor and an output of said third sensor.

3. An exhaust emission control system according to claim 2, wherein at a time of shifting the control range, said target air-fuel ratio limiter sets a change value in accordance with at least one of the output of said second sensor and the output of the third sensor.

4. An exhaust emission control system according to claim 2, further comprising a control gain changer for changing a control gain of a second closed loop control for setting the target air-fuel ratio based on the output of said second sensor and the output of said third sensor.

5. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of exhaust gases flowing into said upstream catalyst;

a second sensor for detecting an air-fuel ratio or a rich/lean state of the exhaust gases flowing from said upstream catalyst;

a third sensor for detecting an air-fuel ratio or a rich/lean state of the exhaust gases flowing from said downstream catalyst;

an air-fuel ratio closed loop controller for setting a target air-fuel ratio based on at least one of an output of said second sensor and an output of said third sensor, and closed loop controlling an air-fuel ratio based on a deviation between the target air-fuel ratio and an output of said first sensor; and a target air-fuel ratio limiter for limiting the target air-fuel ratio in a predetermined control range, wherein said target air-fuel ratio limiter shifts the control range based on an output of said second sensor and an output of said third sensor;

said target air-fuel ratio limiter changes at least a rich-side limit value of the control range to a limit value having a lower degree of richness when both of the outputs of said second and third sensors are rich, and the target air-fuel ratio limiter changes at least a lean-side limit value of the control range to a limit value having a lower degree of leanness when both of the outputs of said second and third sensors are lean.

6. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of exhaust gases flowing into said upstream catalyst;

a second sensor for detecting an air-fuel ratio or a rich/lean state of the exhaust gases flowing from said upstream catalyst;

a third sensor for detecting an air-fuel ratio or a rich/lean state of the exhaust gases flowing from said downstream catalyst;

an air-fuel ratio closed loop controller for setting a target air-fuel ratio based on at least one of an output of said second sensor and an output of said third sensor, and closed loop controlling the air-fuel ratio based on a deviation between the target air-fuel ratio and the output of said first sensor; and a control gain changer for changing a control gain of a second closed loop control for setting the target air-fuel ratio based on the outputs of said second and third sensors.

7. An exhaust emission control system according to claim 6, wherein at a time of changing the control gain, said control gain changer sets a change value in accordance with at least one of the output of said second sensor and the output of said third sensor.

8. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor;

a sensor diagnosing means for determining whether an output of said third sensor is normal or not; and a fail-safe means, when it is determined by said sensor diagnosing means that the output of said third sensor is not normal, for inhibiting an operation of said downstream-side second closed loop controller and setting the target output of said second sensor to a learn value or a predetermined set value;

wherein even in a case where said third sensor is not abnormal, if a temperature of said third sensor has not increased to an active state, said sensor diagnosing means determines that the output of said third sensor is not normal.

9. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor;

a sensor diagnosing means for determining whether an output of said third sensor is normal or not; and a fail-safe means, when it is determined by said sensor diagnosing means that the output of said third sensor is not normal, for inhibiting an operation of said downstream-side second closed loop controller and setting the target output of said second sensor to a learn value or a predetermined set value;

wherein when it is determined by said sensor diagnosing means that the output of said third sensor is not normal, said fail-safe means lowers at least one of a control gain and a control range of a second closed loop control for setting the target output of said first sensor as compared with those in a normal state.

10. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of the second sensor;

an air-fuel ratio closed loop controller for closed loop controlling an air-fuel ratio based on a deviation between an output of said first sensor and the target output of said first sensor;

a sensor diagnosing means for determining whether the output of said second sensor is normal or not; and a fail-safe means, when it is determined by said sensor diagnosing means that the output of said second sensor is not normal, for inhibiting operations of both said upstream-side and downstream-side second closed loop controller and setting the target output of said first sensor based on an output of said third sensor;

wherein even in a case where said second sensor is not abnormal, if a temperature of said second sensor has not increased to an active state, said sensor diagnosing means determines that the output of said second sensor is not normal.

11. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of the second sensor;

an air-fuel ratio closed loop controller for closed loop controlling an air-fuel ratio based on a deviation between an output of said first sensor and the target output of said first sensor;

a sensor diagnosing means for determining whether the output of said second sensor is normal or not; and a fail-safe means, when it is determined by said sensor diagnosing means that the output of said second sensor is not normal, for inhibiting operations of both said upstream-side and downstream-side second closed loop controller and setting the target output of said first sensor based on an output of said third sensor;

wherein when it is determined by said sensor diagnosing means that the output of said second sensor is not normal, said fail-safe means lowers at least one of a control gain and a control range of a second closed loop control for setting the target output of said first sensor as compared with those in a normal state.

12. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor; and a learning means for learn-correcting the target output of said second sensor based on a deviation between the output of said second sensor and the output of said third sensor.

13. An exhaust emission control system according to claim 12, wherein said learning means compensates deviation of the output characteristics of the second and third sensors due to at least one of manufacture variations and deterioration with time.

14. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor; and a learning means for learn-correcting the target output of said second sensor based on a deviation between the output of said second sensor and the output of said third sensor;

wherein said learning means averages the output of said second sensor and the output of said third sensor respectively, and said learning means learn-corrects the target output of said second sensor based on a deviation between an averaged value of the outputs of said second sensor and an averaged value of the outputs of said third sensor.

15. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor; and a learning means for learn-correcting the target output of said second sensor based on a deviation between the output of said second sensor and the output of said third sensor;

wherein said leaning means learns a learn correction amount on a rich side and a learn correction amount on a lean side, independently.

16. An exhaust emission control system according to claim 15, wherein said learning means makes at least one of an updating speed and an updating amount of the learn correction amount on the rich side different from at least one of an updating speed and an updating amount of the learn correction amount on the lean side.

17. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor; and a learning means for learn-correcting the target output of said second sensor based on a deviation between the output of said second sensor and the output of said third sensor;

wherein said learning means limits the learn correction amount to be within a predetermined range.

18. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

a downstream-side second closed loop controller for setting a target output of said second sensor based on an output of said third sensor;

an upstream-side second closed loop controller for setting a target output of said first sensor based on a deviation between an output of said second sensor and the target output of said second sensor;

an air-fuel ratio closed loop controller for closed loop controlling an air-fuel ratio based on a deviation between an output of said first sensor and the target output of said first sensor; and a learning means for learn-correcting the target output of said second sensor based on a deviation between the output of said second sensor and the output of said third sensor; a learning inhibiting means for inhibiting learning correction by said learning means when an intake air volume is smaller than a predetermined value.

19. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

a first sensor for detecting an air-fuel ratio or a rich/lean state of an exhaust gas flowing into said upstream catalyst;

a second sensor for detecting an air-fuel ratio or a rich/lean state of the exhaust gas flowing from said upstream catalyst;

a third sensor for detecting an air-fuel ratio or a rich/lean state of the exhaust gas flowing from said downstream catalyst;

an air-fuel ratio closed loop controlling means for setting a target air-fuel ratio based on at least one of an output of said second sensor and an output of said third sensor, and closed loop controlling an air-fuel ratio based on a deviation between the target air-fuel ratio and an output of said first sensor; and a rich-side control means for performing a rich-side control for setting the air-fuel ratio temporarily to a rich side when it is estimated that a lean-side component adsorption amount at least one of said upstream catalyst and said downstream catalyst is more than a predetermined amount, wherein said rich-side control means changes a degree of richness in the air-fuel ratio based on at least one of an output of said second sensor and an output of said third sensor during the rich-side control.

20. An exhaust emission control system according to claim 19, wherein said rich-side control means changes the degree of richness in the air-fuel ratio in accordance with the output of said second sensor and determines a timing of finishing the rich-side control based on the output of said third sensor.

21. An exhaust emission control system according to claim 19, wherein said rich-side control means switches a sensor to be used for the rich-side control in accordance with operating conditions of said internal combustion engine.

22. An exhaust emission control system for an internal combustion engine, comprising:

an upstream catalyst disposed in an exhaust passage;

a downstream catalyst disposed in said exhaust passage, said downstream catalyst disposed at a downstream of and in series with said upstream catalyst;

an upstream catalyst state detecting means for detecting or estimating a state of said upstream catalyst;

a downstream catalyst state detecting means for detecting or estimating a state of said downstream catalyst; and an air-fuel ratio controlling means for controlling an air-fuel ratio, wherein when the state of said downstream catalyst is richer than an air-fuel ratio where a catalytic conversion efficiency of said downstream catalyst is maximum, said air-fuel ratio controlling means controls the air-fuel ratio such that the state of said upstream catalyst is leaner than an air-fuel ratio where a catalytic conversion efficiency of said upstream catalyst is maximum, and when the state of said downstream catalyst is leaner than the air-fuel ratio where the catalytic conversion efficiency of said downstream catalyst is maximum, said air-fuel ratio controlling means controls the air-fuel ratio such that the state of said upstream catalyst is richer than the air-fuel ratio where the catalytic conversion efficiency of said upstream catalyst is maximum.

* * * * *